US009676548B2

(12) United States Patent
Bradford et al.

(10) Patent No.: US 9,676,548 B2
(45) **Date of Patent: *Jun. 13, 2017**

(54) CONTAINER HAVING GENERALLY L-SHAPED SLOTTED TRACKS TO FACILITATE MOVEMENT OF DUNNAGE

(71) Applicant: Bradford Company, Holland, MI (US)

(72) Inventors: Judson A. Bradford, Holland, MI (US); Allen L. Burns, Holland, MI (US); Matthew S. Sanger, West Olive, MI (US); Brian T. Dobrinski, Zeeland, MI (US); Eric S. Bruinsma, Holland, MI (US); Timothy A. Bublitz, Grand Haven, MI (US)

(73) Assignee: Bradford Company, Holland, MI (US)

( * ) Notice: Subject to any disclaimer, the term of this patent is extended or adjusted under 35 U.S.C. 154(b) by 222 days.

This patent is subject to a terminal disclaimer.

(21) Appl. No.: 14/539,339

(22) Filed: Nov. 12, 2014

(65) Prior Publication Data

US 2015/0069053 A1 Mar. 12, 2015

Related U.S. Application Data

(63) Continuation-in-part of application No. 13/896,675, filed on May 17, 2013, now Pat. No. 9,233,790, (Continued)

(51) Int. Cl.
*B65D 25/04* (2006.01)
*B65D 25/10* (2006.01)
(Continued)

(52) U.S. Cl.
CPC ..... *B65D 88/54* (2013.01); *B65D 19/06* (2013.01); *B65D 19/44* (2013.01); *B65D 25/005* (2013.01);
(Continued)

(58) Field of Classification Search
CPC ..... B65D 2585/6887; B65D 25/06
(Continued)

(56) References Cited

U.S. PATENT DOCUMENTS 634,589 A 10/1899 Russell
1,712,168 A 5/1929 Rand, Jr.
(Continued)

FOREIGN PATENT DOCUMENTS

DE 19549166 3/1997
DE 20101374 4/2001
(Continued)

OTHER PUBLICATIONS

FR_2619360_translation.pdf.*

*Primary Examiner* — J. Gregory Pickett
*Assistant Examiner* — Allan Stevens
(74) *Attorney, Agent, or Firm* — Wood, Herron & Evans, LLP

(57) ABSTRACT

A container for holding product therein during shipment and being returned for reuse has guides containing generally L-shaped slotted tracks having horizontal and vertical portions. A plurality of dunnage supports extend between the tracks. Dunnage is suspended by the dunnage supports. The dunnage supports have narrowed portions engaged with the slotted tracks.

20 Claims, 50 Drawing Sheets

Related U.S. Application Data which is a continuation-in-part of application No. 13/616,635, filed on Sep. 14, 2012, now Pat. No. 9,004,307, which is a continuation-in-part of application No. 13/888,686, filed on May 7, 2013.

(51) Int. Cl.

| | |
|---|---|
| ***B65D 81/05*** | (2006.01) |
| ***B65D 88/54*** | (2006.01) |
| ***B65D 88/12*** | (2006.01) |
| ***B65D 90/00*** | (2006.01) |
| ***B65D 85/68*** | (2006.01) |
| ***B65D 19/06*** | (2006.01) |
| ***B65D 19/44*** | (2006.01) |
| ***B65D 25/00*** | (2006.01) |

(52) U.S. Cl.

CPC ..... *B65D 85/68* (2013.01); *B65D 88/12* (2013.01); *B65D 90/008* (2013.01); *B65D 90/0046* (2013.01); *B65D 2519/00024* (2013.01); *B65D 2519/00034* (2013.01); *B65D 2519/00044* (2013.01); *B65D 2519/00059* (2013.01); *B65D 2519/00069* (2013.01); *B65D 2519/0082* (2013.01); *B65D 2519/00164* (2013.01); *B65D 2519/00174* (2013.01); *B65D 2519/00184* (2013.01); *B65D 2519/00233* (2013.01); *B65D 2519/00268* (2013.01); *B65D 2519/00273* (2013.01); *B65D 2519/00288* (2013.01); *B65D 2519/00293* (2013.01); *B65D 2519/00318* (2013.01); *B65D 2519/00323* (2013.01); *B65D 2519/00333* (2013.01); *B65D 2519/00422* (2013.01); *B65D 2519/00497* (2013.01); *B65D 2519/00502* (2013.01); *B65D 2519/00532* (2013.01); *B65D 2519/00562* (2013.01); *B65D 2519/00611* (2013.01); *B65D 2519/00621* (2013.01); *B65D 2519/00666* (2013.01); *B65D 2519/00701* (2013.01); *B65D 2519/00805* (2013.01); *B65D 2585/6882* (2013.01); *B65D 2585/6887* (2013.01)

(58) Field of Classification Search

USPC ..... 220/545, 546, 547, 548, 544, 542, 541, 220/540, 539, 538, 537, 536, 535, 534, 220/529

See application file for complete search history.

(56) References Cited

U.S. PATENT DOCUMENTS

| | | | |
|---|---|---|---|
| 4,527,694 | A | 7/1985 | Bolt et al. |
| 4,602,815 | A | 7/1986 | Boots et al. |
| 4,685,571 | A | 8/1987 | Hoss |
| 4,721,317 | A | 1/1988 | Avot |
| 4,770,314 | A | 9/1988 | Giesler |
| 4,821,879 | A | 4/1989 | Kupersmit |
| 4,864,686 | A | 9/1989 | Lasier et al. |
| 4,988,006 | A | 1/1991 | Lundin |
| 5,238,139 | A | 8/1993 | Bisceglia |
| 5,324,105 | A | 6/1994 | Christensen |
| 5,407,262 | A | 4/1995 | Christian et al. |
| 5,560,507 | A | 10/1996 | Arpin et al. |
| 5,725,119 | A | 3/1998 | Bradford et al. |
| 5,813,566 | A | 9/1998 | Bradford et al. |
| 5,815,903 | A | 10/1998 | Foster et al. |
| 6,062,410 | A | 5/2000 | Bradford et al. |
| 6,164,440 | A | 12/2000 | Van Bree |
| 6,202,884 | B1 | 3/2001 | Verkerke |
| 6,230,916 | B1 | 5/2001 | Bradford et al. |
| 6,305,764 | B1 | 10/2001 | Kortman et al. |
| 6,540,096 | B1 | 4/2003 | Bazany et al. |
| 6,830,156 | B2 | 12/2004 | MacKelvie |
| 7,125,062 | B2 | 10/2006 | Kiester et al. |
| 7,748,559 | B2 | 7/2010 | Bradford |
| 7,762,422 | B2 | 7/2010 | Dobrinski |
| 7,870,970 | B2 | 1/2011 | Fisk |
| 8,100,282 | B2 | 1/2012 | Nyeboer et al. |
| 2003/0168461 | A1 | 9/2003 | Richardson |
| 2006/0249416 | A1 | 11/2006 | Bradford et al. |
| 2006/0249514 | A1 | 11/2006 | Bazany et al. |
| 2008/0023470 | A1 | 1/2008 | Bradford |
| 2008/0078729 | A1 | 4/2008 | Bazany et al. |
| 2012/0043865 | A1 | 2/2012 | Newkirk et al. |
| 2012/0061387 | A1 | 3/2012 | Nam |
| 2013/0057135 | A1 | 3/2013 | Bradford et al. |

FOREIGN PATENT DOCUMENTS

| | | | | |
|---|---|---|---|---|
| DE | 20318172 | | 5/2004 | |
| FR | 1455414 | | 4/1966 | |
| FR | 2619360 | B1 * | 12/1989 | ..... B65D 5/48024 |
| FR | 2860504 | | 4/2005 | |
| JP | 6-59230 | | 8/1994 | |
| WO | 9310024 | | 5/1993 | |

* cited by examiner

CONTAINER HAVING GENERALLY L-SHAPED SLOTTED TRACKS TO FACILITATE MOVEMENT OF DUNNAGE

CROSS-REFERENCE TO RELATED APPLICATIONS

This application is a continuation-in-part of U.S. patent application Ser. No. 13/896,675 filed May 17, 2013, which is a continuation-in-part of U.S. patent application Ser. No. 13/616,635 filed Sep. 14, 2012, now U.S. Pat. No. 9,004,307. This application is also a continuation-in-part of U.S. patent application Ser. No. 13/888,686 filed May 7, 2013, now U.S. Pat. No. 9,010,563. All of these applications are fully incorporated by reference herein.

FIELD OF THE INVENTION

The present invention relates to containers for use in shipping and, more particularly, to containers with movable members for supporting product.

BACKGROUND OF THE INVENTION

A large number of different container structures are utilized by manufacturers to ship a variety of different products to end users, which may be, for example, assembly plants. In the automobile industry, for example, an assembly plant assembling a particular automobile might utilize a number of different parts from different manufacturers. These manufacturers ship their respective parts to the assembly plant in container structures where the parts are then removed from dunnage or support members inside the container structure and assembled into a finished automobile.

Access to the product in the containers is of particular concern. Specifically, in the automotive industry, the containers full of product are positioned on an assembly line adjacent to a work area, which is associated with a particular product to be installed on a manufactured vehicle. For example, a container full of interior door panels is usually positioned next to a particular station on an assembly line where interior door panels are installed so that a line worker may easily access the door panels inside the container. The product or part is taken directly from the container and used on the line. Some existing containers are difficult to access, which makes removal of the parts therein difficult and time consuming. For example, some containers are configured so that a line worker must walk around the container to remove parts or products from opposite ends of the container. As may be appreciated, a line worker only has a certain amount of time to install a part. Any delay in access and removal of the part from the container is undesirable.

In many containers, a line worker or employee must insert or remove parts from a distal or rear part of the container. The size and/or weight of the parts or work pieces may cause stress or strain on the line worker and, more particularly, on the back of the worker when inserting or removing parts from such a container. Such ergonomically unfriendly movements may cause physical trauma, pain and other injuries that may lead to lost production time.

In some situations, in order to alleviate such stress and/or strain on his or her body, the line worker may move to the rear or opposite end of the container to remove parts from inside the container. This requires space around the container which may not be available, depending on the physical layout of the plant or facility. The length (front to back) of certain containers may be limited because the container manufacturer needs to eliminate the need for a line worker to walk around the container to remove product from inside the container. Such containers having a reduced length reduce the number of parts or products which may be shipped and/or stored in the container. The more containers needed to ship a predetermined number of parts, the greater the cost to the shipper.

In other containers, a line worker or employee must lean forward and bend down into the container to insert or remove a part or work piece from a lower portion of the container. This movement by the line worker is ergonomically unfriendly because the line worker must lean forward and bend down and lift a part or workpiece up and over a wall into the container to remove the part or work piece from inside the container. Similarly, when a part or workpiece must be inserted into a container, the line worker may have to lean forward and insert the part, which may be heavy, into its proper location inside the container, again experiencing ergonomically unfriendly movements. Such movements may be necessary with many top loading containers and/or containers having multiple layers or levels of parts.

Depending upon the number of times the line worker repeats this unnatural motion into the interior of the container, strain in the back, legs and arms may result. The size and/or weight of the parts or work pieces may increase the strain on the line worker. Thus, simply removing multiple parts during a work day may cause physical trauma, pain and other injuries that may lead to lost production time.

Accordingly, there is a need for a container which prevents employees from walking around the container to insert or remove product from inside the container.

There is further a need for a container which prevents employees from having to perform difficult or straining repetitive reaching motions.

There is further a need for a container which brings product into an ergonomically friendly area or zone for insertion or removal of the product.

SUMMARY OF THE INVENTION

The present invention provides a container for holding product therein during shipment that comprises a bottom, a front and two sides. In one embodiment, a guide is spaced inwardly from each side of the container. Each of the guides is secured to one of the container sides and has a generally L-shaped stationary slotted track formed therein. Each of the generally L-shaped stationary slotted tracks has a substantially horizontally oriented portion and a substantially vertically oriented portion when the container is resting on the floor. The substantially horizontally oriented portion of each track is located proximate the open top of the container, and the substantially vertically oriented portion is located proximate the front of the container where a door may be located.

The container further comprises a plurality of movable dunnage supports generally inside the container that are supported by the guides. For purposes of this document, the terms "dunnage support" may include a unitary member or multiple components secured together. For example, a "dunnage support" may comprise in combination a tubular support and a pair of end members which move or slide inside slotted tracks, both in a horizontal direction and vertical direction. Alternatively, each "dunnage support" may be a unitary member.

Each dunnage support has a narrowed portion at each end. The narrowed portions of each dunnage support are engaged with and slidable along the slotted tracks in the guides to facilitate movement of the dunnage supported by the dunnage supports.

According to another aspect of the present invention, the container has a bottom and at least two side structures. The container further comprises a guide supported each of the side structures. Each of the guides has a generally L-shaped slotted track comprising at least one generally horizontally oriented portion and at least one generally vertically oriented portion which remain fixed during the loading and unloading of products. Each generally vertically oriented portion may extend downwardly from an end of the generally horizontally oriented portion of each track. Each of the stationary generally "L"-shaped tracks may have a curved or arcuate corner having a radius. Each of the guides may be made of any number of pieces of material or be a unitary piece.

A plurality of dunnage supports is located generally inside the container. Each of the dunnage supports has narrowed portions, the narrowed portions of each dunnage support being engaged with and movable along the stationary slotted tracks to facilitate movement of the dunnage supports. Dunnage is supported by the dunnage supports. The dunnage may be pouches or any other known dunnage. The dunnage may be secured to the dunnage supports in any known manner.

The container may also include at least one space limiter attached to the dunnage to limit the distance adjacent dunnage supports may be moved or separated from each other. Each space limiter may be a fabric strap or like component that can flex when the distance between the dunnage supports is minimized and yet only stretch a predetermined distance to allow the dunnage supports to move a predetermined distance apart from each other. Space limiters or straps may be located on opposite sides of the container so two straps connect front and rear walls of a pouch or adjacent pouches. The straps may be made of the same material as the dunnage, or may be any other suitable material.

According to another aspect of the invention, the container comprises a bottom and at least two opposed sides. A guide is space from each of the sides of the container by at least one spacer. Each of the guides has a generally L-shaped slotted track comprising a generally horizontally oriented portion and at least one generally vertically oriented portion. Each generally vertically oriented portion may extend downwardly from an end of the generally horizontally oriented portion of each track.

In some embodiments, the container has a movable door on one side of the container which may be lowered for ergonomic reasons. An operator may find loading and/or unloading parts from the dunnage in the container to be easier and less stressful on his/her body when the door is in a lowered position. Alternative containers may have two doors on opposite sides of the container. Each of the doors, regardless of whether the container has one or two doors, may comprise multiple panels, at least one of which may be movable.

In the situation in which each side of the container has a track having two generally vertically oriented portions extending downwardly from opposite ends of a generally horizontal portion of the track, the container could have two doors. In such a container, each of the stationary generally "U-shaped" tracks may have curved or arcuate corners, each corner having a radius. The container further comprises dunnage supports supported by the tracks and extending therebetween. Each of the dunnage supports may comprise a pair of end members engaged with and movable along the tracks and a support extending between the end members, the support surrounding a portion of each of the end members. The container further comprises dunnage supported by the dunnage supports.

The container may be adapted so that an operator located at the front of the container may pull product to be emptied from the rear of the container forwardly to a more ergonomically friendly position after products suspended from dunnage at the front of the container have been unloaded or removed. Thus, a person unloading the container from the front or proximal location of the container will not have to stretch or reach to the back of the container to unload remaining product.

Similarly, a person loading the container from the front of the container need not stretch or reach to the back of the container to insert or load product into the container. The loader of the container may push the dunnage supports and associated dunnage loaded with product rearwardly and load additional product in a more ergonomically friendly position or manner. For example, after product is loaded into dunnage suspended by adjacent dunnage supports, these dunnage supports and associated dunnage are pushed rearwardly to enable the loader to load additional product. Thus, the container allows product to be more efficiently and safely removed from the container or inserted therein without unnecessary stress or strain on the operator.

In some embodiments having a single door, the generally vertically oriented track portions may be located at the front of the container only proximate the door. In such embodiments, the container has two generally vertically oriented track portions, one on each side of the container. Alternatively, in some embodiments, the containers may have two doors and generally vertically oriented track portions proximate each door. In such embodiments, the container has four generally vertically oriented track portions, two on each side of the container.

In either case, the generally vertically oriented track portions provide a mechanism for one of the dunnage supports supporting a wall of a dunnage pouch to move downwardly out of the way of the loader/unloader. With the front dunnage support lower than the rear dunnage support supporting a dunnage pouch, the loader/unloader has an easier time loading or unloading a product into or out of the dunnage pouch because he or she does not have to lift the product as far in a vertical direction. This capability of the container to ease the loading or unloading procedure may reduce the number of injuries and down time and thus, save costs. The drop down door or doors and L-shaped or U-shaped tracks inside the container allow parts to be removed from inside the container with minimal lifting, making the process of unloading a container easier and less stressful on the operator's body than previously known. Similarly, such configurations of containers make the process of loading a container with parts for shipment easier and less stressful on the operator's body than using previously known containers.

The ease of operation and other objects and advantages of the present invention shall be made apparent from the accompanying drawings and the brief description thereof.

BRIEF DESCRIPTION OF THE DRAWINGS

The accompanying drawings, which are incorporated in and constitute a part of this specification, illustrate embodiments of the invention and, together with a general description of the invention given above and the detailed description of the embodiments given below, serve to explain the principles of the invention.

DETAILED DESCRIPTION OF THE INVENTION

Figure 1:
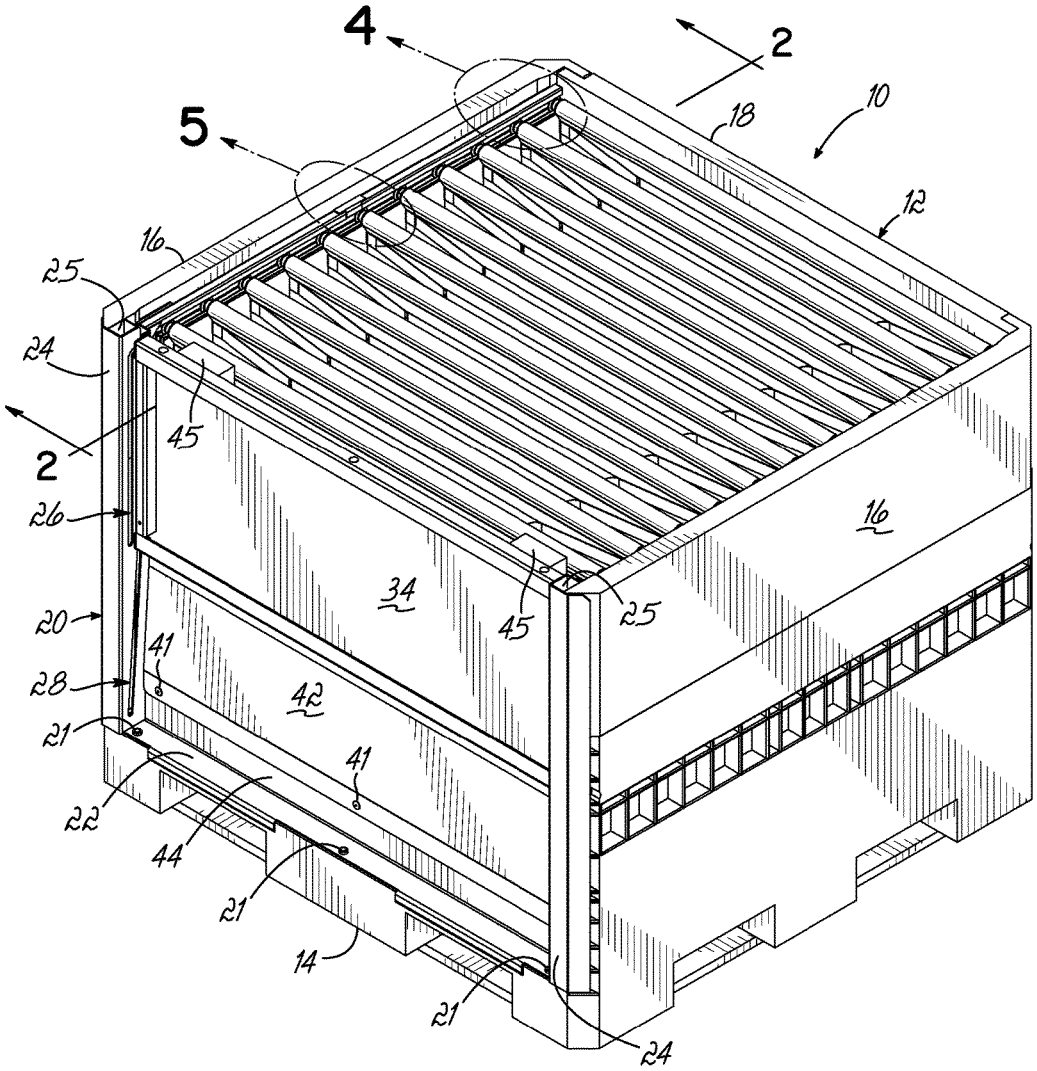
FIG. 1 is a perspective view of one embodiment of a reusable and returnable container.

Referring to FIG. 1, there is illustrated a reusable and returnable container 10 according to one embodiment. The reusable and returnable container 10, as shown, comprises a body 12 having a base 14, opposed side walls 16 and a rear wall 18, all extending upwardly from the base 14. The side walls 16 and/or rear wall 18 may be hingedly secured to the base 14. A generally U-shaped front frame 20 may be fixedly secured to the side walls 16 and does not move relative to the side walls 16 after the container is assembled. The front frame 20 may be made of metal or any other suitable material.

Figure 2:
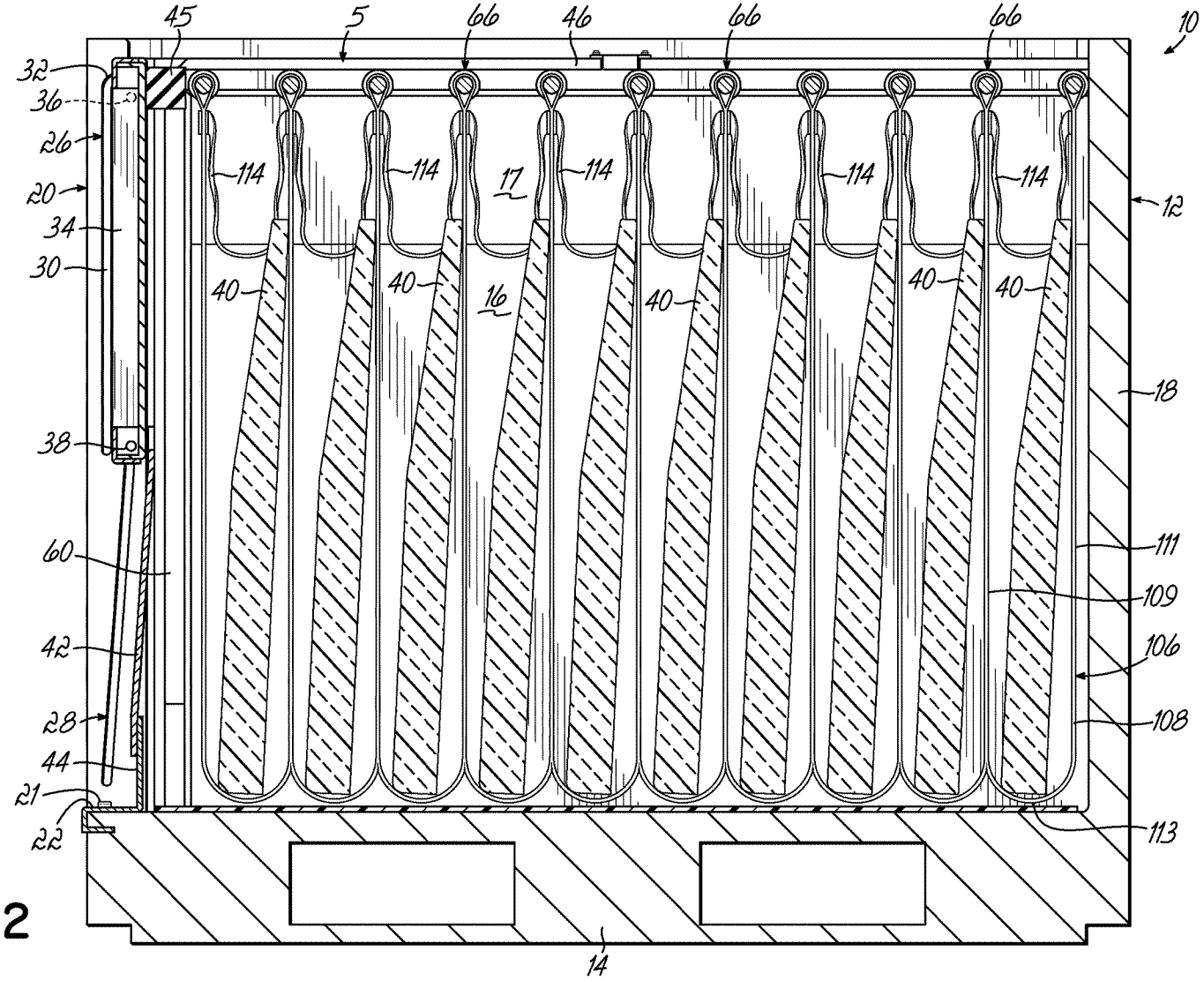
FIG. 2 is a cross-sectional view taken along the line 2-2 of FIG. 1 showing products being suspended by a plurality of pouches.

As shown in FIG. 2, a bumper 17 may be secured to each of the side walls 16 (only one being shown). Each bumper 17 functions to protect the products 40 from contacting the side walls 16 and being scratched or damaged in some fashion. The bumpers may be made of foam or any other suitable material. If desired, the bumpers may be omitted.

Although one specific shape of product 40 is illustrated in the drawings, this document is not intended to limit in any way the size, shape or configuration of product 40 shipped or stored in any of the embodiments described or shown herein. One type of product which may be used in accordance with the present invention is car door panels.

Although one type of container is illustrated, the present invention may be used with other types or configurations of container. For example, each side wall may not be a solid wall.

As best shown in FIG. 1, the front frame 20 comprises a frame base 22 and two side posts 24 extending upwardly from the frame base 22. The frame base 22 is fixedly secured to the base 14 of the container 10 with rivets or fasteners 21, while the side posts 24 of the front frame 20 are secured to the container side walls 16.

Each of the side posts 24 of the front frame 20 is generally rectangular in cross-section and has a hollow interior 25. Each of the side posts 24 of the front frame 20 has two slots therethrough, an upper slot 26 and a lower slot 28. However, any number of slots of any desired shape may be incorporated into the side posts. As best shown in FIGS. 3A-3D, upper slot 26 has a "candy cane" shape comprising a straight portion 30 and a curved upper portion 32. The lower slot 28 is linear, as best illustrated in FIG. 2. These upper and lower slots 26, 28 are used to secure a movable door segment or portion 34 in a fixed position and guide the door segment 34 during its movement from an upper or raised position and a lower or dropped position. As best shown in FIGS. 2 and 3A-3D, the door segment 34 has a pair of upper pins 36 extending outwardly from the door segment 34 and adapted to ride or move inside the upper slots 26. Similarly, the door segment 34 has a pair of lower pins 38 extending outwardly from the door segment 34 and adapted to ride or move inside the lower slots 26. FIG. 2 shows the door segment 34 locked in a raised position with the upper pins 36 located at the upper ends of the curved portions 32 of the upper slots 26. As the door segment 34 is lowered, it moves outside a shield 42 secured with rivets or fasteners 41 to a vertically oriented flange 44 of the frame base 22 of the front frame 20. See FIG. 2.

As best shown in FIG. 1, a pair of spaced stops 45 are secured to door segment 34. The stops 45 may be made of foam or any other suitable material. When the door segment 34 is in its raised position, stops 45 function to prevent the support member assemblies and associated dunnage from sliding down the vertically oriented tracks from the horizontally oriented tracks. The stops 45 also function to prevent products 40 from hitting the door segment 34 during the loading or unloading process. Although two stops 45 are illustrated per door segment 34, a continuous stop or a different number of stops may be utilized of any desired configuration or size.

Figure 4:
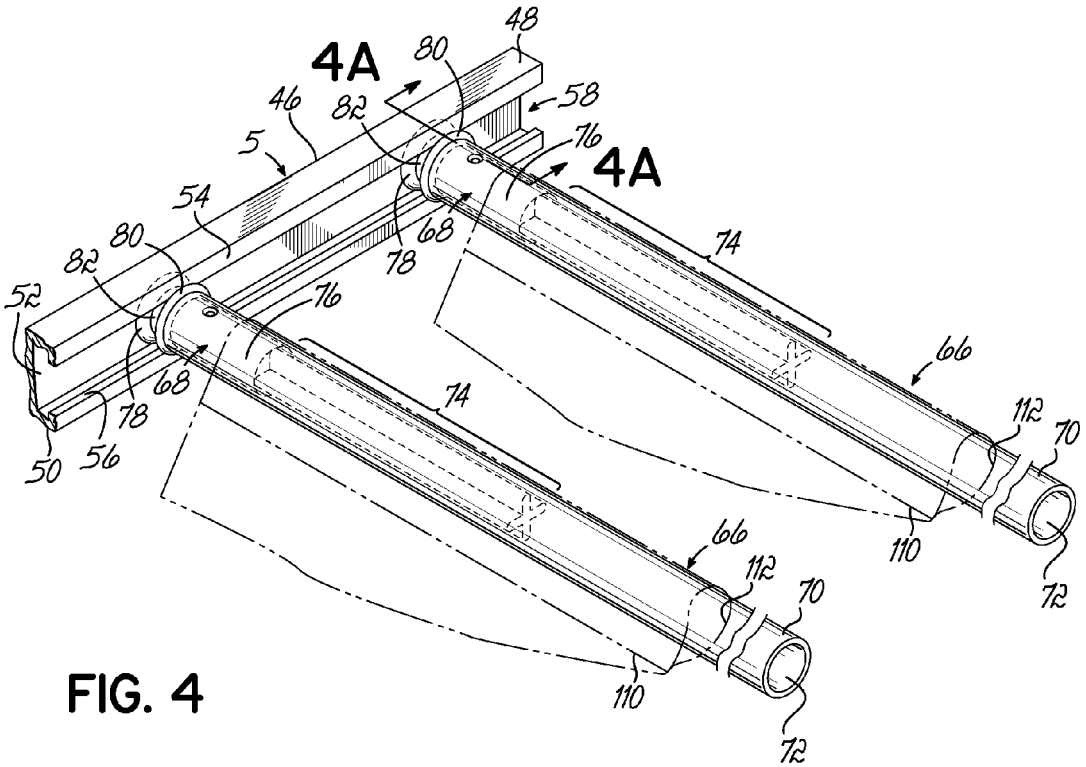
FIG. 4 is an enlarged view of the encircled area 4 of FIG. 1.

As best shown in FIG. 2, container 10 further comprises a generally "L-shaped" track 5 secured to each side wall 16 of the container 10, which does not move relative to the side wall 16 after the container 10 is assembled and during the loading or unloading processes (only one being shown in FIG. 2). Each "generally L-shaped" track 5 comprises a generally horizontally oriented track portion 46 and a generally vertically oriented track portion 60, each being fixedly secured to a side wall 16 of the container 10. Each "generally L-shaped" track 5 may be constructed of several pieces or may be a unitary piece. As shown in FIG. 4, each generally horizontally oriented track portion 46 and each generally vertically oriented track portion 60 has an upper wall 48, a lower wall 50 joined to the upper wall 48 by a side wall 52, and a lip 54 extending downwardly from the upper wall 48 and another lip 56 extending upwardly from the lower wall 50 defining an interior 58 of the track 46.

As best shown in FIGS. 3A-3D, generally vertically oriented track portion 60 of "generally L-shaped" track 5 is also fixedly secured to each side wall 16 of the container 10. The generally vertically oriented track portion 60 and generally horizontally oriented track portion 46, each being fixedly secured to the side walls 16 of the container 10, do not move after the container 10 is assembled and do not move relative to the side walls 16 of the container 10 during the loading or unloading of parts or products. On each side of the container, the top of the generally vertically oriented track portion 60 may connect or communicate with the front end of the generally horizontally oriented track portion 46 at corner 62. The generally vertically oriented track portion 60 may be the same construction and/or material as the horizontally oriented track portion 46, or they may be slightly different. The interior 58 of the generally horizontally oriented track portion 46 connects with the interior of the generally vertically oriented track portion 60 so that one of the dunnage supports 66 may move along a continuous path in both a horizontal and vertical direction. The generally horizontally oriented track portion 46 and generally vertically oriented track portion 60 may be separate pieces welded or joined together, or may be a unitary generally "L-shaped" piece of track fixedly secured to each of the side walls 16. In either event, a corner piece 64 may be welded or otherwise secured to each corner 62 to prevent the end members or portions of the dunnage supports 66 from coming out of the tracks at the corner.

Referring to FIG. 4, container 10 further comprises a plurality of dunnage supports 66 extending between the tracks of opposed side walls 16. Each dunnage support 66 includes a pair of sliders or end members 68 and a tubular support 70 having a hollow interior 72 extending therebetween. The sliders 68 are preferably made of injection molded plastic, such as nylon, but may be made of any other material. The tubular support 70 is preferably made of metal, but may be made of other suitable material, such as plastic.

As shown in FIG. 4, each slider 68 preferably has a first portion 74 having an X-shaped cross-sectional configuration and a second portion 76 having a circular cross-sectional configuration. Although one configuration of slider 68 is illustrated, any type or configuration of slider may be used with the present invention. In this embodiment, each slider 68 has a pair of heads 78, 80 at the end of the slider 68. Head 78 is furthest from the first portion 74 of the slider 68, and head 80 is spaced inwardly from head 78. The heads 78, 80 are spaced from one another to define a groove 82 therebetween which receives and retains the lips 54, 56 of the stationary tracks 46, 60. As shown in FIG. 4, head 78 is located inside the interior 58 of tracks 46, 60 and head 80 is located outside the interior 58 of stationary tracks 46, 60. Head 78 keeps the slider 68 engaged with the tracks 46, 60 while head 80 keeps the dunnage material out of the interior 58 of the tracks 46, 60, thereby ensuring that the sliders 68 may move smoothly along the stationary tracks. Although one configuration of support member assembly 66 is illustrated, the present invention may be used with any type or configuration of support member assembly for supporting dunnage so the dunnage may slide or move inside the container.

As shown in FIG. 4, each end of tubular support 70 fits over at least one portion 74 of a slider 68. An end surface 84 of tubular support 70 abuts head 80 of slider 68. Each end member or slider 68 of each dunnage support 66 is adapted to engage and move along one of the tracks. The end members 68 preferably slide along the length or width of the tracks; however, different end members may rotate rather than slide along the tracks. Although one configuration of track and end member is shown and described, other types of end members and tracks may be used if desired.

Figure 4A:
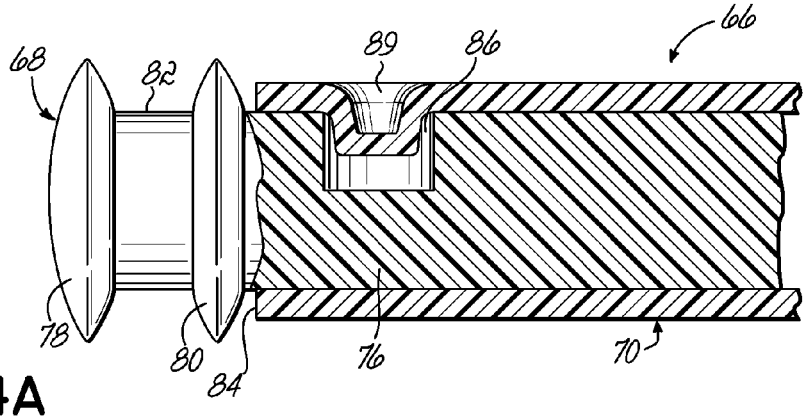
FIG. 4A is a view taken along the line 4A-4A of FIG. 4.

As best shown in FIG. 4A, dunnage support 66 includes a pair of sliders 68 (only one being shown in FIG. 4A). Each slider 68 has a groove 86 formed in a second portion 76 therein. Dunnage supports 66 further include a tubular support 70 having a hollow interior 72 extending therebetween. The tubular support 70 is preferably made of metal, but may be made of other suitable material, such as plastic. As shown in FIG. 4A, each end of tubular support 70 fits over at least the first portion 74 of a slider 68. An end surface 84 of tubular support 70 abuts head 80 of slider 68. As shown in FIG. 4A, tubular support 70 has two detents 89 therethrough (one at each end) in which the material of the tubular support is pressed downwardly into the groove 86. This attachment between each of the two sliders 68 and the tubular support 70 enables some movement therebetween. Such interaction between the sliders 68 and tubular support 70 allows for a tolerance of approximately one-quarter inch on each side. The detents 89 prevent separation of the tubular support 70 from the sliders 68 while allowing some movement therebetween as the detents 89 move within the grooves 86 formed in the sliders 68.

Figure 4B:
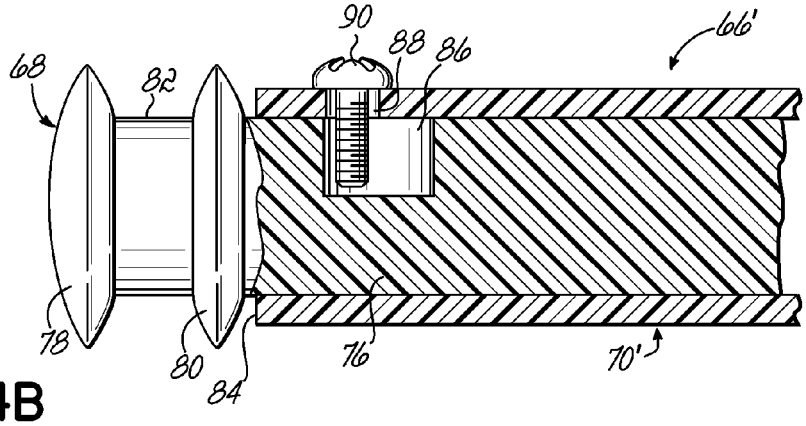
FIG. 4B is a cross-sectional view of a portion of an alternative dunnage support.

As shown in FIG. 4B, a slightly different dunnage support 66', including a pair of sliders 68 (only one being shown in FIG. 4B), may be used. Dunnage support 66' is slightly different than dunnage support 66 shown in FIG. 4A and described above. As shown in FIG. 4B, the only difference between dunnage support 66' and dunnage support 66 shown in FIG. 4A is that tubular supports 70' are slightly different than the tubular supports 70; they lack detents 89. See FIG. 4A. Each dunnage support 66' includes a tubular support 70' having a hole 88 at each end. The tubular support 70' is preferably made of metal, but may be made of other suitable material, such as plastic. As shown in FIG. 4B, each end of tubular support 70' fits over at least the first portion 74 of a slider 68. An end surface 84 of tubular support 70' abuts head 80 of slider 68. As shown in FIG. 4B, tubular support 70' has holes 88 therethrough, which receive fasteners 90. Although fasteners 90 are shown as screws, they may be any other type of fasteners. The fasteners 90 prevent separation of the tubular support 70' from the sliders 68 while allowing some movement therebetween as the fastener 90 moves within the grooves 86 formed in the sliders 68. Other known means of securing the tubular support 70 to the sliders 68 may be used if desired.

FIGS. 1 and 4 illustrate all of the dunnage supports 66 having detents 89, as shown in FIG. 4A. Alternatively, containers may be made with all of the dunnage supports having fasteners, like dunnage supports 66'. Alternatively, some of the dunnage supports may have fasteners like dunnage supports 66', and some may have detents like dunnage supports 66. Containers may have a mixture thereof.

Figure 5:
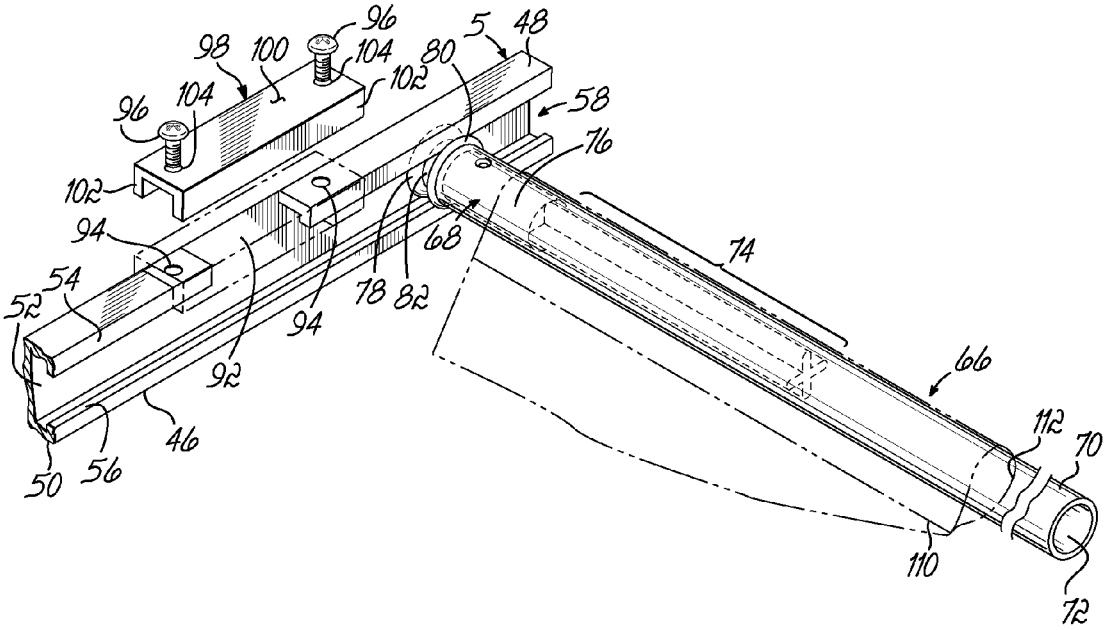
FIG. 5 is an enlarged view of the encircled area 5 of FIG. 1.
Figure 6:
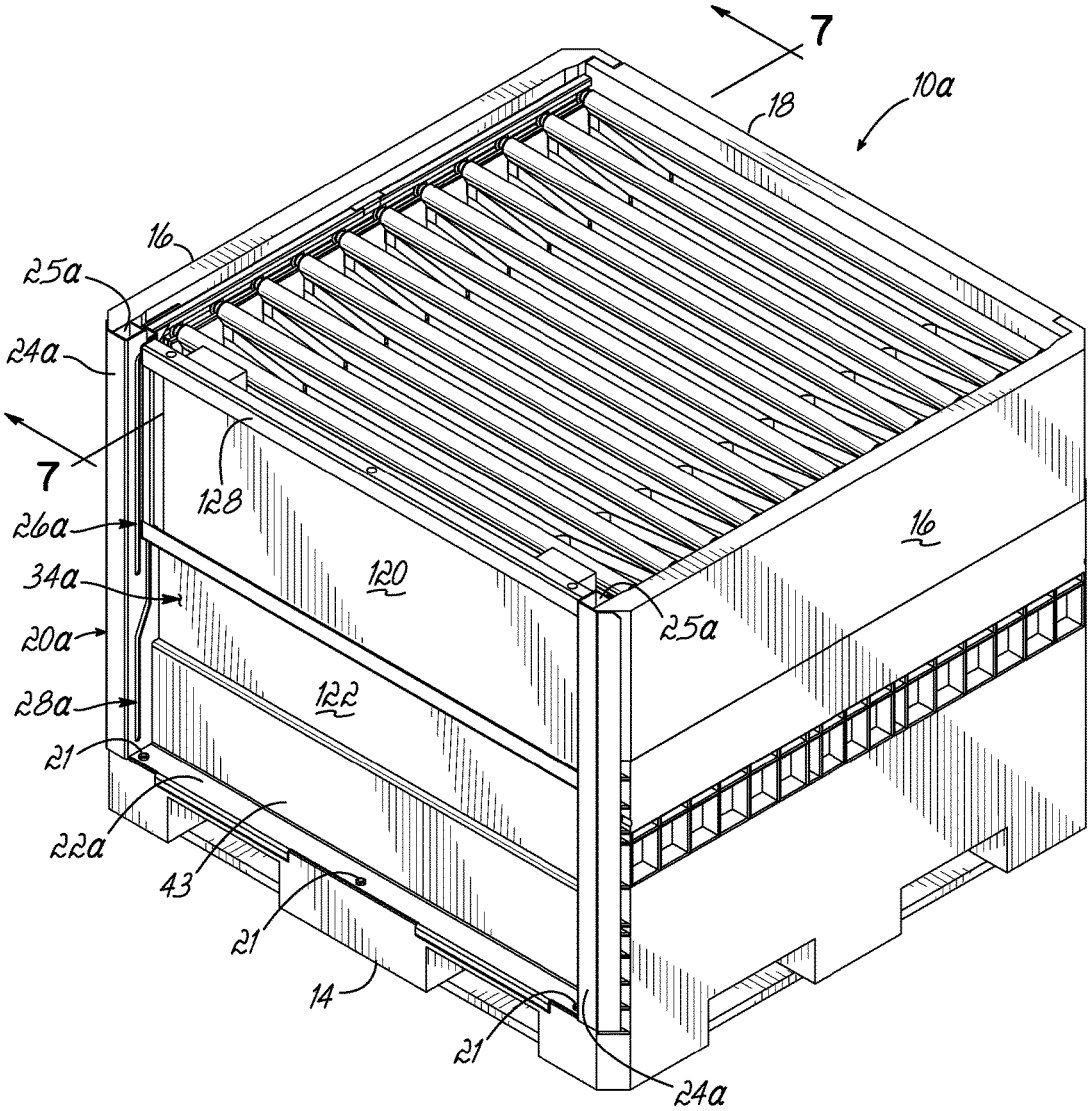
FIG. 6 is a perspective view of an alternative embodiment of reusable and returnable container.

FIG. 5 illustrates another dunnage support 66, exactly like the one shown in FIG. 4A, used to support one of the pouches. However, FIG. 5 illustrates another innovative feature or aspect of the invention. Track portion 46 has an opening or cut-out 92 formed therein. Holes 94 are formed in the upper wall 48 of track portion 46, which are sized and threaded to receive fasteners 96. Although fasteners 96 are illustrated to be screws, they may be any other desirable fastener. A cap 98 is removably secured to the track portion 46 to cover the opening or cut-out 92 formed in an upper portion of track portion 46. As best seen in FIG. 5, cap 98 has a generally inverted U-shaped cross-sectional configuration, including a top portion 100 and side portions 102 extending downwardly from the top portion 100. Holes 104 are formed through the top portion 100 of the cap 98 and sized to receive fasteners 96, as shown in FIG. 5. The fasteners 96 are adapted to pass through the holes 104 in the cap 98 and into the holes 94 in the upper wall 48 of the track portion 46. Caps of alternative shapes or sizes may be used if desired.

When one of the sliders 68 or any part of support member assemblies 66, 66' is damaged or needs to be replaced for any reason, one may remove cap 98 after loosening fasteners 96, thereby exposing the opening or cut-out 92 of track portion 46. The support member assemblies 66, 66' may then be removed or inserted as necessary to repair or replace the damaged part or parts.

As best shown in FIG. 2, dunnage 106 in the form of a plurality of pouches 108 is suspended by and supported by a plurality of support member assemblies 66. Each pouch 108 has a front wall 109, a rear wall 111 and a bottom 113 extending therebetween. As shown in FIG. 2, the top of the front wall 109 is attached to one of the support member assemblies 66 and the rear wall 111 being attached to an adjacent support member assembly 66. Although the dunnage 106 shown comprises pouches, the dunnage may assume other shapes or configurations. A pouch 108 is supported by two adjacent support member assemblies 66. As shown in FIG. 4, the fabric of the pouch 108 is sewn or otherwise secured together along a seam 110 to make a pocket 112 in which is located a tubular support 70 of the support member assembly 66.

Dunnage supports 66 supporting pouches 108 are adapted to move from back to front inside the interior of the container 10, the end members or sliders 68 of the dunnage supports 66 moving along the stationary tracks 5 in generally horizontal and generally vertical directions.

Multiple pouches 108 may be formed or created from one piece of material draped or laying over and secured to the dunnage supports 66. Alternatively, each pouch 108 may be made from its own piece of material, in which case, the pouches 108 would not be interconnected other than via the straps or space limiters 114.

The reusable and returnable container 10 may also have at least one space limiter or strap 114 which, as shown in FIGS. 2 and 3A-3D, limits the distance the dunnage supports 66 may be moved away from one another due to the fact that each space limiter 114 is secured to the dunnage of adjacent dunnage supports 66. Typically, the length or distance of the space limiter 114 between locations where the space limiter 114 is secured to the dunnage will be fixed to prevent the dunnage supports 66 from moving farther apart than necessary for the insertion or removal of product 40 into or from the pouches. The space limiter 114 may be secured to the dunnage 106 in any suitable fashion including, but not limited to, sewing, fastening, etc. Of course, when the dunnage supports 66 are moved to a position adjacent to one another, the flexibility of the space limiters 114 allows for such movement. The space limiter 114, as shown, is preferably comprised of a fabric strap, but may be made of any other suitable material, such as plastic. Preferably, two space limiters or straps 114, one on each side of a pouch 108, connect adjacent walls 109, 111 of a pouch 108. However, any number of straps 114 may be used to connect any number of pouches.

Figure 2A:
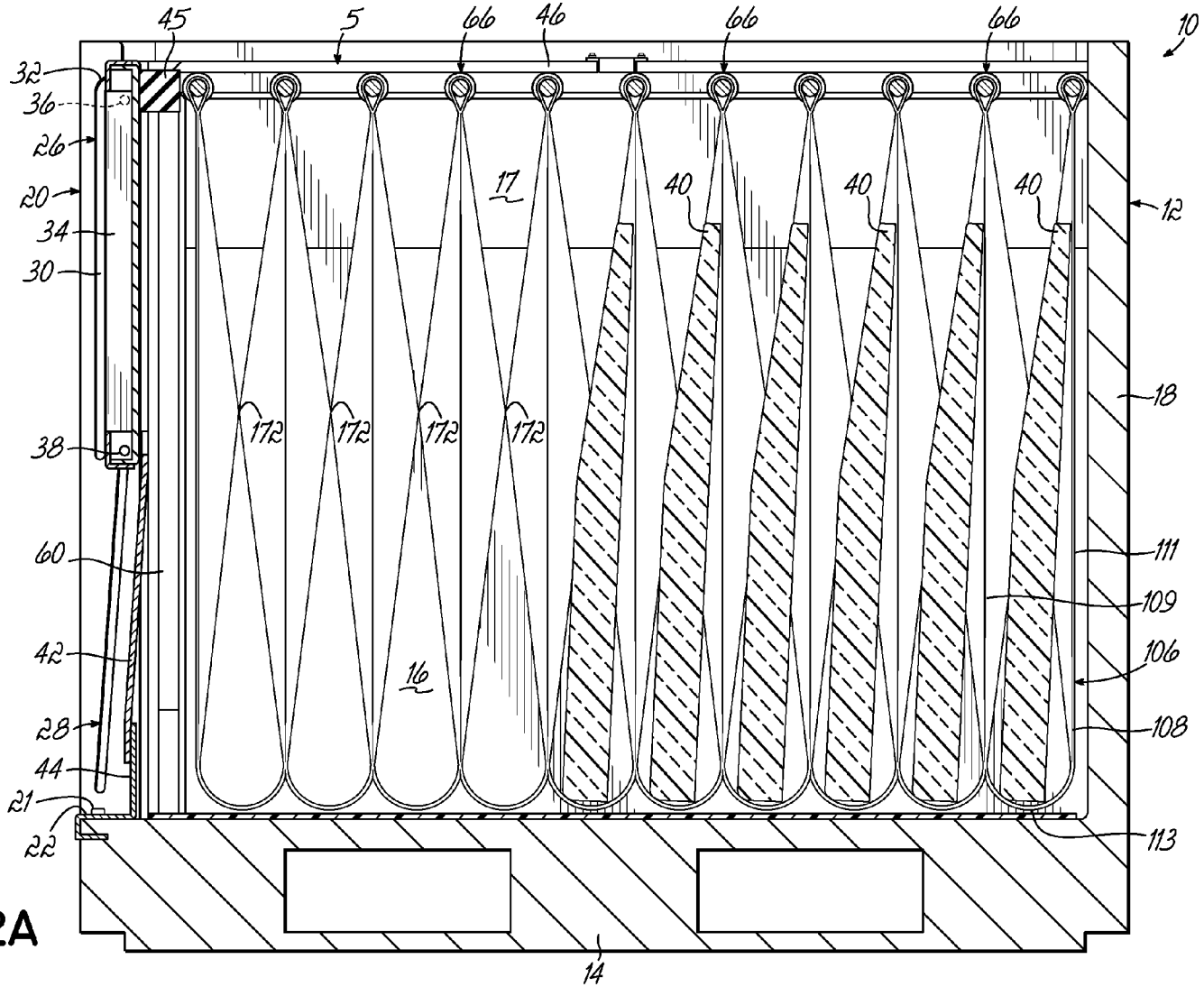
FIG. 2A is a cross-sectional view like FIG. 2 showing an alternative form of dunnage inside the container of FIG. 1.

As shown in FIG. 2A, straps 114 may be omitted and replaced with two side sewn locations 172 (only one being shown in FIG. 2A). Each pouch 108 has two sewn locations 172 on opposite sides of the pouch 108, thereby enabling the product 40 to be inserted or removed as desired. Each sewn location 172 comprises the front and rear walls 109,111 of pouch 108 being sewn together at a specific location.

Figure 3B:
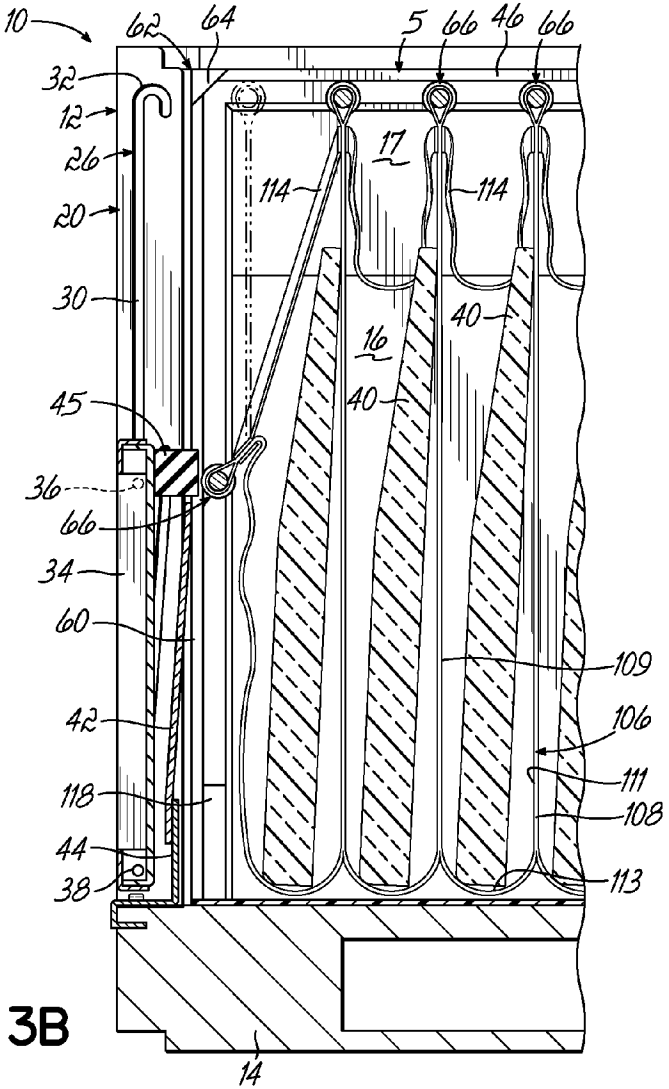
FIG. 3B is a partial cross-sectional view of the container shown in FIG. 1, the front slider assembly being shown in a lowered or dropped position.
Figure 3A:
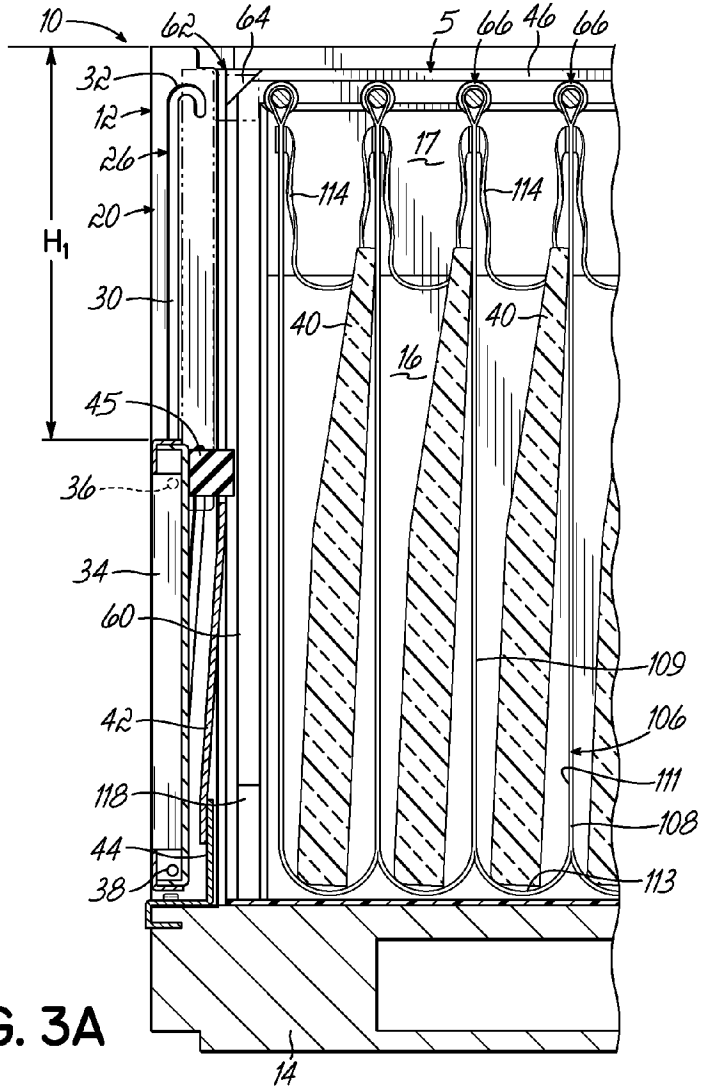
FIG. 3A is a partial cross-sectional view of the container shown in FIGS. 1 and 2, the door being shown in a lowered or dropped position.
Figure 3D:
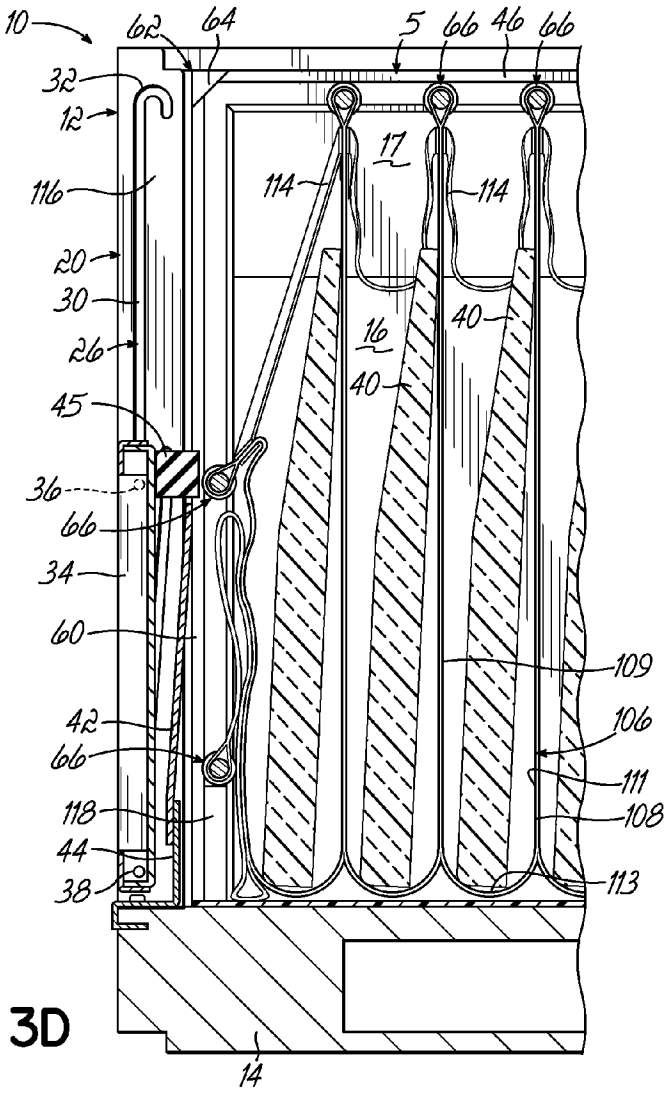
FIG. 3D is a partial cross-sectional view of the container shown in FIG. 1, the second slider assembly being shown in a lowered or dropped position.
Figure 3C:
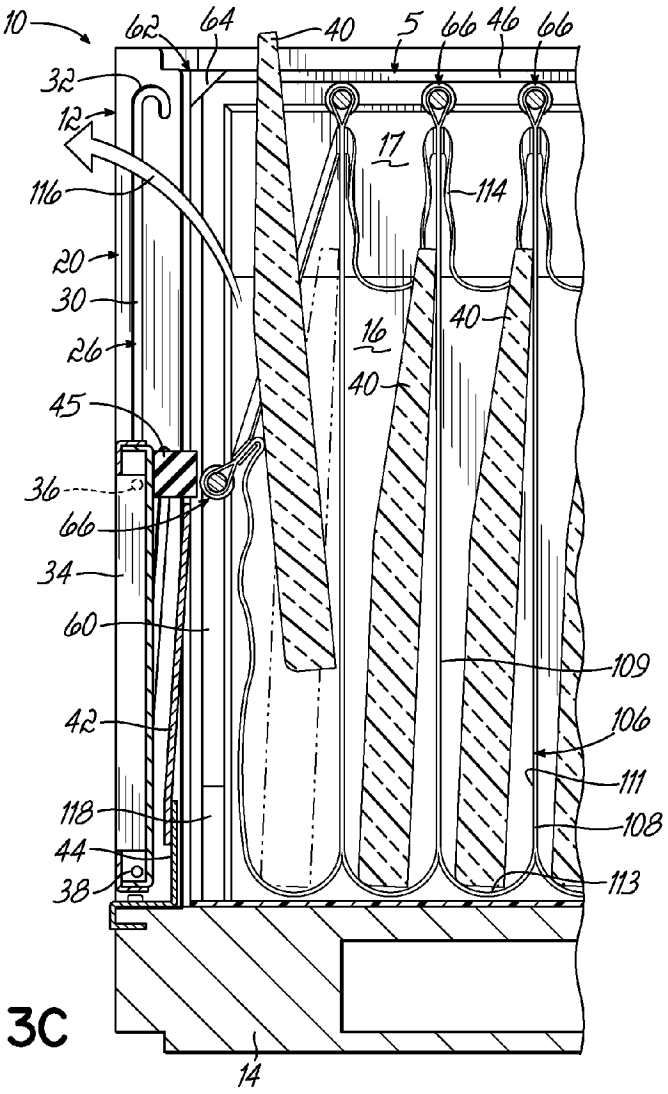
FIG. 3C is a partial cross-sectional view of the container shown in FIG. 1, showing the front product being removed.

FIGS. 3A-3D illustrates a method of unloading product 40 from the pouches 108 of the container 10. The method comprises the step of lowering door 34 from a raised and locked position shown in FIG. 2 to a lowered or dropped position illustrated in FIG. 3A. As shown in FIG. 3A, when the door 34 is in a lowered position, an opening having a height $H_1$ is created above the door 34. The next step comprises moving the first dunnage support 66 forwardly, the sliders 68 sliding in the stationary generally horizontally oriented track portions 46, and then down the stationary generally vertically oriented track portions 60 until the straps 114 extending between the front and rear walls of the front pouch 108 are stretched and generally linear, as shown in FIG. 3B. At this point, the product 40 in the forwardmost or front pouch 108 is still in the front pouch 108, as shown in FIG. 3B. As shown in FIG. 3C, the product 40 in the front pouch 108 is then removed by the operator in the direction shown by arrow 116 over the front door 34. Thus, the front product 40 being removed passes between the partially lowered or dropped first dunnage support 66 and the second dunnage support 66, which is still extending between the generally horizontally oriented track portions 46. As shown in FIG. 3C, the lowered position of the front door 34 makes it easier from an ergonomic standpoint for the operator to remove the product 40 because the product 40 need not be raised over the full height of the container 10 to be removed from inside the container. FIG. 3D illustrates the second dunnage support 66 extending between the stationary generally vertically oriented track portions 60 above the front dunnage support 66, the straps 114 extending between the front and rear walls of the second pouch 108 being stretched and generally linear. The front dunnage support 66 is spaced above the bottom of the container by a bottom stop 118. With the second dunnage support 66 extending between the vertically oriented tracks 60 as shown in FIG. 3D, the product 40 in the second pouch 108 may be easily removed like the front product 40 was removed. This process is continued by an operator until all the products 40 are removed from the pouches 108 and each of the dunnage supports 66 extend between the generally vertically oriented track portions 60. The empty container 10 still having the dunnage therein is then shipped back to its desired location for loading additional products. During the unloading or loading process, the tracks 5 remain stationary fixedly secured to the side walls 16; it is the dunnage supports 66 and dunnage 106 hanging from the dunnage supports 66 which move inside the container with the assistance of an operator. The loading process is the reverse.

FIGS. 6, 7, 8A and 8B illustrate an alternative embodiment of container 10*a*. Container 10*a* has a stationary U-shaped front frame 20*a* fixedly secured to the side walls 16. In this embodiment, the front frame 20*a* comprises a frame base 22*a* and two side posts 24*a* extending upwardly from the frame base 22*a*. The frame base 22*a* is fixedly secured to the base 14 of the container 10*a* with rivets or fasteners 21, while the side posts 24*a* of the front frame 20*a* are fixedly secured to the side walls 16. During the loading or unloading processes described herein, the front frame 20*a* does not move.

Figure 7:
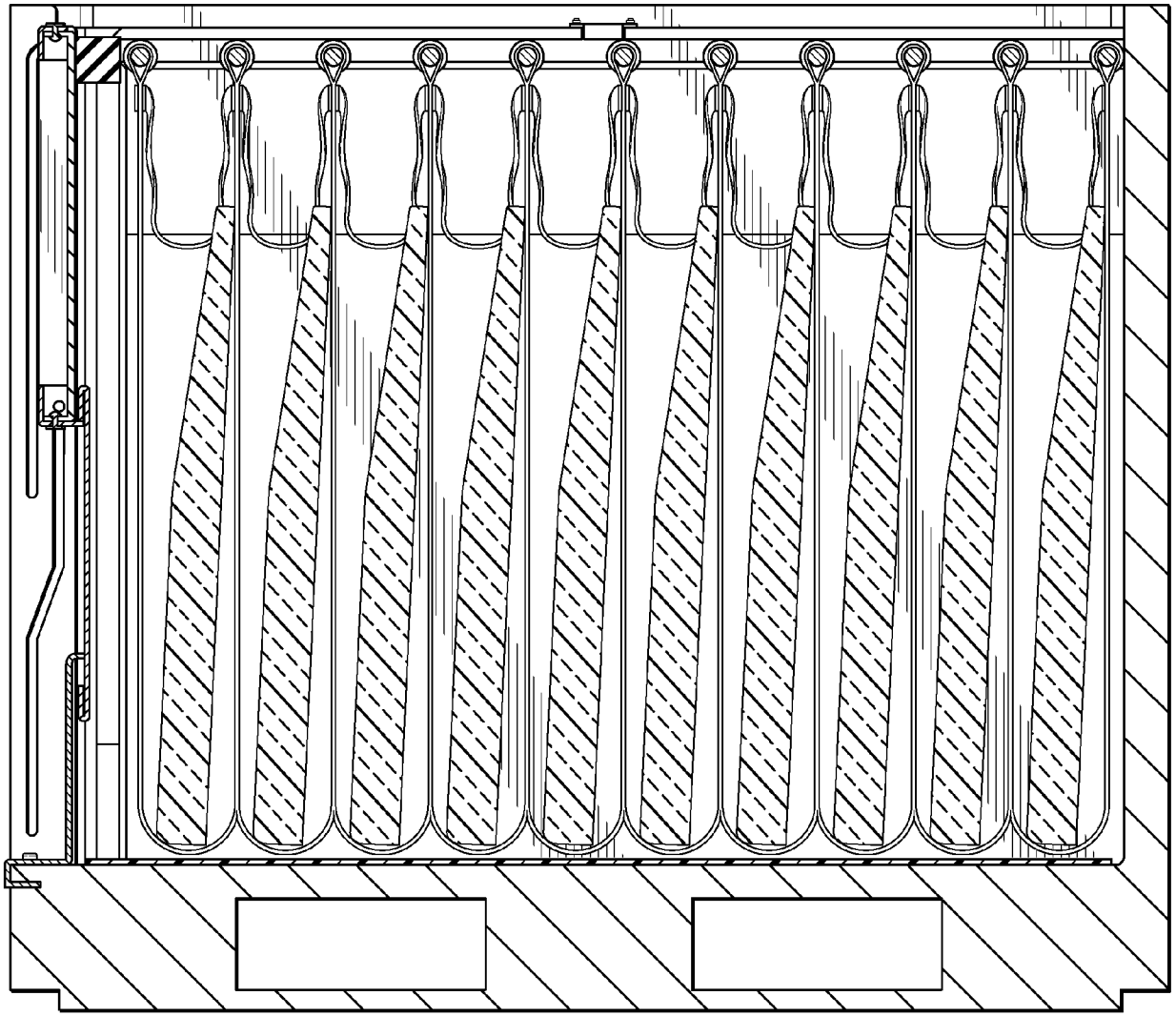
FIG. 7 is a cross-sectional view taken along the line 7-7 of FIG. 6 with products shown in the pouches.
Figure 8B:
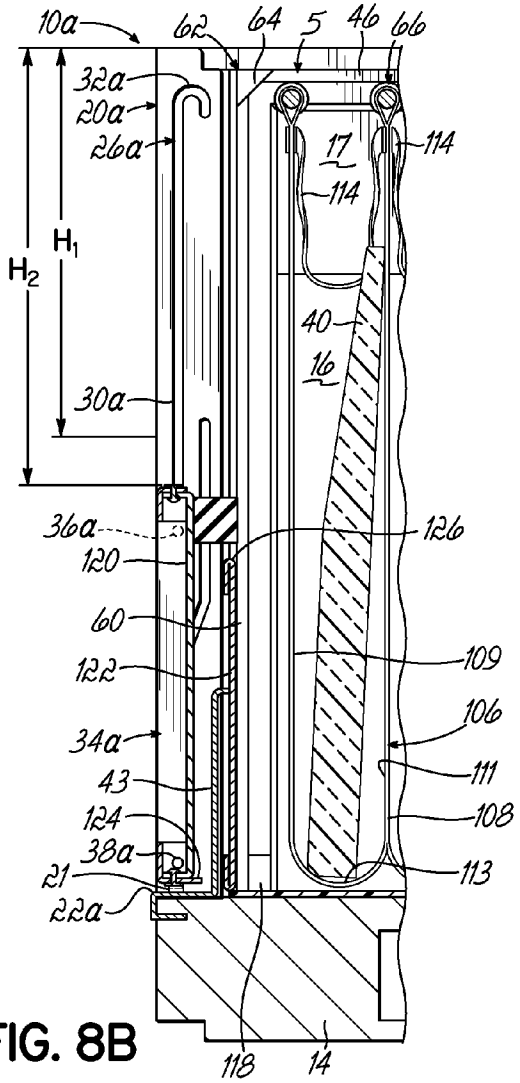
FIG. 8B is a partial cross-sectional view of the container shown in FIG. 8A, the door being shown in a lowered or dropped position.
Figure 8A:
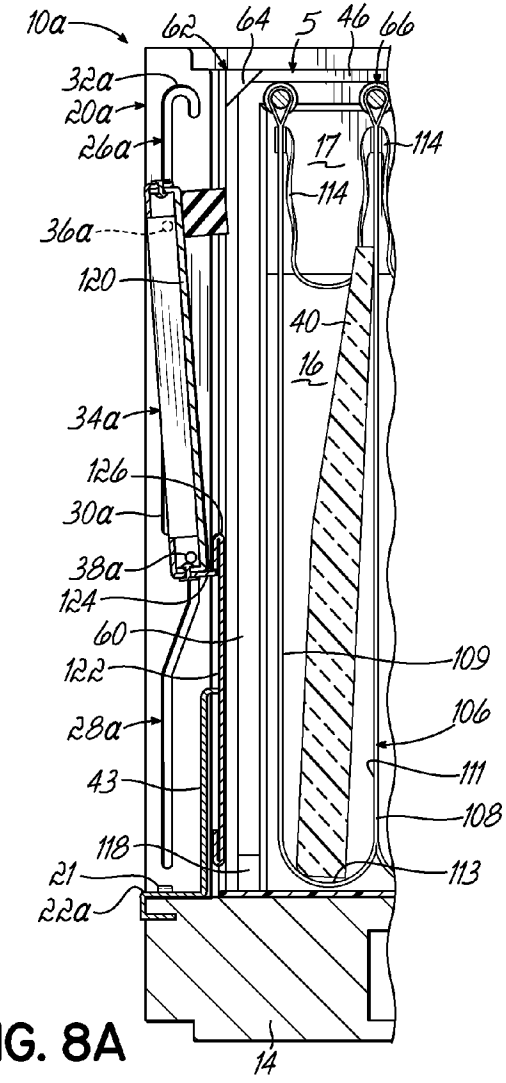
FIG. 8A is a partial cross-sectional view of the container shown in FIG. 6, the door being shown in a raised or up position.

Each of the side posts 24*a* of the front frame 20*a* is generally rectangular in cross-section and has a hollow interior 25*a*. Each of the side posts 24*a* of the front frame 20*a* has two slots therethrough; an upper slot 26*a* and a lower slot 28*a*. As best shown in FIGS. 7, 8A and 8B, upper slot 26*a* has a "candy cane" shape comprising a straight portion 30*a* and a curved upper portion 32*a*. The lower slot 28*a* is not linear, but rather has a "Z" shape, as best illustrated in FIG. 7. These upper and lower slots 26*a*, 28*a* are used to secure a movable multi-segmented or multi-piece door or door assembly 34*a* in a fixed position and guide the door assembly 34*a* during its movement from an upper or raised position and a lower or dropped position.

As best shown in FIGS. 7 and 8A-8B, the movable door assembly 34*a* comprises a movable upper segment 120 and a movable lower segment 122 which are not connected together. As shown in FIG. 7, the upper segment 120 has a flange 124 at the bottom thereof. The upper segment 120 has a pair of upper pins 36*a* extending outwardly from the upper segment 120 of the door assembly 34*a* and adapted to ride or move inside the upper slots 26*a*. In addition, the upper segment 120 of the door assembly 34*a* has an integral U-shaped upper handle 128 which a user may easily grasp and move the upper segment 120 of the door assembly 34*a* along with the lower segment 122 of the door assembly 34*a* due to the configuration of the door assembly 34*a*. Similarly, the upper segment 120 of door 34*a* has a pair of lower pins 38*a* extending outwardly from the upper segment 120 of door assembly 34*a* and adapted to ride or move inside the lower slots 28*a*. FIG. 7 shows the door assembly 34*a* locked in a raised position with the upper pins 36*a* located at the ends of the curved portions 32*a* of the upper slots 26*a*.

The lower segment 122 of door assembly 34*a* is not fastened or secured to any particular piece and is free floating between the generally vertically oriented track portions 60 and the upper segment 120 of door assembly 34*a*. The lower segment 122 of door assembly 34*a* has a U-shaped lip 126 located at the upper end of the lower segment 122. The lower segment 122 of door assembly 34*a* moves inside a stationary vertically oriented flange 43 of the frame base 22*a* of the front frame 20*a*. As the door 34*a* is lowered, the lower segment 122 of door assembly 34*a* moves inside a flange 43 of the base 22*a* of the front frame 20*a*. As the door assembly 34*a* is raised, the flange 124 of the upper segment 120 of door assembly 34*a* contacts the U-shaped lip 126 located at the upper end of the lower segment 122 and raises the lower segment 122 of door assembly 34*a*.

When the door assembly 34*a* is in its lowered position shown in FIG. 8B, an opening having a height $H_2$ is created above the door assembly 34*a*. The height $H_2$ of the opening is greater than the height $H_1$ of the embodiment shown in FIGS. 1 and 2 (approximately half the height of the container). Thus, the opening $H_2$ is greater than half the height of the container $H_1$, making it more desirable from an ergonomic standpoint for the loader/unloader.

Figure 9:
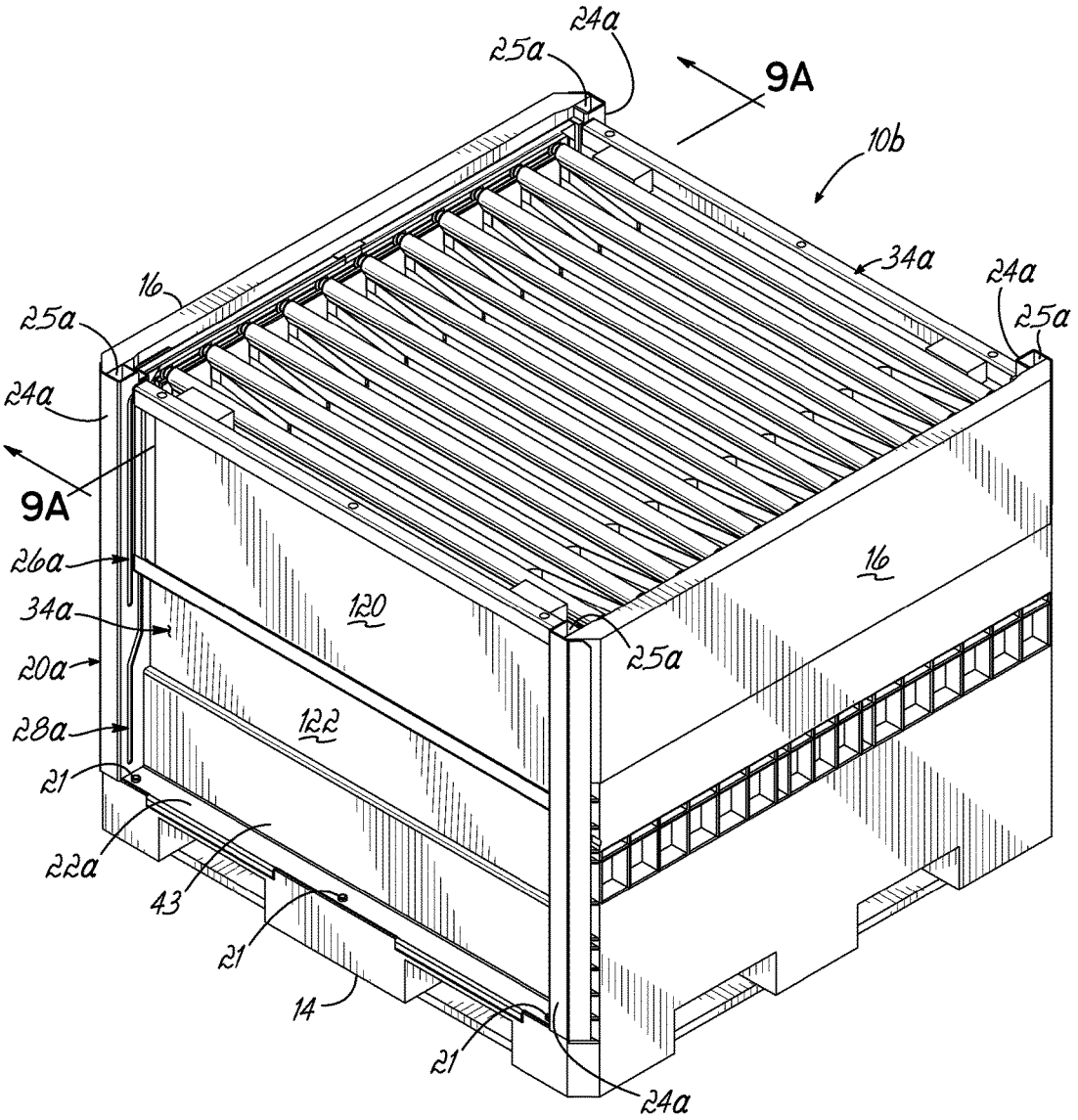
FIG. 9 is a perspective view of an alternative embodiment of a reusable and returnable container having two doors.

FIG. 9 shows another alternative embodiment of container 10*b*. This container 10*b* has two doors 34*a* on opposite sides of the container. Each door 34*a* is like the door 34*a* shown in FIGS. 6, 7, 8A and 8B. Any of the containers shown or described herein may have two doors and two generally vertically oriented stationary track portions attached to each side wall of the container and extending downwardly from a generally horizontally oriented track portion, one generally vertically oriented track portion being proximate each of the doors.

Figure 9A:
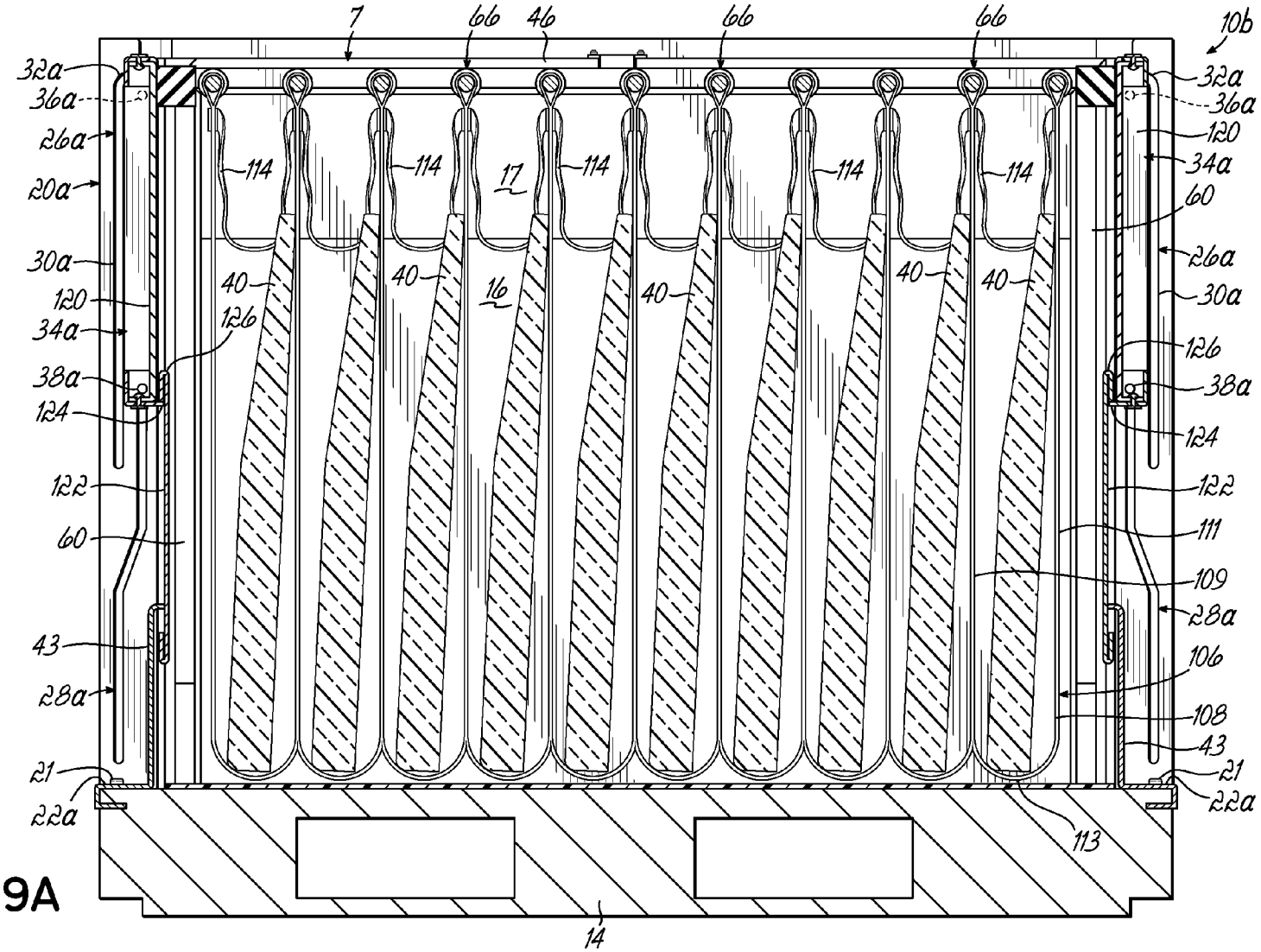
FIG. 9A is a view taken along the line 9A-9A of FIG. 9 with products shown in the pouches.

FIG. 9A shows the interior of container 10*b*. On each side of the container, rather than one stationary generally vertically oriented track portion 60, two stationary generally vertically oriented track portions 60 extend downwardly from the ends of a stationary generally horizontally oriented track portion 46 to create a generally "U-shaped" track 7 fixedly secured to each side wall 16 (only one being shown in FIG. 9A). With such an interior, dunnage supports 66 with dunnage may be moved towards either end of the container to load or unload products from either end of the container over a lowered door, the dunnage supports 66 moving along either one or both of the stationary vertically oriented tracks 7.

Figure 10:
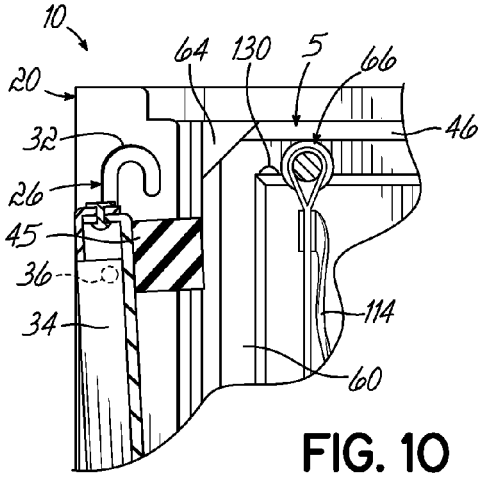
FIG. 10 is an enlarged view of a portion of a container showing a bump at the front of one of the horizontal tracks.
Figure 11:
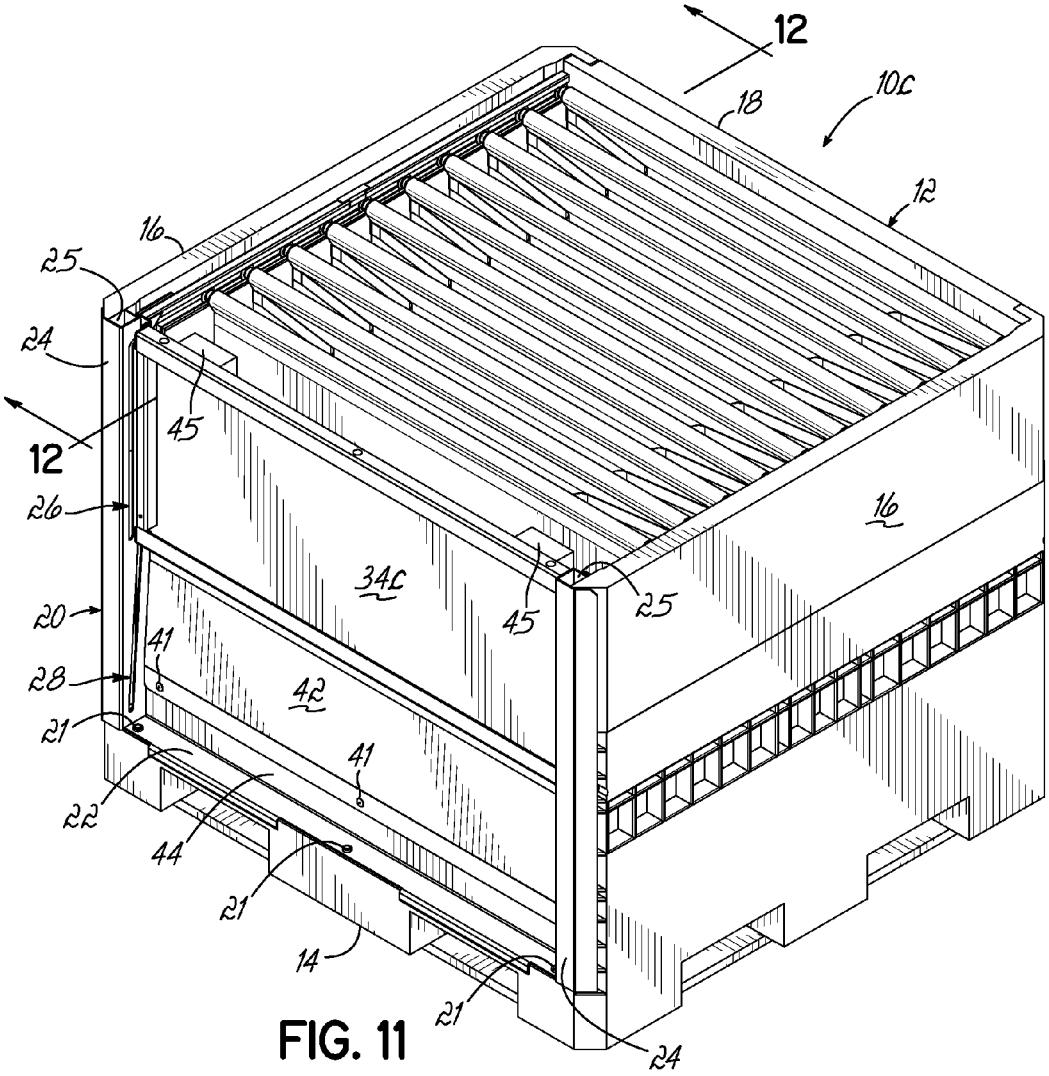
FIG. 11 is a perspective view of another embodiment of the reusable and returnable container.

FIG. 10 shows a feature of container 10 which may be used in any embodiment or container shown or described herein. This feature comprises a bump 130 at one end of the stationary horizontally oriented track 46. The purpose of the bump 130 is to prevent dunnage supports 66 from accidently passing from the generally horizontally oriented track portion 46 to the stationary generally vertically oriented track portion or portions 60. Containers having two generally vertically oriented track portions 60 on each side of the container would have two bumps 130; one on each end of each generally horizontally oriented track portion 46, making a total of four bumps 130 per container.

Figure 12:
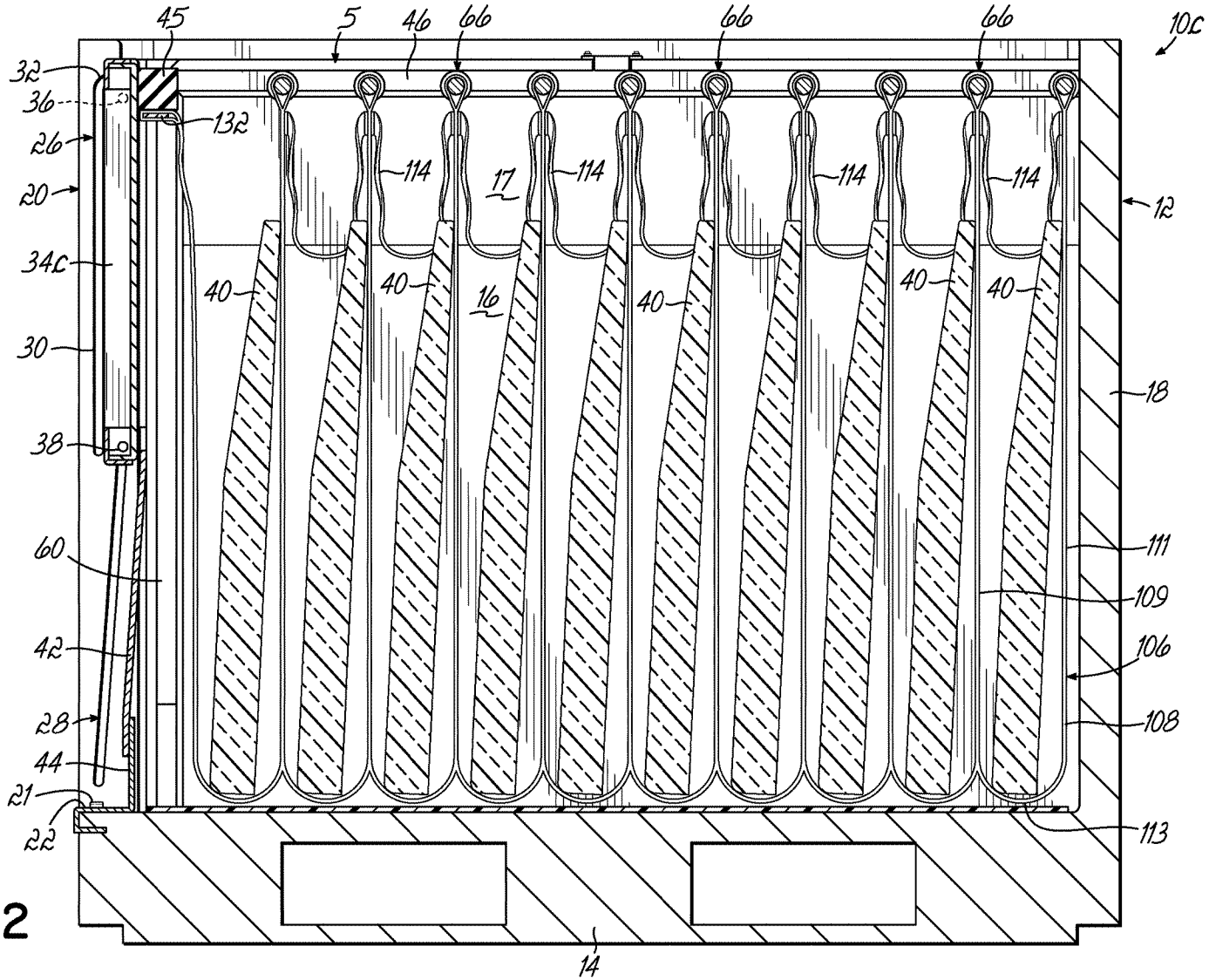
FIG. 12 is a cross-sectional view taken along the line 12-12 of FIG. 11 with products shown in the pouches.

FIGS. 11, 12 and 13A-13E illustrate an alternative embodiment of container 10*c*. Inside container 10*c*, the front edge of dunnage 106 is secured to door 34*c*. As best illustrated in FIG. 12, door 34*c* is identical to door 34, except door 34*c* has a bar 132 around which the front edge of the front wall of the front pouch 108 is wrapped and sewn or secured. FIG. 12 shows the door 34*c* in a raised position, the front edge of the front pouch 108 being secured to bar 132 of door 34*c*. Other than bar 132 of door 34*c* and the dunnage being secured thereto, container 10*c* is identical to container 10 shown and described herein.

Figure 13B:
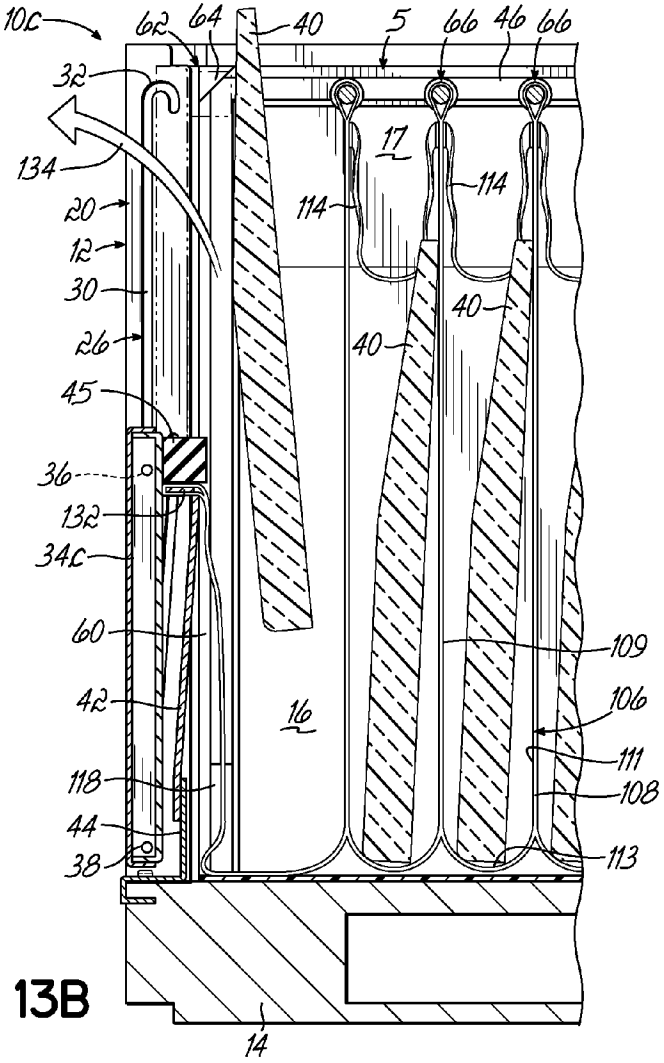
FIG. 13B is a partial cross-sectional view of the container shown in FIG. 11, showing the front product being removed.
Figure 13A:
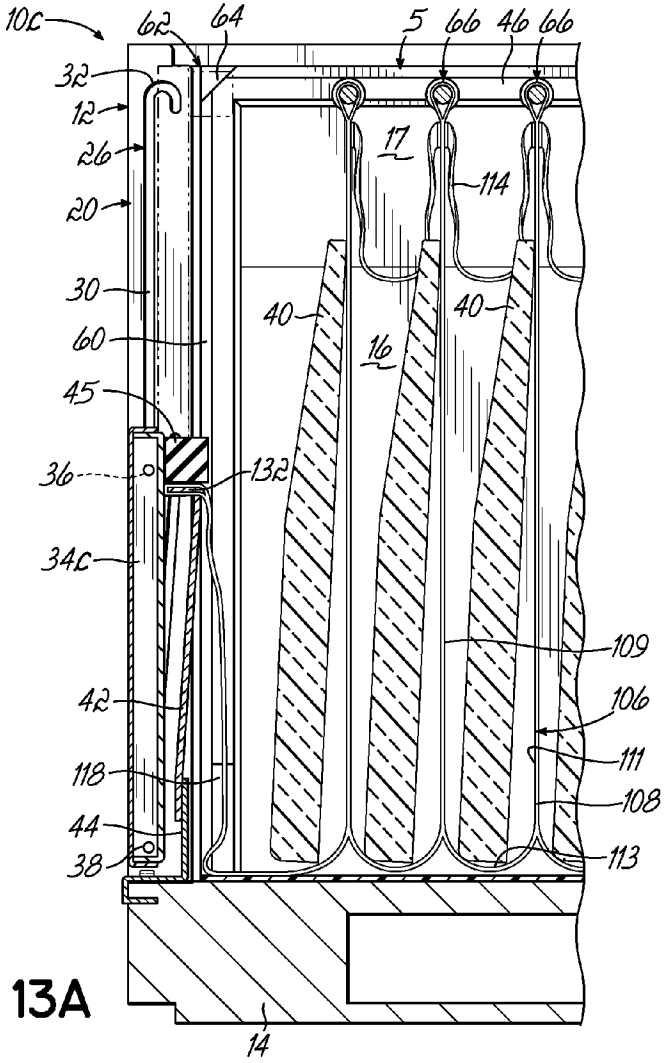
FIG. 13A is a partial cross-sectional view of the container shown in FIG. 11, the door being shown in a lowered or dropped position.
Figure 13D:
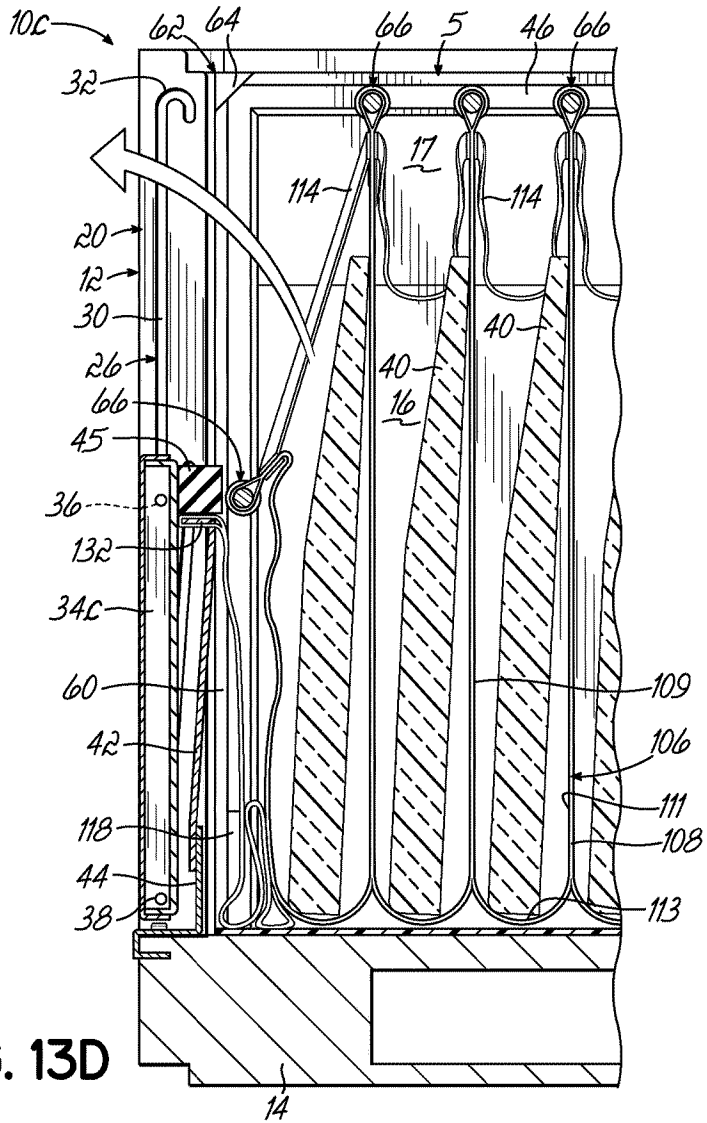
FIG. 13D is a partial cross-sectional view of the container shown in FIG. 11, showing a second product being removed.
Figure 13C:
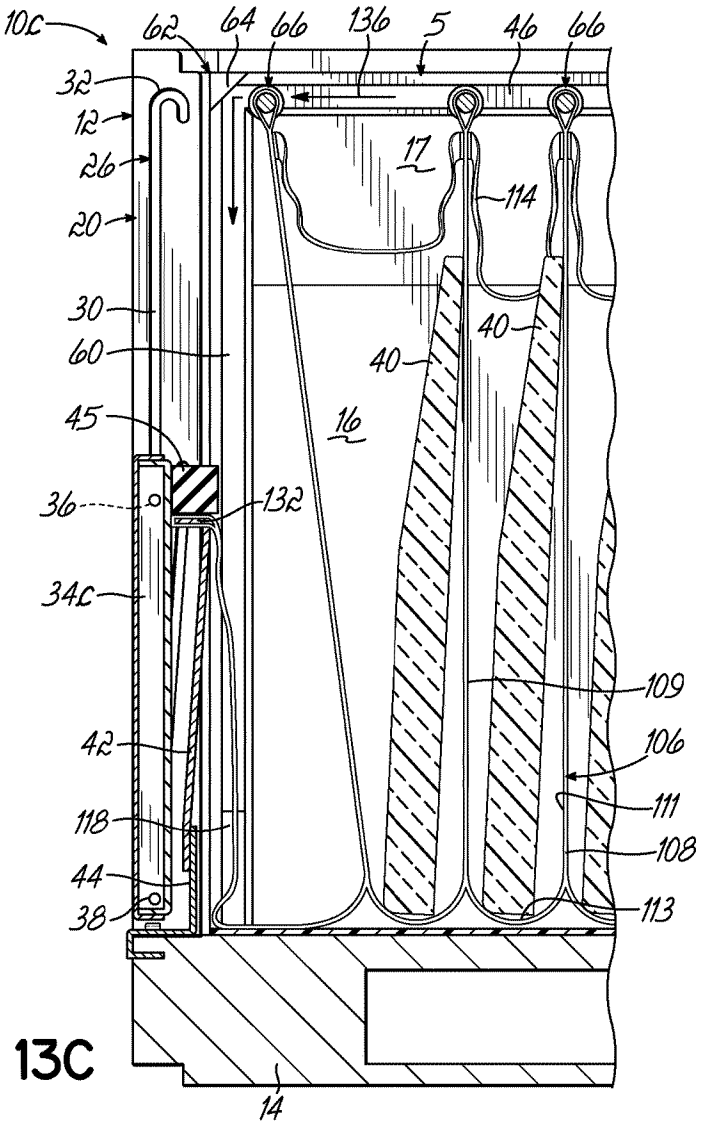
FIG. 13C is a partial cross-sectional view of the container shown in FIG. 11, the front dunnage support being shown in a lowered or dropped position.
Figure 13E:
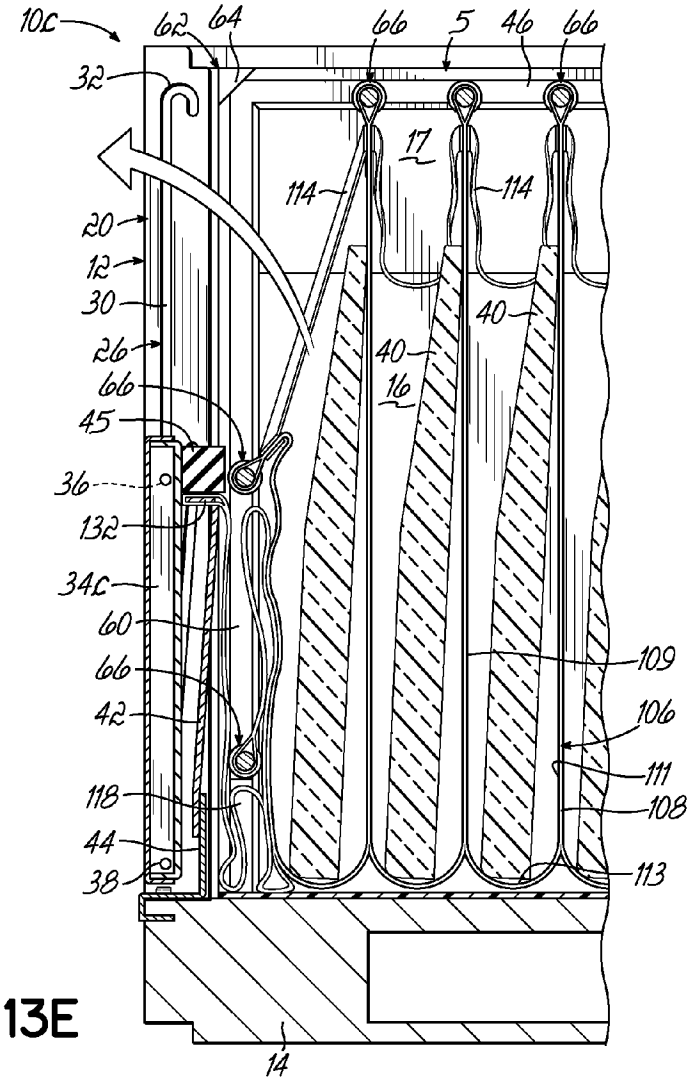
FIG. 13E is a partial cross-sectional view of the container shown in FIG. 11, a second dunnage support being shown in a lowered or dropped position.

FIGS. 13A-13E illustrate a method of unloading product 40 from the pouches 108 of the container 10*c*. The method comprises the step of lowering door 34*c* from a raised and locked position shown in FIG. 12 to a lowered or dropped position illustrated in FIG. 13A. When the door 34*c* is down in its lowered position shown in FIG. 13A, the upper end of the front wall 109 of the front pouch 108 is below the rear of the front pouch 108. At this point, the product 40 in the front pouch 108 is still in the front pouch 108, as shown in FIG. 13A. As shown in FIG. 13B, the product 40 in the front pouch 108 is then removed from inside the front pouch 108 over the lowered door 34*c* by the operator in the direction shown by arrow 134. Thus, the front product 40 being removed passes between the lowered or dropped door 34*c* and the first support member assembly 66, which is still in the stationary generally horizontally oriented track portion 46. As shown in FIG. 13B, the lowered position of the door 34*c* makes it easier from an ergonomic standpoint for the operator to remove the product 40 because the product 40 need not be raised the full height of the container 10*c*. As shown in FIG. 13C, the next step comprises moving the first or front support member assembly 66 forwardly in the track portion 46 in the direction of arrow 136, the sliders 68 sliding in the stationary generally horizontally oriented track portions 46. As shown in FIG. 13D, front support member assembly 66 is then moved downwardly in the stationary generally vertically oriented track portions 60, the sliders 68 sliding down the generally vertically oriented track portions 60 until the straps 114 located in the second pouch 108 are stretched and generally linear. FIG. 13D illustrates the front support member assembly 66 extending between the generally vertically oriented track portions 60, the straps 114 extending between the first or front and second support member assemblies 66 being stretched and generally linear. FIG. 13E illustrates the second support member assembly 66, like the first support member assembly 66 extending between the generally vertically oriented track portions 60, the front support member assembly 66 is spaced above the bottom of the container by a bottom stop 118. With the second support member assembly 66 extending between the generally vertically oriented track portions 60, as shown in FIG. 13E, the product 40 in the third pouch 108 may be easily removed like the other products 40 in the other pouches were removed. This process is continued by an operator until all the products 40 are removed from their pouches 108 and each of the support member assemblies 66 extend between the generally vertically oriented track portions 60. The empty container 10*c* still having the dunnage therein is then shipped back to its desired location for loading additional products. The loading process is the reverse. During the unloading or loading process, the location of the track portions 46, 60 remains stationary; it is the support member assemblies 66 and dunnage 106 hanging from the support member assemblies 66 which move inside the container with the assistance of an operator. This process may be used in any of the containers shown or described herein, the dunnage being secured to one or two doors of the container.

Figure 14:
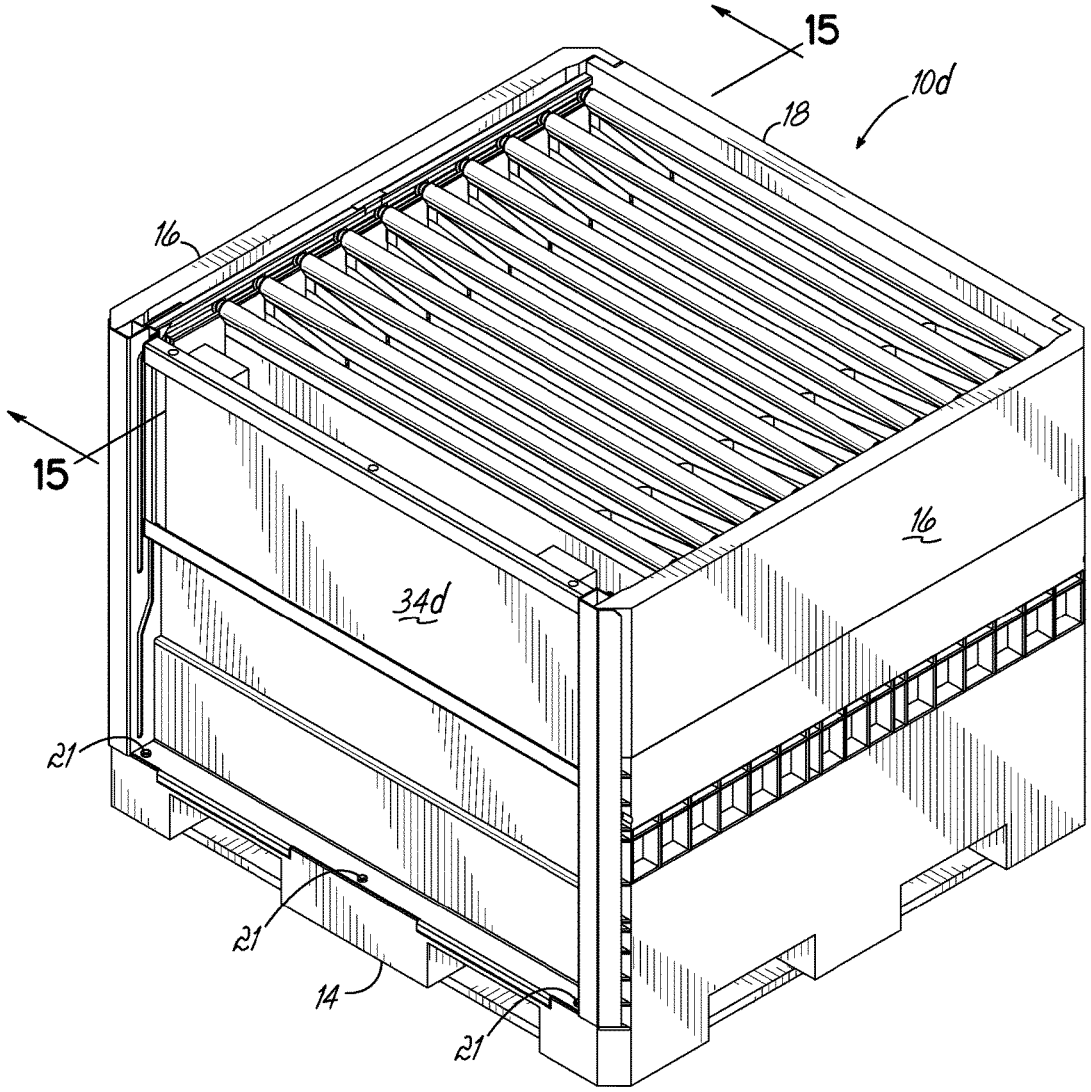
FIG. 14 is a perspective view of another embodiment of the reusable and returnable container.
Figure 15:
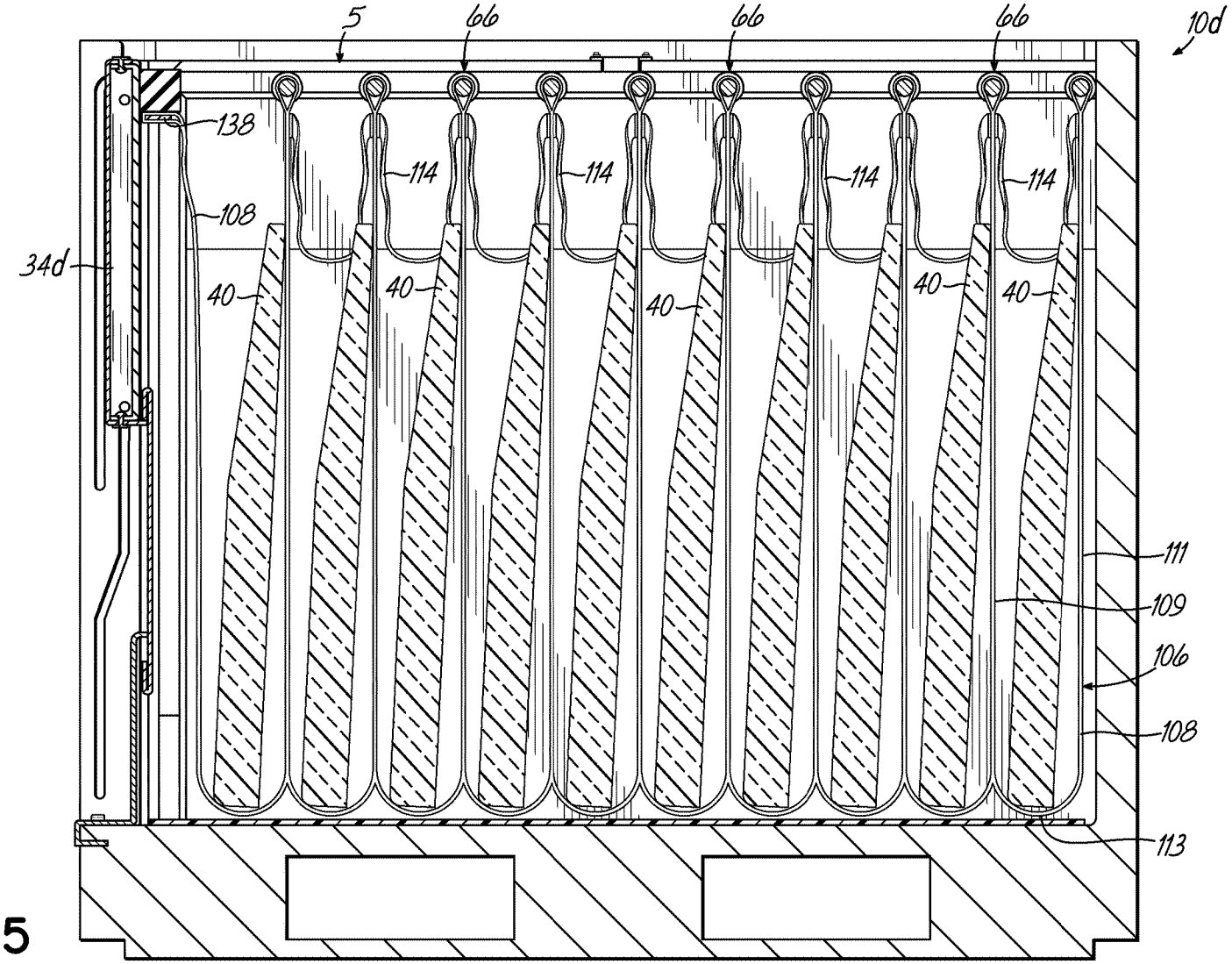
FIG. 15 is a cross-sectional view taken along the line 15-15 of FIG. 14 with products shown in the pouches.
Figure 16:
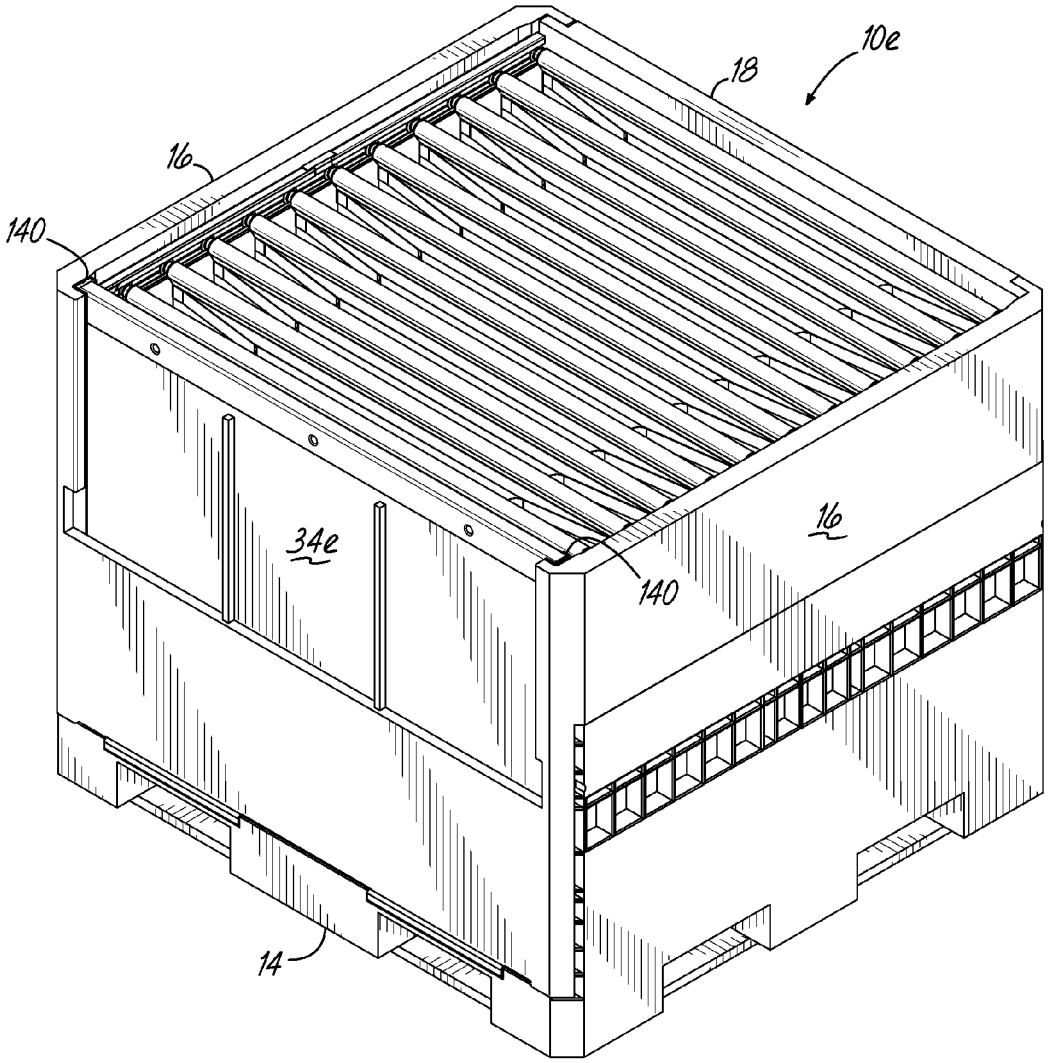
FIG. 16 is a perspective view of another embodiment of the reusable and returnable container.
Figure 17:
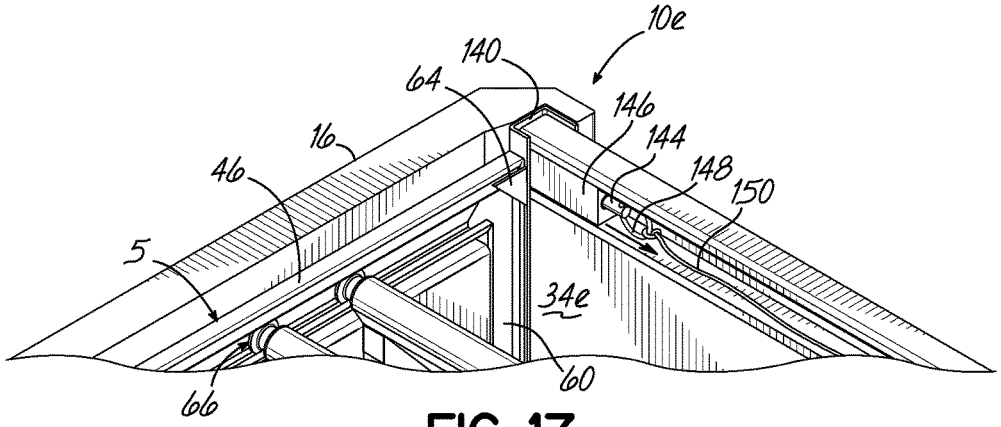
FIG. 17 is an enlarged perspective view of a portion of the container of FIG. 16 showing a locking mechanism for the door.

FIGS. 14 and 15 illustrate an alternative embodiment of container 10*d*. As shown in FIG. 15, inside container 10*d*, the front edge of dunnage 106 in the form of pouches 108 for supporting products 40 is secured to door 34*d*. Door 34*d* is identical to door 34*a*, except door 34*d* has a bar 138 around which the front edge of the front pouch 108 is wrapped and sewn or secured. FIG. 14 shows the door 34*d* in a raised position, the front edge of the front pouch 108 being secured to bar 138 of door 34*d*. Other than bar 138 of door 34*d* and the dunnage being secured thereto, container 10*d* is identical to container 10*a* shown and described herein.

Figure 18:
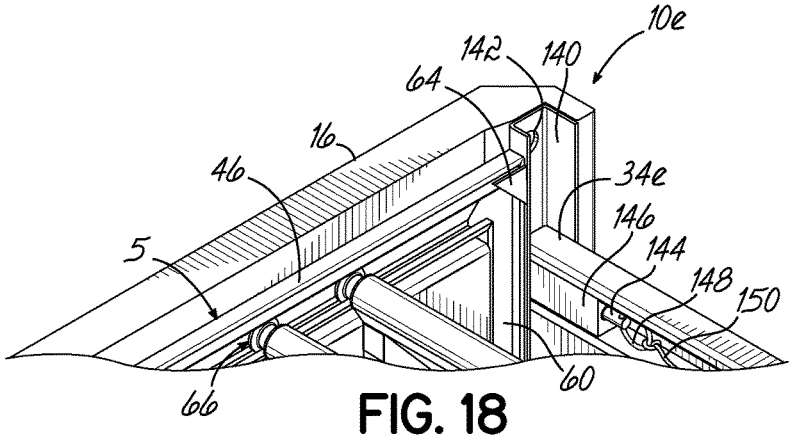
FIG. 18 is an enlarged perspective view of a portion of the container of FIG. 16 showing the door partially lowered.
Figure 19:
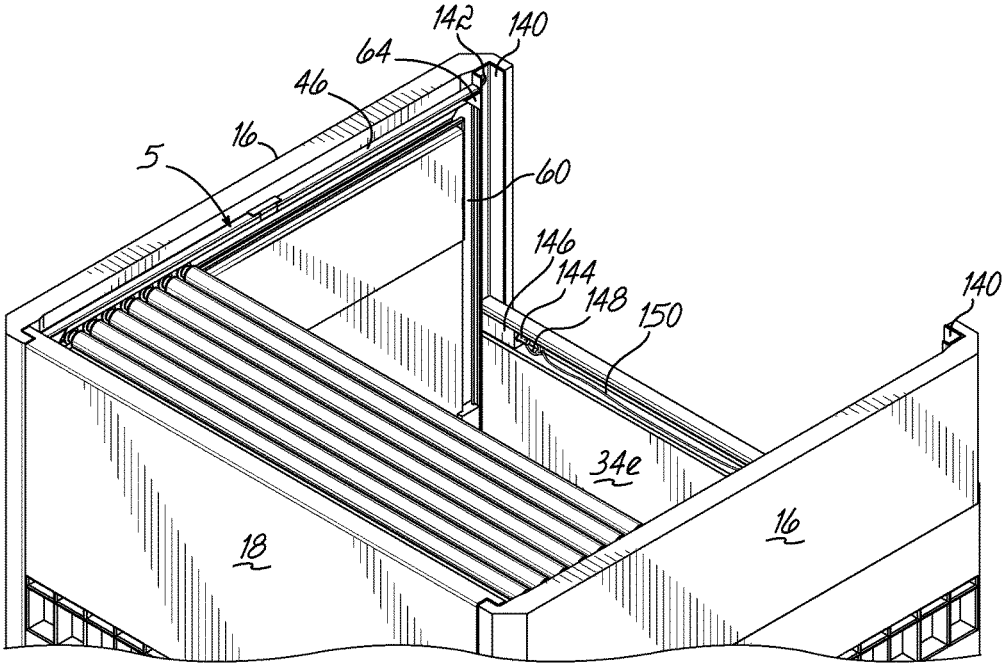
FIG. 19 is an enlarged perspective view of a portion of the container of FIG. 16 showing the door fully lowered.

FIGS. 16-19 illustrate an alternative embodiment of container 10*e*. In container 10*e*, door 34*e* slides in stationary vertically oriented tracks 140 (one on each side wall) between a raised and locked position shown in FIGS. 16 and 17, and a lowered position shown in FIG. 19. As shown in FIG. 18, at the top of each track 140 is a hole 142 adapted to receive a pin 144 from a lock 146. A ring 148 is attached to pin 144 at each end of the door 34*e*. The locks 146, only one being shown, are located at the sides of the door 34*e* and move with the door 34*e*. A connector 150, which may be in the form of a wire or any other suitable material, extends between the rings 148. In order to disengage the pins 144 from inside the holes 142 and lower the door 34*e*, an operator may pull on the connector 150, thereby moving the pins 144 toward each other out of engagement with the holes 142. With the pins 144 no longer holding the door in an upward raised and locked position, the door 34*e* may be moved downwardly inside tracks 140 to the position shown in FIG. 19. Although FIGS. 16-19 illustrate container 10*e* having only one door 34*e*, this door 34*e* may be located on opposite sides of a container. In such a container, two tracks would be located inside the container, one for each door.

Figure 20:
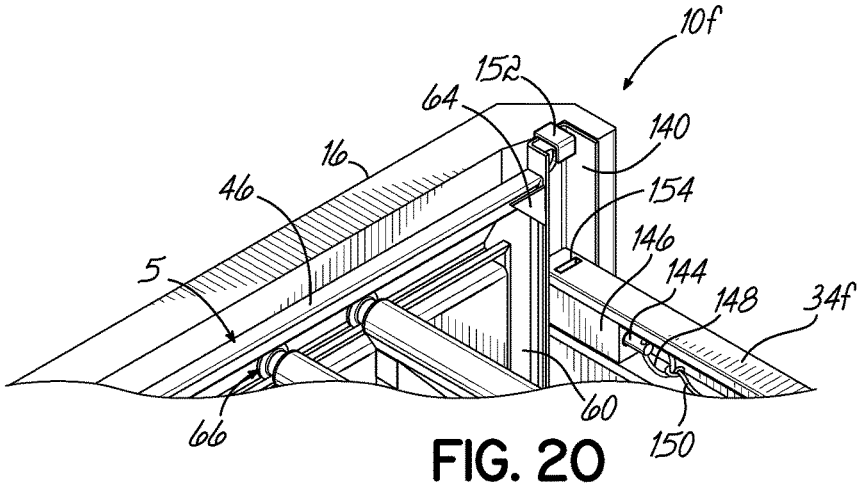
FIG. 20 is an enlarged perspective view of a portion of an alternative container showing the door partially lowered.
Figure 21:
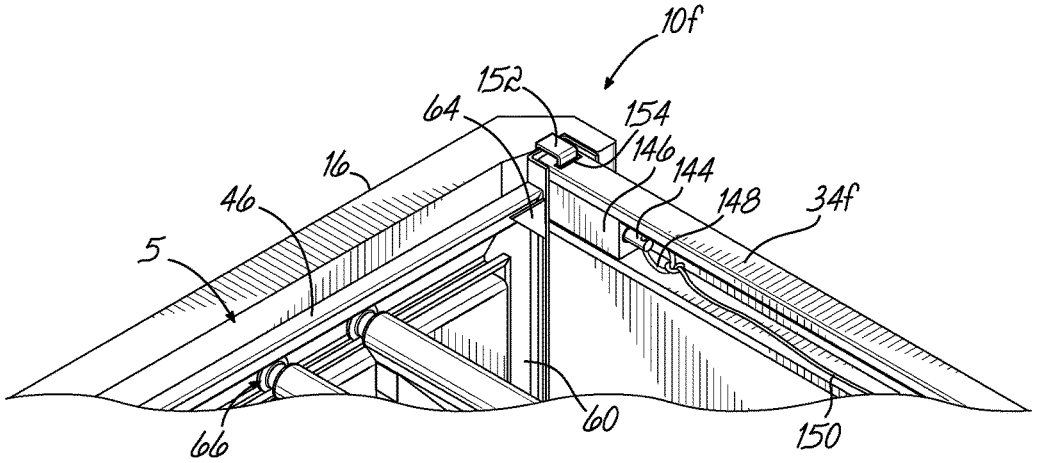
FIG. 21 is an enlarged perspective view of a portion of the container of FIG. 20 showing the door locked in a raised position.

FIGS. 20 and 21 illustrate a container 10*f* having a door 34*f* having an additional feature which may be used to help hold door 34*f* in a raised and locked position. This feature comprises a movable finger 152, which may be located at the top of each track 140. The finger 152 is adapted to engage a slot 154 located at the top of the door 34*e*. This feature may be used in any of the containers described or shown herein.

Figure 22:
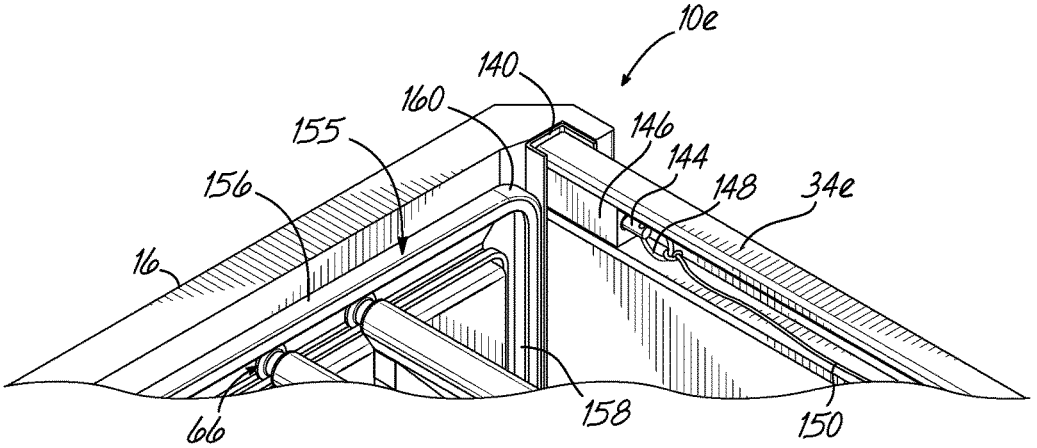
FIG. 22 is an enlarged perspective view of a portion of an alternative container showing a corner of a continuous track.

FIG. 22 illustrates a unitary "L-shaped" track 155 having a rounded corner which is fixedly secured to one of the side walls 16. The unitary track 155 comprises a horizontal portion 156 and a vertical portion 158 connected by a curved portion 160. Although the unitary tracks 155 are illustrated in container 10*e*, they may be used in any of the containers illustrated or described herein. Such rounded corners may be used in any tracks described or shown herein and may be used in containers having one or two vertically oriented tracks.

Figure 23:
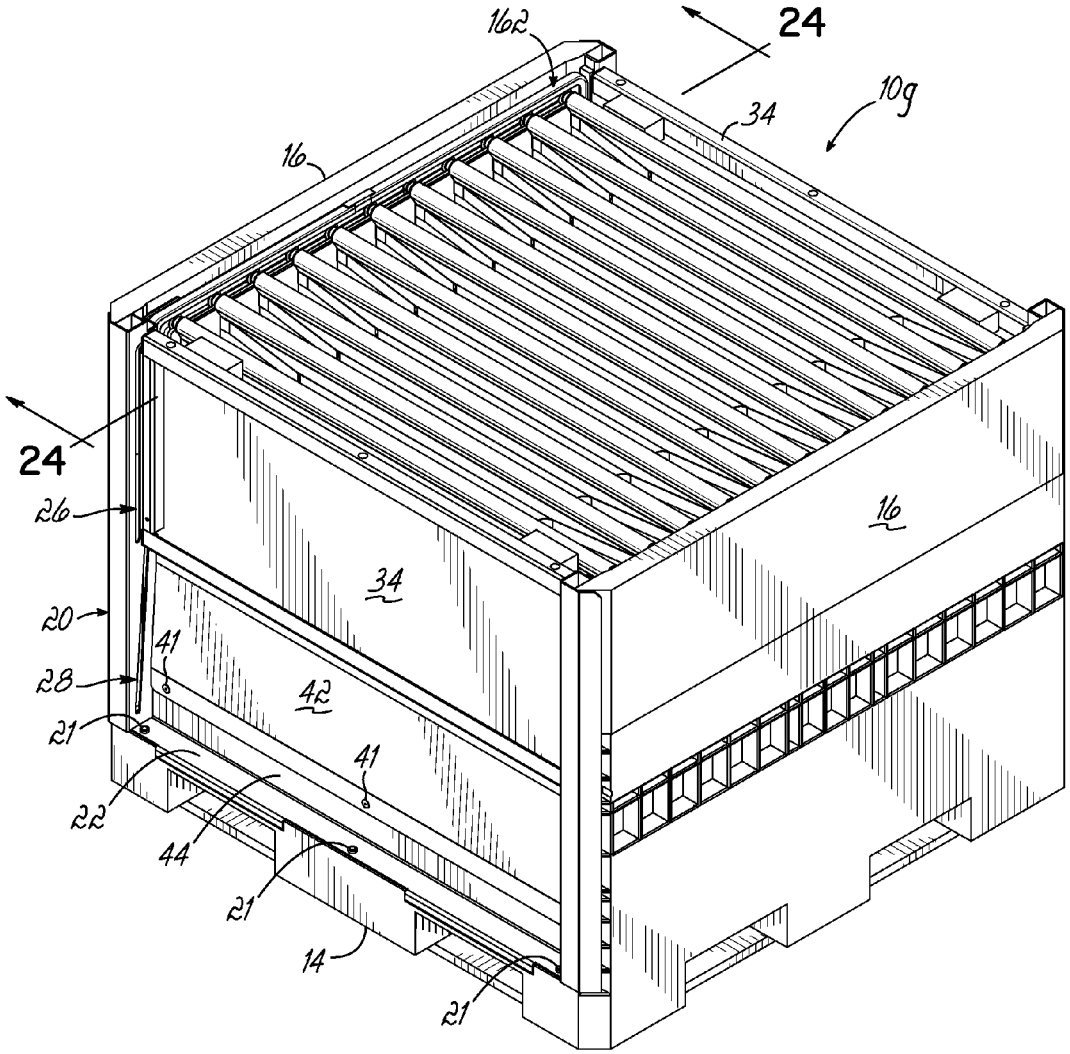
FIG. 23 is a perspective view of an alternative embodiment of a reusable and returnable container having two doors.
Figure 24:
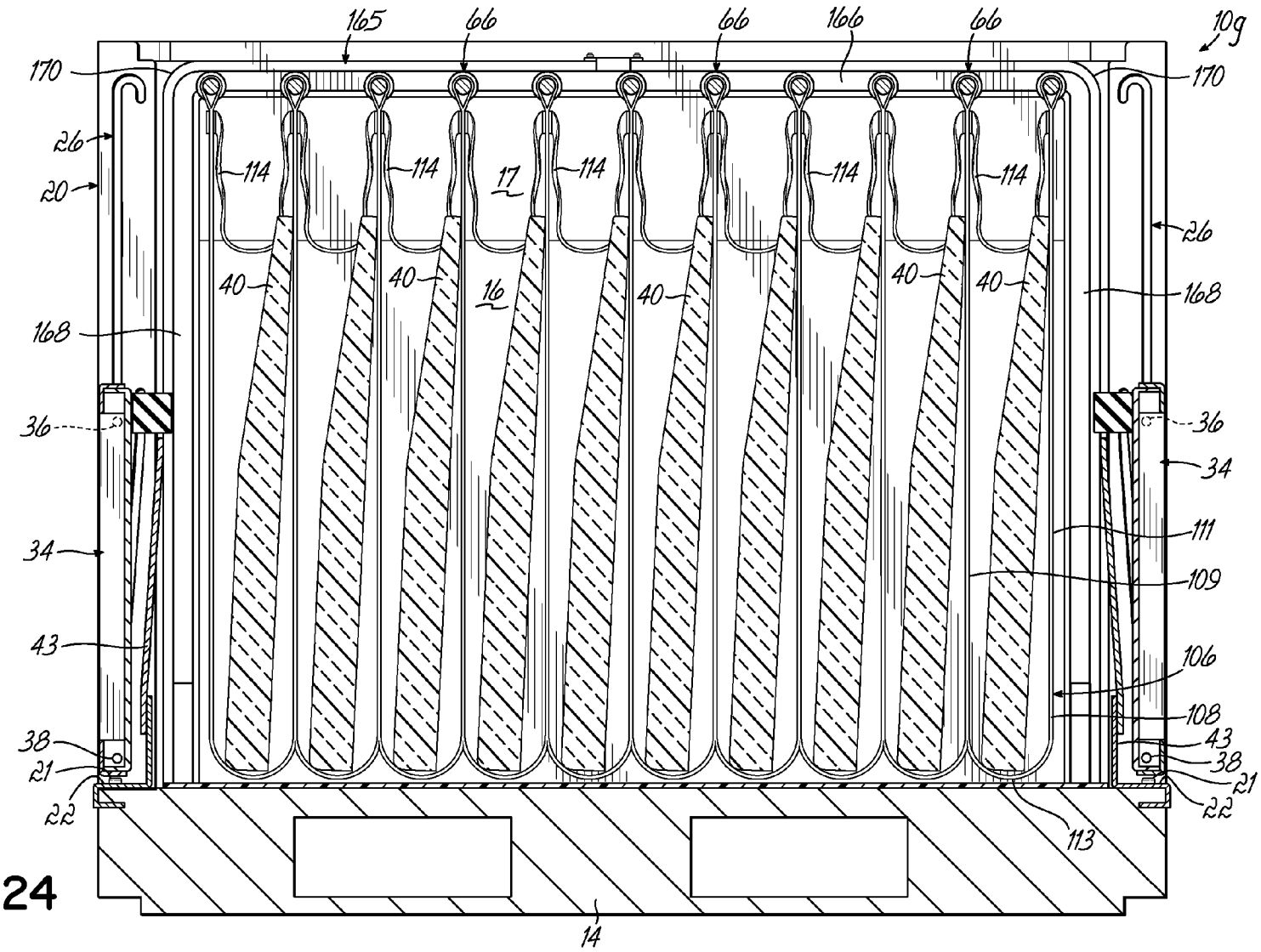
FIG. 24 is a cross-sectional view taken along the line 24-24 of FIG. 23 with products shown in the pouches.

FIGS. 23 and 24 illustrate an alternative embodiment of container 10*g*. Container 10*g* is a two-sided container having a U-shaped frame 20 fixedly secured to the side walls 16 at each end of the container 10*g* which does not move during the loading or unloading of the container. In this embodiment, each frame 20 is identical to the frame disclosed in container 10. The container 10*g* has two movable doors 34, one at each end, identical to the door 34 shown in the embodiment of FIGS. 1 and 2.

Inside container 10*g*, a "U-shaped" unitary track 165 having a horizontal portion 166 and two vertical portions 168 connected by two curved portions 170, similar to the track shown in FIG. 22, is secured to each side wall 16 in a fixed, stationary position (only one being shown in FIG. 24). Dunnage supports 66, like those described herein and shown in other embodiments, may move inside container 10*g* in both a vertical and horizontal direction due to the location and configuration of tracks 165 on side walls 16. Such stationary tracks may be used in any container shown or described herein.

Figure 25:
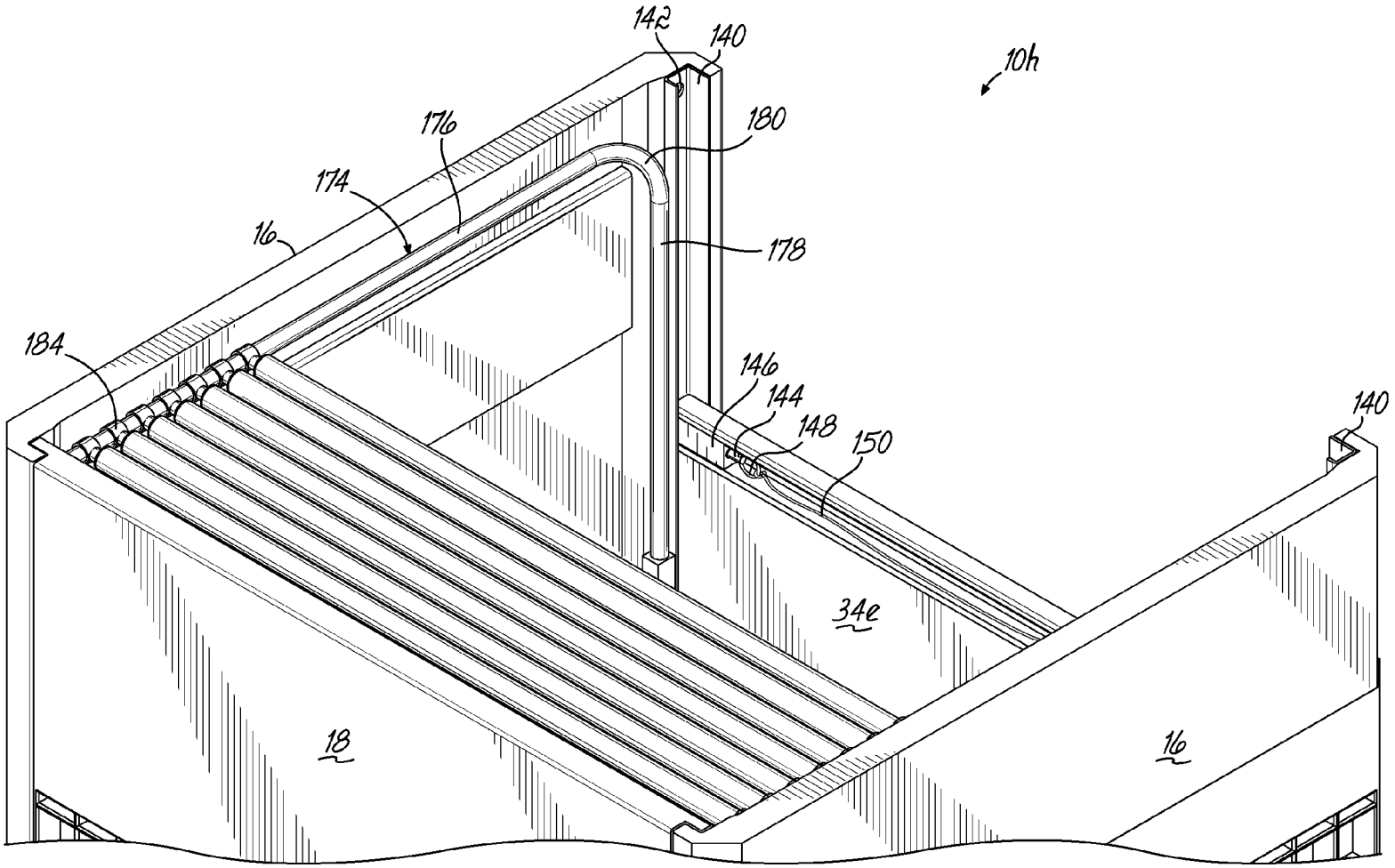
FIG. 25 is a rear perspective view of an alternative embodiment of container showing a different type of track and a different type of dunnage support.

FIG. 25 illustrates an alternative embodiment of container 10*h* having only one door 34*e* configured and operational like the door shown in FIGS. 16-19. This embodiment of container 10*h* may use any door or features described or illustrated herein.

Figure 26:
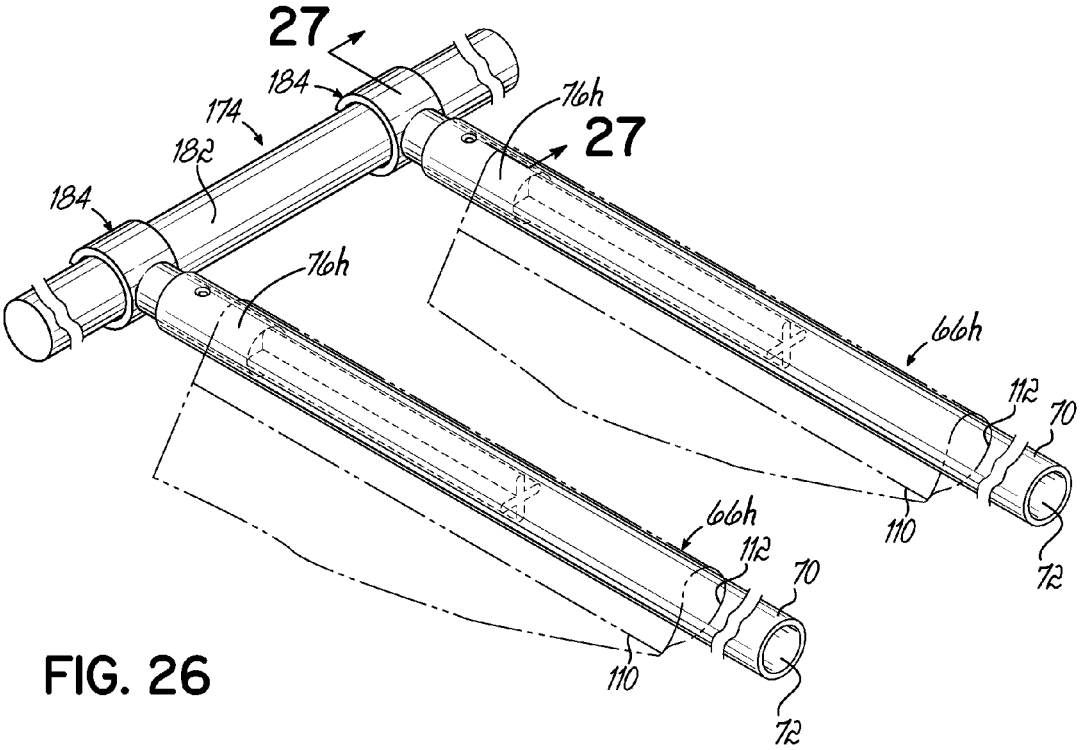
FIG. 26 is an enlarged view of a portion of two dunnage supports and associated dunnage of the container of FIG. 25.
Figure 27:
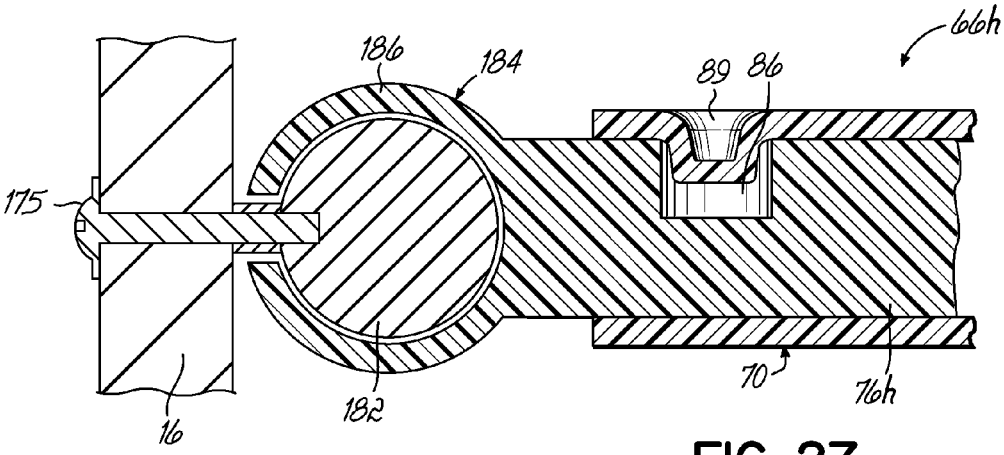
FIG. 27 is a cross-sectional view taken along the line 27-27 of FIG. 26.
Figure 28:
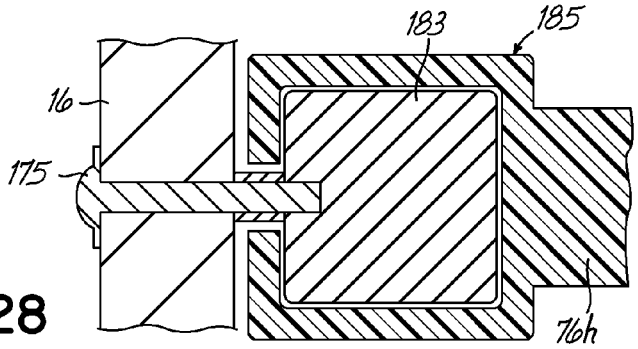
FIG. 28 is a cross-sectional view of an alternative shape of track and end member.

This container 10*h* illustrates a different generally "L-shaped" track 174 attached to and spaced from each side wall 16 with fasteners 175 (only one track 174 being shown in FIG. 25). As shown in FIG. 25, each track 174 comprises a horizontal portion 176 and a vertical portion 178 joined by a curved corner 180. As shown in FIG. 27, each of the fasteners 175 extends through one of the side walls 16 and into a track rail 182 which is shown as circular in cross-section in FIGS. 26 and 27. However, as exemplified in FIG. 28, the track rail 182 may be rectangular or oval or any desired shape of cross-sectional configuration. FIG. 28 illustrates a track rail 183 having a rectangular cross-section secured to side wall 16 with fastener 175 in the same manner. The fasteners 175 space the track rail 182, 183 away from the inner surface of the side wall 16 to provide clearance for a portion of an end member or slider 184 to move past the fasteners 175. As best shown in FIG. 27, each slider 184 has a generally "C-shaped" portion 186 which partially surrounds the track rail 182 and an inward portion 76*h*. FIG. 28 illustrates a slider 185 having a slightly different configuration partially surrounding track rail 183.

In container 10*h*, each support member assembly 66*h* comprises two end members or sliders 184 attached to a tubular support 70 in any manner described herein. As best shown in FIG. 26, support member assembly 66*h* includes a pair of sliders 184 (only one being shown in FIG. 26). Each slider 184 has a groove 86 formed in an inward portion 76*h* therein. Support member assemblies 66*h* further include a tubular support 70 having a hollow interior 72 extending therebetween. As shown in FIG. 27, each end of tubular support 70 fits over at least one portion of a slider 184. As shown in FIG. 27, tubular support 70 has two detents 89 therethrough (one at each end) in which the material of the tubular support 70 is pressed downwardly into the groove 86 at each end. This attachment between each of the two sliders 184 and the tubular support 70 enables some movement therebetween. Such interaction between the sliders 184 and tubular support 70 allows for a tolerance of approximately one-quarter inch on each side. The detents 89 prevent separation of the tubular support 70 from the sliders 184 while allowing some movement therebetween as the detents 89 move within the grooves 86 formed in the sliders 184. This may be true no matter what the shape of the mating slider and track rail.

Although a generally "L-shaped" track 174 is shown and described, a generally "U-shaped" track like the track 174 may be used in any container described or shown herein. Any combination of features described or shown herein may be used in combination with any other features described or shown herein. For example, the container shown in FIG. 25 may have two doors and generally "U-shaped" tracks spaced from the side walls like tracks 174.

Figure 29:
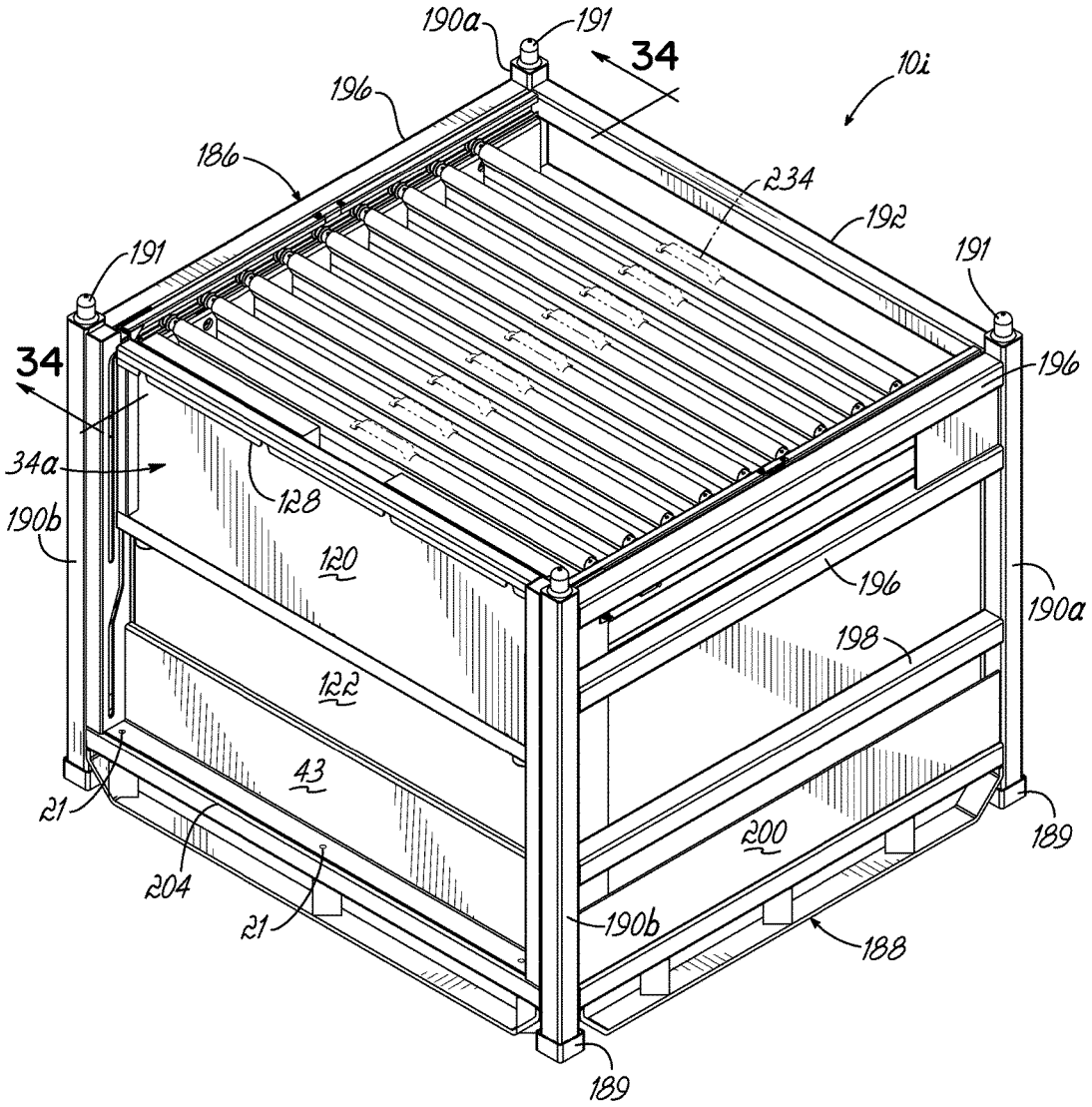
FIG. 29 is a perspective view of another embodiment of reusable and returnable container incorporating a metal frame or rack.
Figure 30:
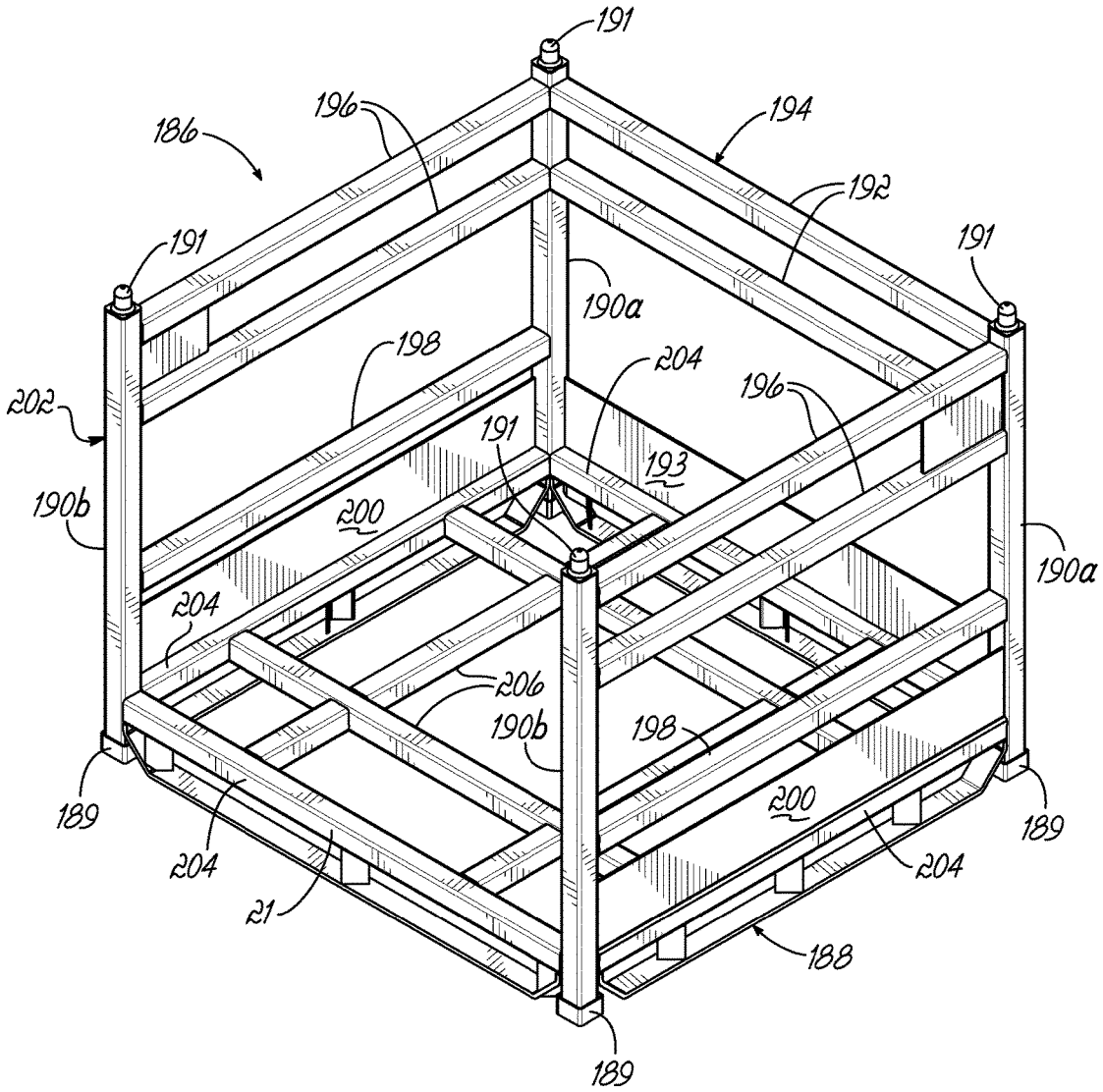
FIG. 30 is a perspective view of the metal frame of the container of FIG. 29.

FIGS. 29-33 illustrate an alternative embodiment of container 10*i*. As best shown in FIG. 30, container 10*i* comprises an outer metal rack or frame 186 having a bottom 188 and four corner posts, two rear corner posts 190*a* and two front corner posts 190*b*. Each of the corner posts 190*a* and 190*b* is generally rectangular in cross-section, has a hollow interior, a knob 191 at the top thereof and a cap 189 at the bottom thereof for stacking purposes so that multiple containers 10*i* may be stacked upon one another. The knobs 191 of a first container fit inside the hollow interiors of the corner posts of another or second container located above the first container for stacking purposes. The metal frame 186 further comprises rear members 192, 193 extending between the two rear corner posts 190*a*. The rear members 192, 193 and rear corner posts 190*a* define a rear portion 194 of the metal frame 186, rear member 193 being below two rear members 192. In some applications, the lower rear member 192 may be omitted for weight reduction.

The metal frame 186 further comprises, on each side of the container, side members 196, 198 and 200 extending between one of the rear corner posts 190*a* and one of the front corner posts 190*b*, the side members 196, 198 and 200 and corner posts 190*a*, 190*b* defining a side portion 202 of the metal frame 186. Side member 198 is below two side members 196, and side member 200 is below side member 198. In some applications, on each side, the lower side member 196 and member 198 may be omitted for weight reduction.

The bottom 188 of the metal rack 186 further comprises four perimeter members 204 defining a rectangle and a plurality of intersecting interior members 206 extending between opposed perimeter members 204, members 204 and 206 comprising part of the bottom 188 of the metal rack 186. Although four interior members 206 are shown in the bottom 188 of the metal rack 186, any number of interior members may be used. Similarly, although the rear and side portions 194, 202 of the metal rack 186 are illustrated as having a certain number of braces or members extending between corner posts, any number of braces or members may extend between corner posts of any desired shape or size.

Figure 31:
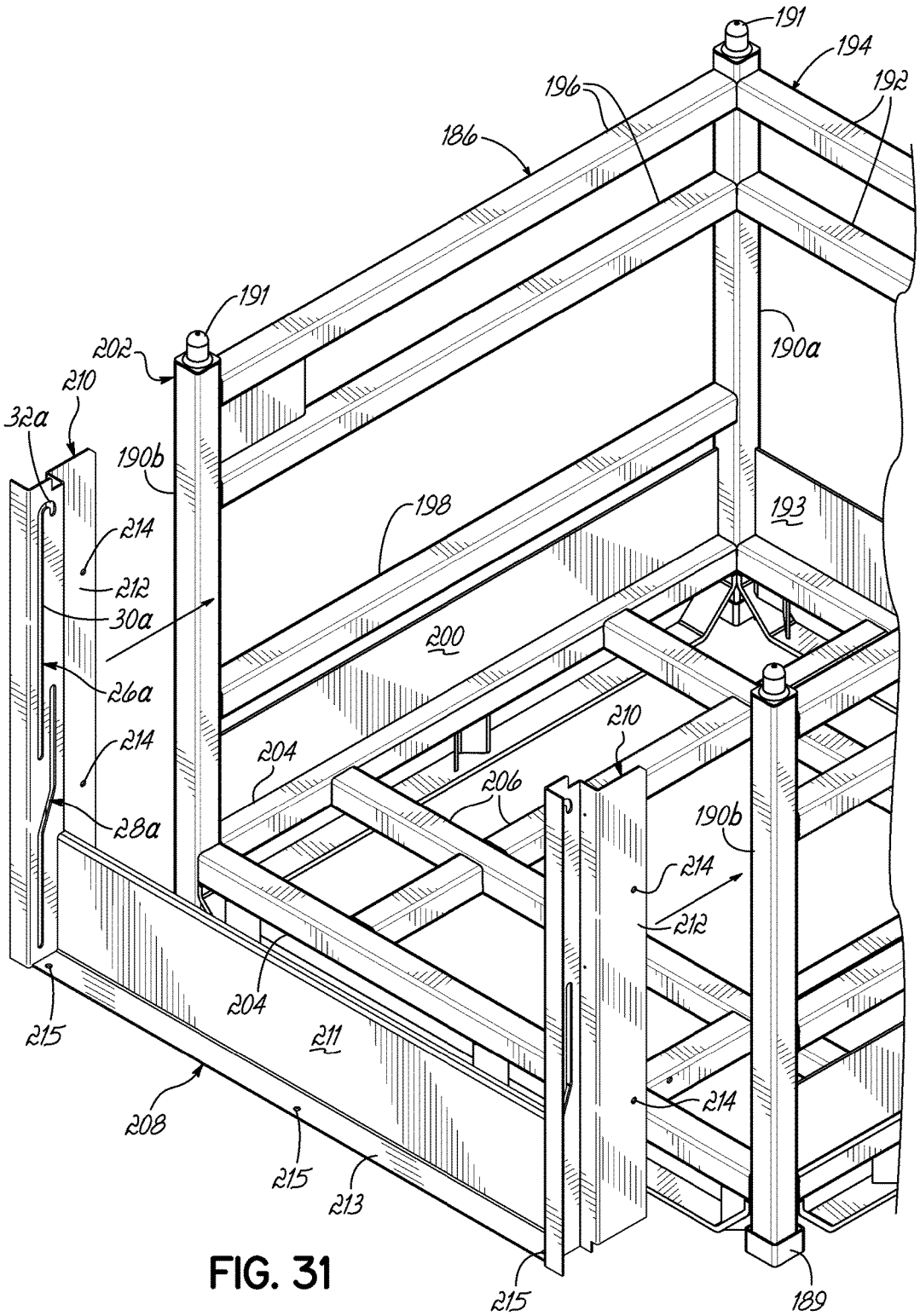
FIG. 31 is a perspective view of the metal frame and guide assembly of the container of FIG. 29.

As best shown in FIG. 31, container 10*i* further comprises a metal generally U-shaped door guide assembly 208 comprising two opposed door guides 210 and a panel 211 extending between the door guides 210 and welded thereto. The panel 211 has a bottom flange 213 which may be secured to the front perimeter member 204 of the bottom 188 of the metal rack 186 using welding or fasteners or any other known technique. For example, the bottom flange 213 of the panel 211 is illustrated having holes 215 through which fasteners may pass. Each door guide 210 has a flange 212 which has holes 214 therethrough so the door guide 210 may be secured via bolts or any other conventional manner to the outer frame 186.

Figure 32:
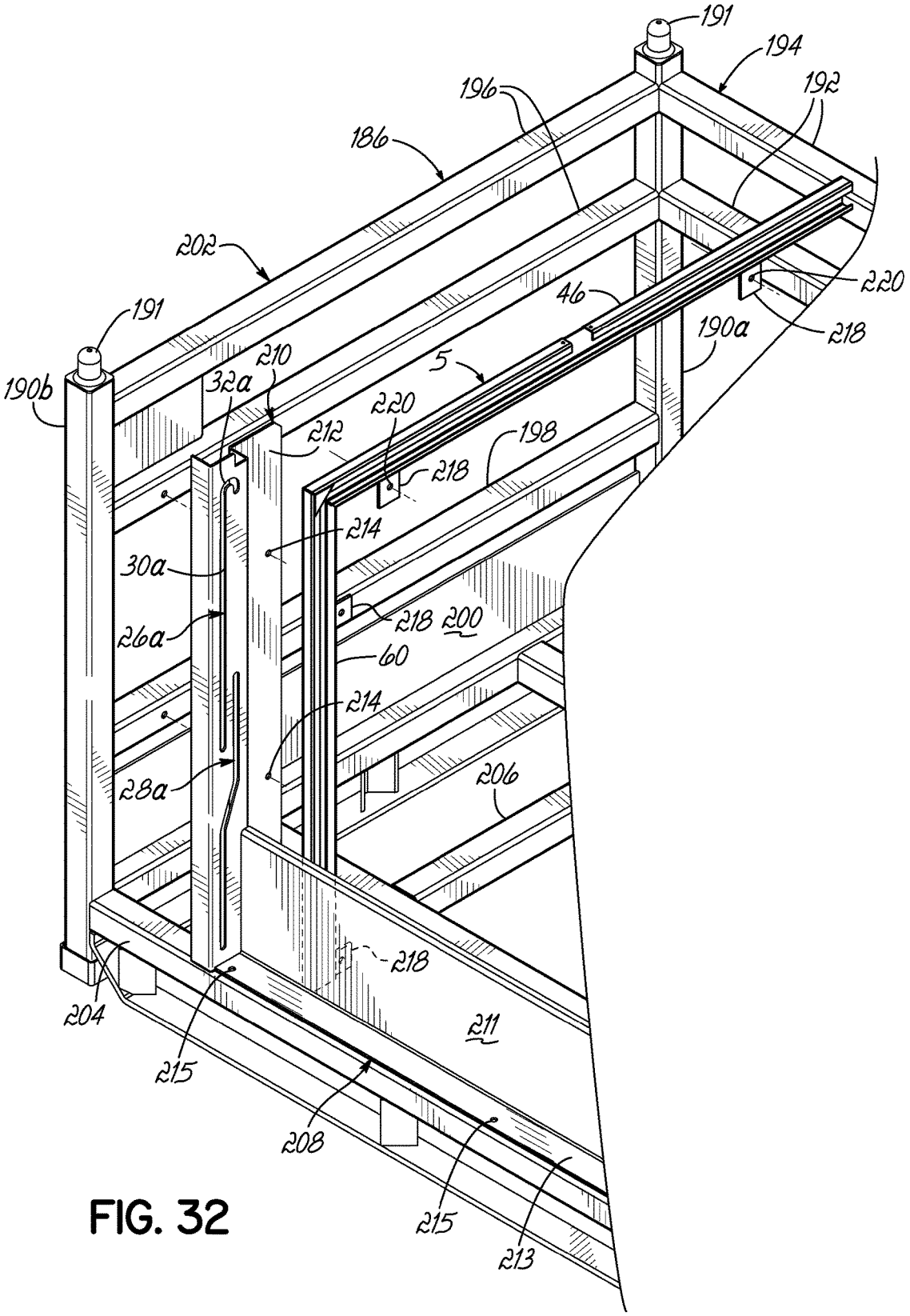
FIG. 32 is a partially dissembled view of a portion of the container of FIG. 29.

Each of the metal guides 210 has two slots therethrough, an upper slot 26*a* and a lower slot 28*a* just like the slots shown and described above. However, any number of slots of any desired shape may be incorporated into the metal guides 210. As best shown in FIGS. 31 and 32, upper slot 26*a* has a "candy cane" shape comprising a straight portion 30*a* and a curved upper portion 32*a*. The lower slot 28*a* is not linear, but rather has a "Z" shape, like the lower slot illustrated in FIG. 7. These upper and lower slots 26*a*, 28*a* are used to secure a movable multi-segmented or multi-piece door identical to the multi-piece door assembly 34*a* having door segments 120, 122 shown and described herein, particularly in FIGS. 6-9A. These slots 26*a*, 28*a* guide the door assembly 34*a* during its movement from an upper or raised position and a lower or dropped position. If desired, the metal guides 210 may have slots of other configurations shown and described herein, including the slot system, including slots 26, 28 shown in FIGS. 1-3D adapted to guide a door panel or assembly, such as the door panel 34 shown and described herein.

As best shown in FIG. 32, container 10*i* further comprises a generally "L-shaped" track 5 secured to each side portion 202 of the metal frame 186 of container 10*i*, which does not move relative to the side portion 202 of the metal frame 186 after the container 10*i* is assembled and during the loading or unloading processes (only one track 5 being shown in FIG. 32). Each "generally L-shaped" track 5 comprises a generally horizontally oriented track portion 46 and a generally vertically oriented track portion 60, the generally horizontally oriented track portion 46 being fixedly secured to one of the side members 196 of one of the side portions 202 of the outer frame 186 of container 10*i* and the generally vertically oriented track portion 60 being fixedly secured to at least one of the side members 196, 198, 200 of one of the side portions 202 of the outer frame 186 of container 10*i*. Each "generally L-shaped" track 5 may be constructed of several pieces or may be a unitary piece and may be constructed in accordance with any of the tracks shown or described herein.

Figure 33:
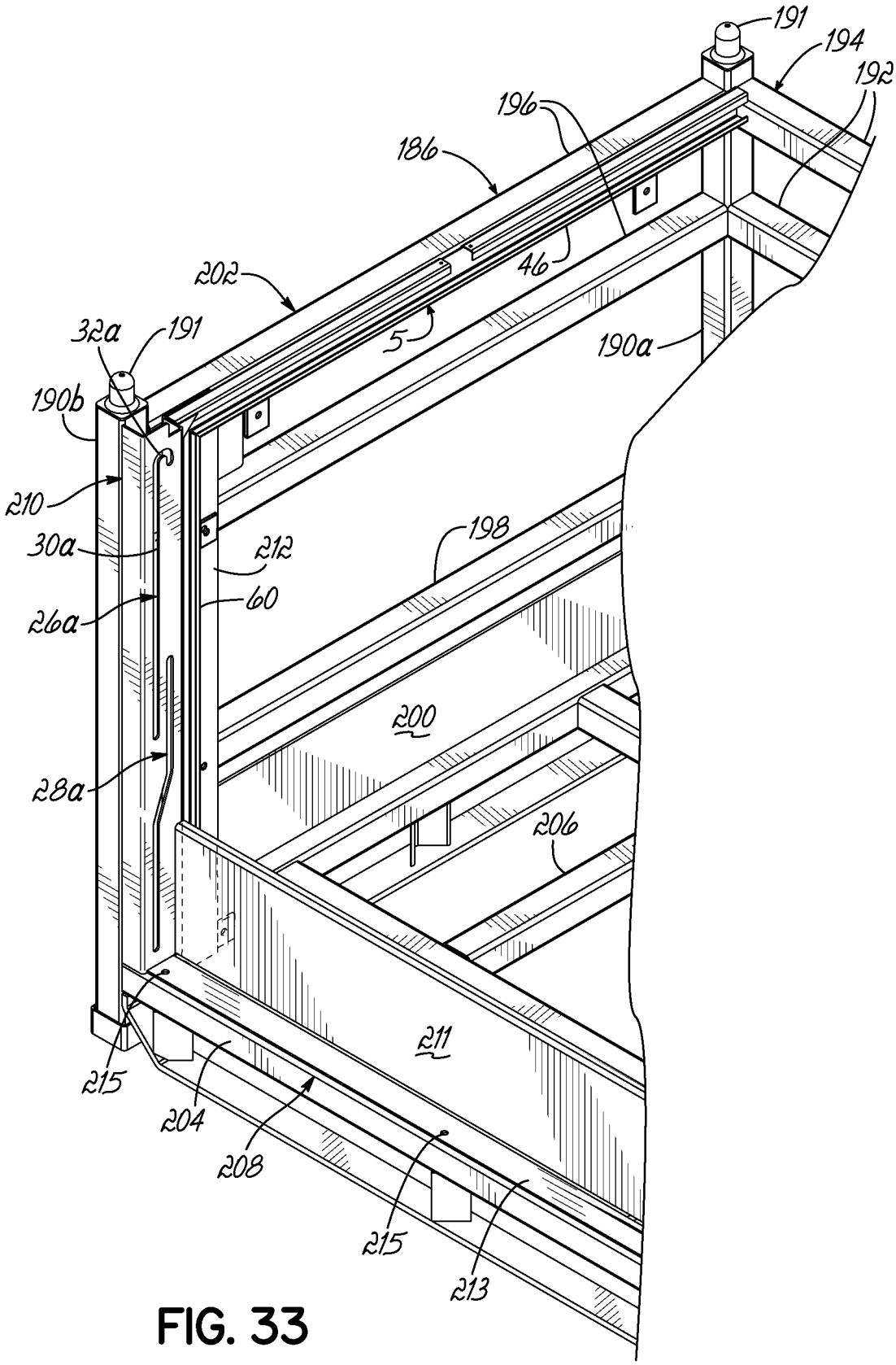
FIG. 33 is a partially dissembled view of a portion of the container of FIG. 29.

As shown in FIG. 32, each of the tracks 5 has multiple plates 218 welded thereto for securing the different pieces of container 10*i* together. Each of the plates 218 has an opening 220 therethrough so a fastener may extend through the plate 218. For example, the track 5 shown in FIG. 32 has two plates 218 attached to the vertically oriented track portion 60 of track 5 and two plates 218 attached to the generally horizontally oriented track portion 46 of track 5. Any number of plates may be used; this document is not intended to limit the number of plates which are part of the track 5. FIG. 33 illustrates one side of container 10*i* partially assembled, the outer frame 186, door guide assembly 208 and track 5 being secured together.

Figure 36:
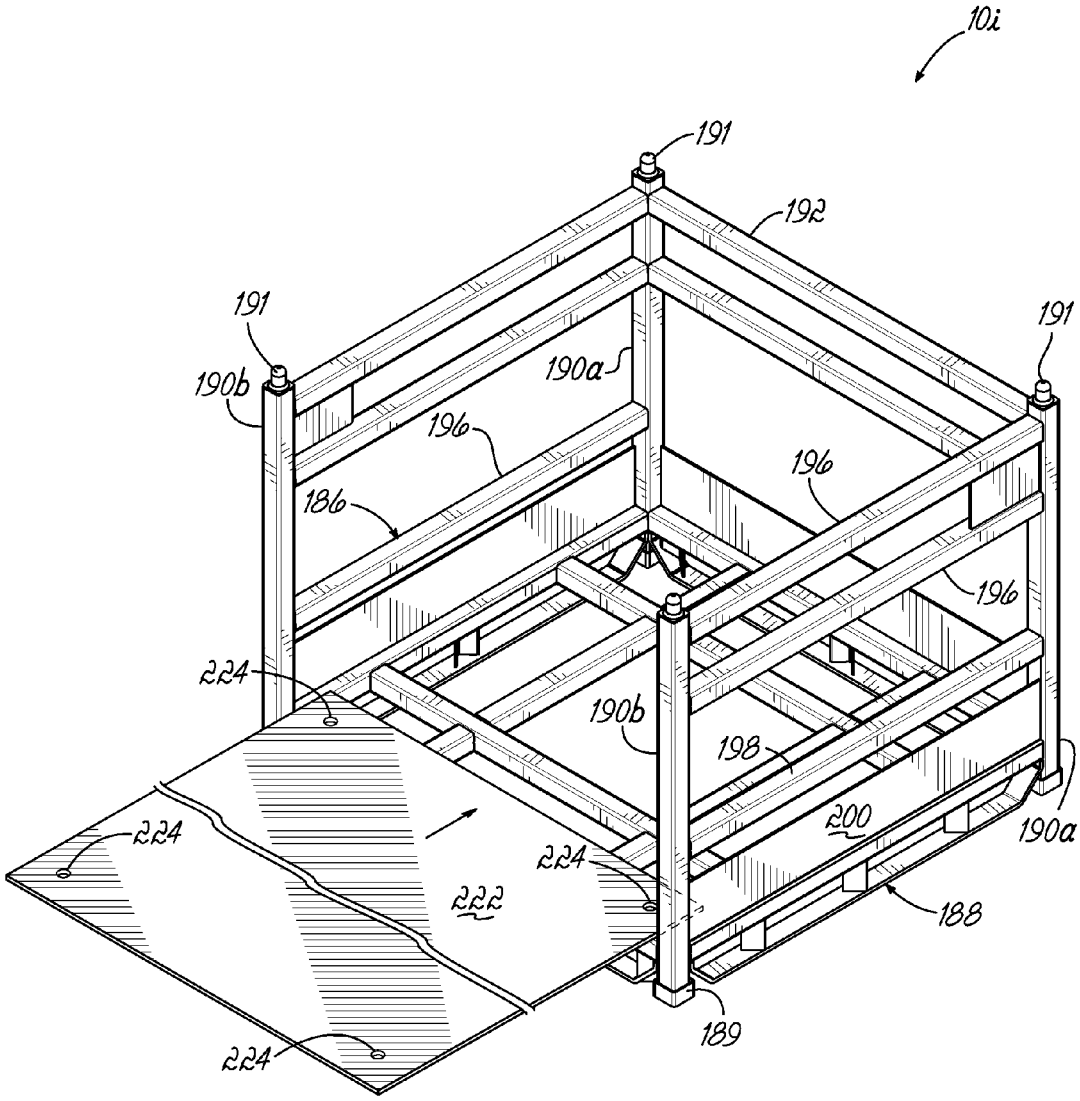
FIG. 36 is a partially dissembled view of a portion of the container of FIG. 29.

As shown in FIG. 36, a floor or panel 222 resides on the bottom 188 of the metal rack 186 on the inside thereof. The floor 222 has four openings 224 at the corners thereof for drainage and/or handling purposes. The floor 222 may or may not be secured to the bottom 188 of the metal frame 186. The floor 222 is preferably made of plastic, but may be made of any desired material.

Figure 35:
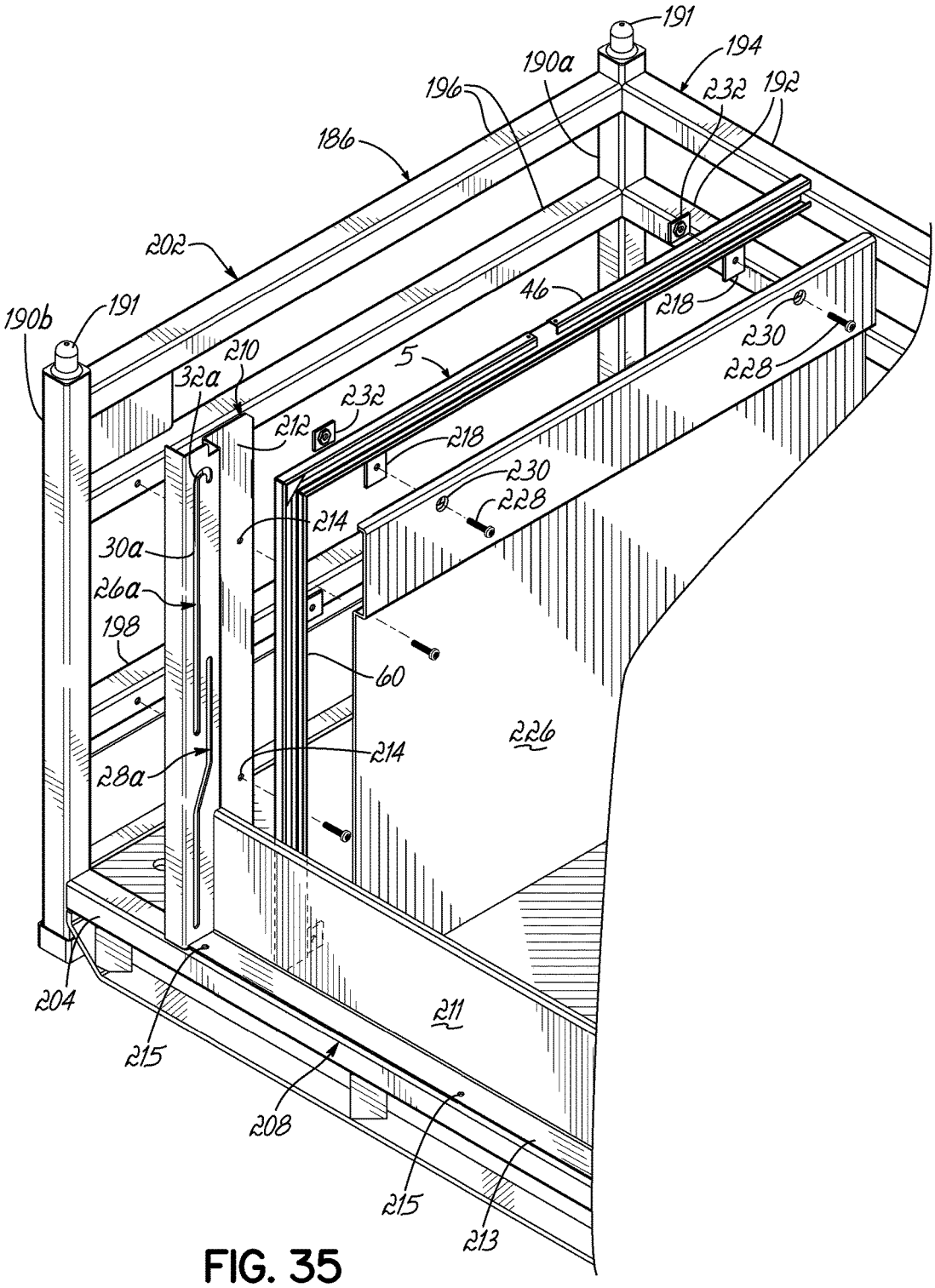
FIG. 35 is a partially dissembled view of a portion of the container of FIG. 29.

As shown in FIG. 35, a side piece or guard 226 is secured to each side portion 202 of the metal rack 186 on the inside thereof (only one being shown). Although preferably made of plastic, these members 226 may be made of any other suitable material. Fasteners 228 extend through openings 230 in the side piece 226, through the openings 220 in the plates 218 of the track 5 and are secured in place with a nut 232 for purposes of securing the side piece 226 to the track 5.

Figure 34:
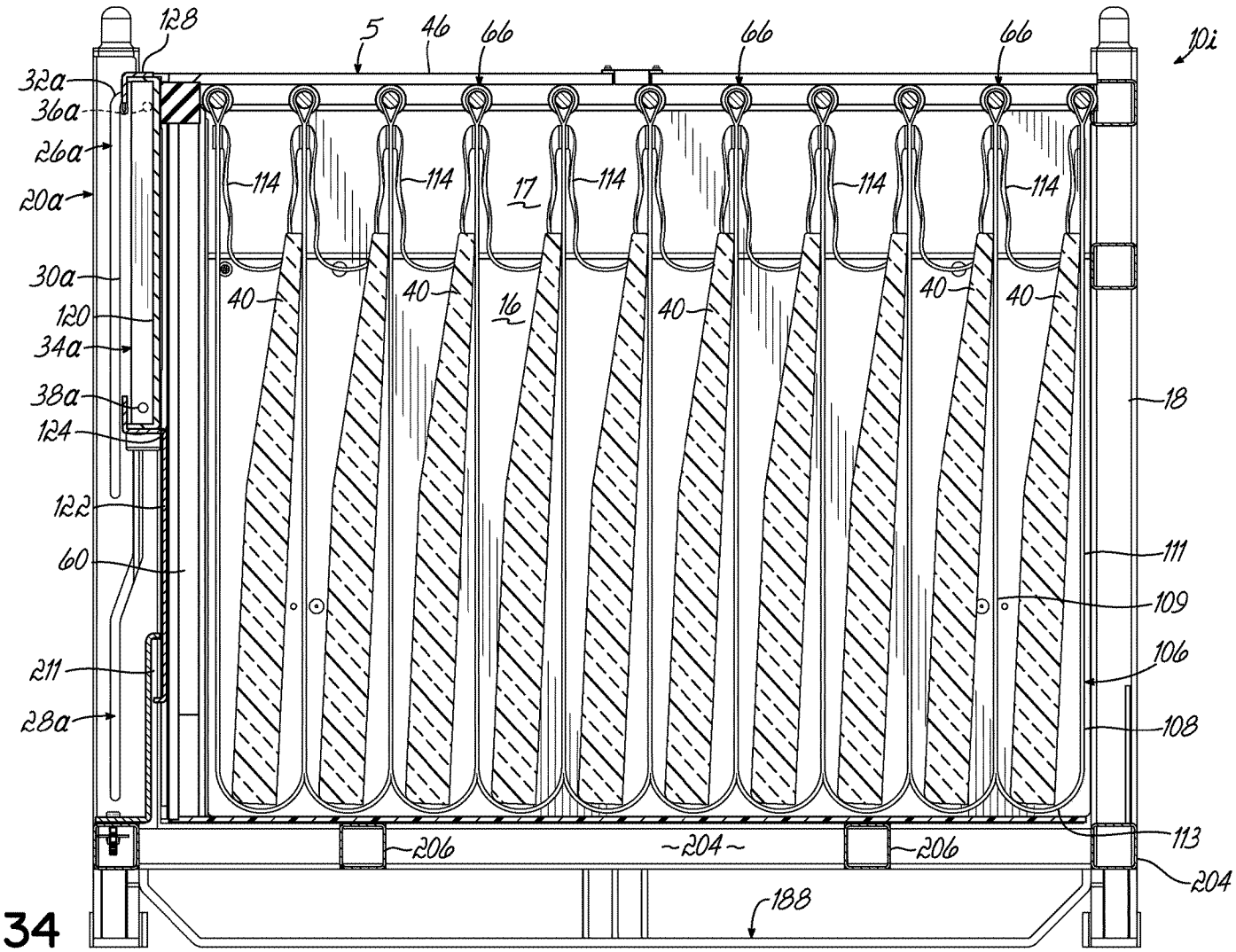
FIG. 34 is a cross-sectional view taken along the line 34-34 of FIG. 29 with products shown in the pouches.

As best shown in FIG. 34, dunnage 106 in the form of a plurality of pouches 108 are suspended by and supported by a plurality of dunnage supports 66. Each pouch 108 has a front wall 109, a rear wall 111 and a bottom 113 extending therebetween. As shown in FIG. 34, the top of the front wall 109 is attached to one of the dunnage supports 66 and the rear wall 111 being attached to an adjacent dunnage support 66 in any manner described or illustrated herein. Although the dunnage 106 shown comprises pouches, the dunnage may assume other shapes or configurations. FIG. 34 illustrates straps or space limiters 114 extending between adjacent pouch panels or walls to facilitate load or unloading products 40 as described herein. FIG. 34 illustrates products 40 being secured inside the pouches 108, the products 40 being purely for illustrative purposes, as described above. Any embodiment described or illustrated herein may be used with products of different sizes or shapes. The illustrated products 40 are not intended to be limited to any particular size or shape in any of the embodiments.

If desired, as shown in FIG. 29, each of the dunnage walls may have a handle 234 sewn therein directly above each of the movable dunnage supports 66. This feature may exist in any of the embodiments shown or described herein.

Figure 37:
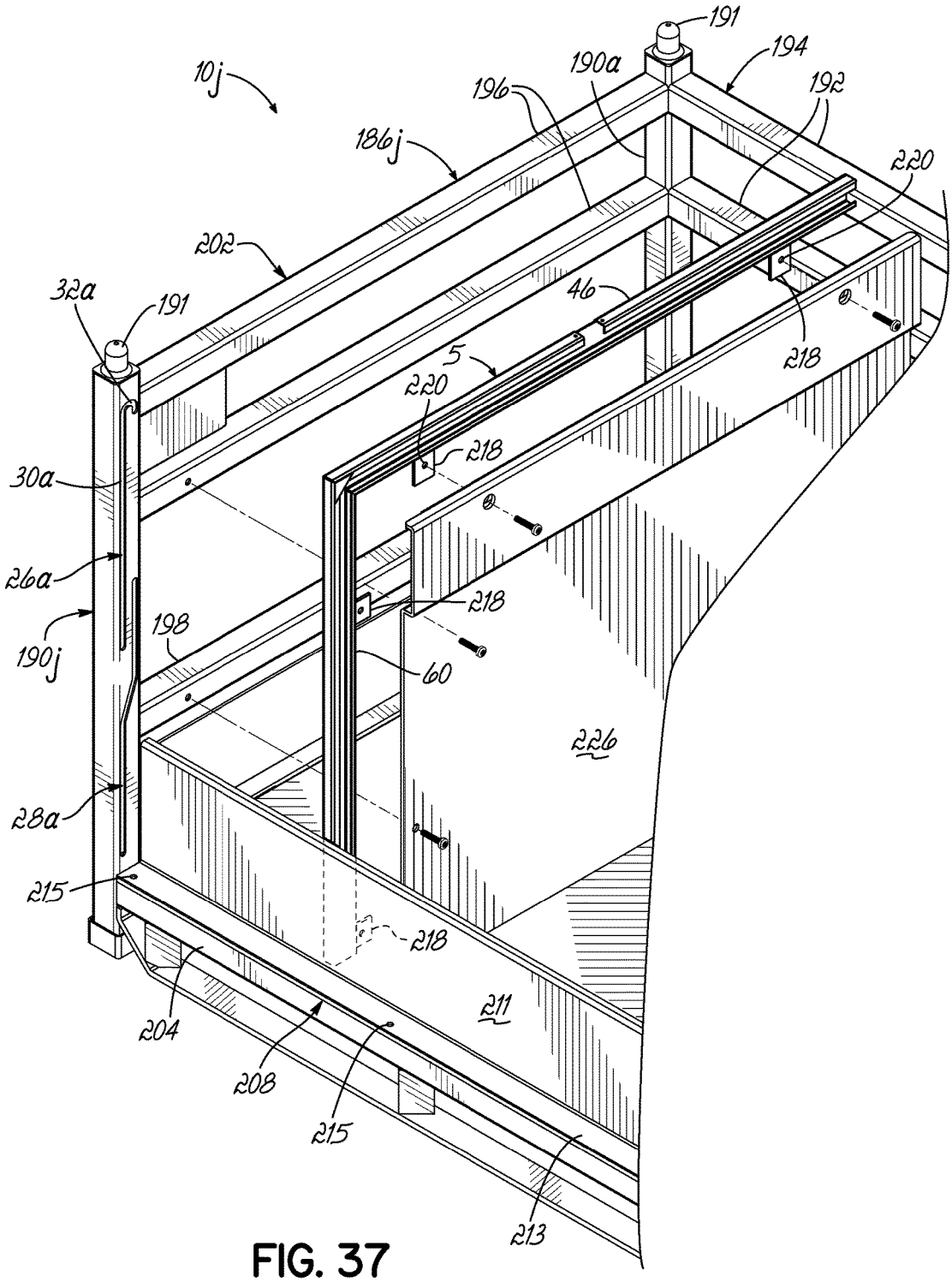
FIG. 37 is a partially dissembled view of a portion of another embodiment of reusable and returnable container incorporating a metal rack.
Figure 38:
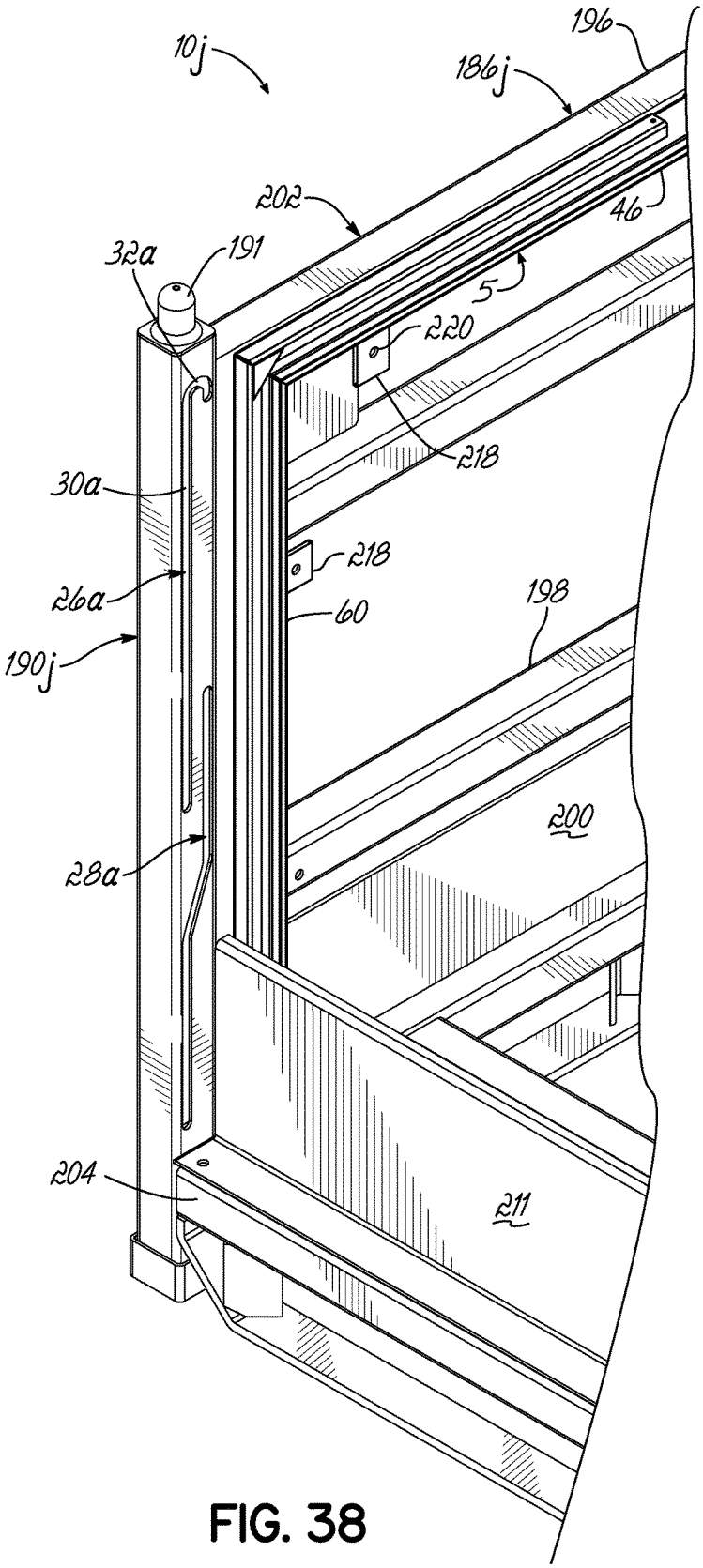
FIG. 38 is a partially dissembled view of a portion of another embodiment of reusable and returnable container of FIG. 37.

FIGS. 37 and 38 illustrate an alternative embodiment of container 10*j* very similar to container 10*i*. For simplicity, like numbers represent like parts. Container 10*j* has an outer frame 186*j* which is identical to outer frame 186 of the embodiment of FIGS. 29-36 except for the two front corner posts. As best shown in FIG. 37, each of the two front corner posts 190*j* of outer frame 186*j* of container 10*j* has slots 26*a*, 28*a* identical to those described and illustrated in door guides 210 of the container 10*i* for purposes of guiding movement of a door assembly like door assembly 34*a*. Therefore, container 10*j* lacks any door guides 210. In virtually all other respects, container 10*j* is identical to container 10*i*.

Figure 39:
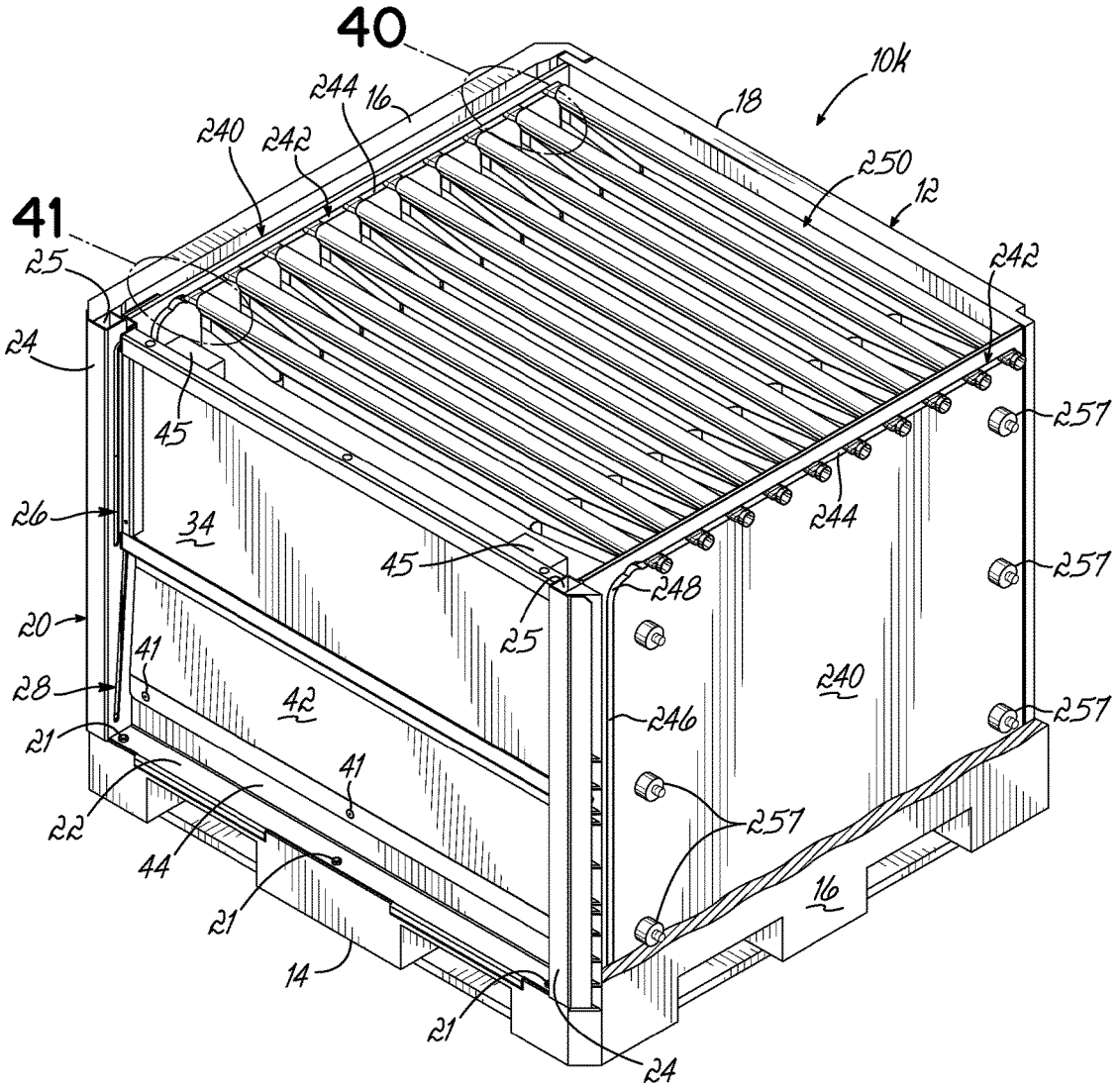
FIG. 39 is a perspective view of another embodiment of a reusable and returnable container having slotted tracks, dunnage supports and associated dunnage in the form of pouches.
Figure 40:
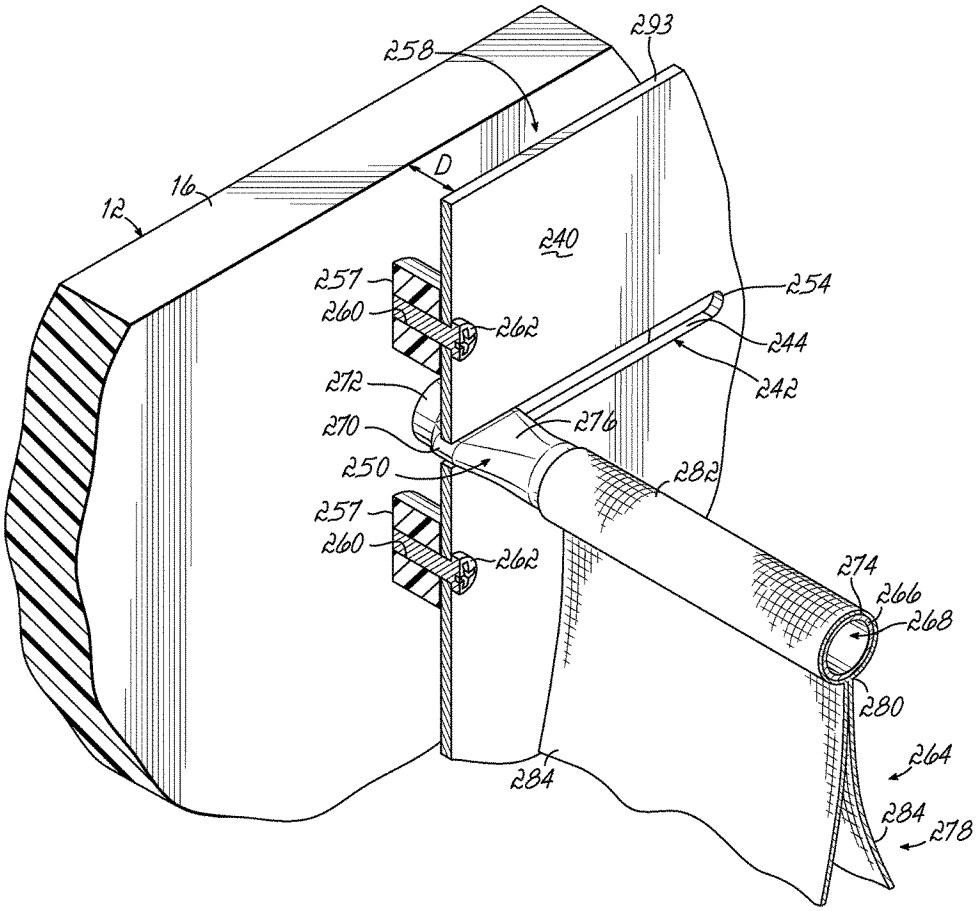
FIG. 40 is a perspective view of the encircled area 40 of FIG. 39.
Figure 41:
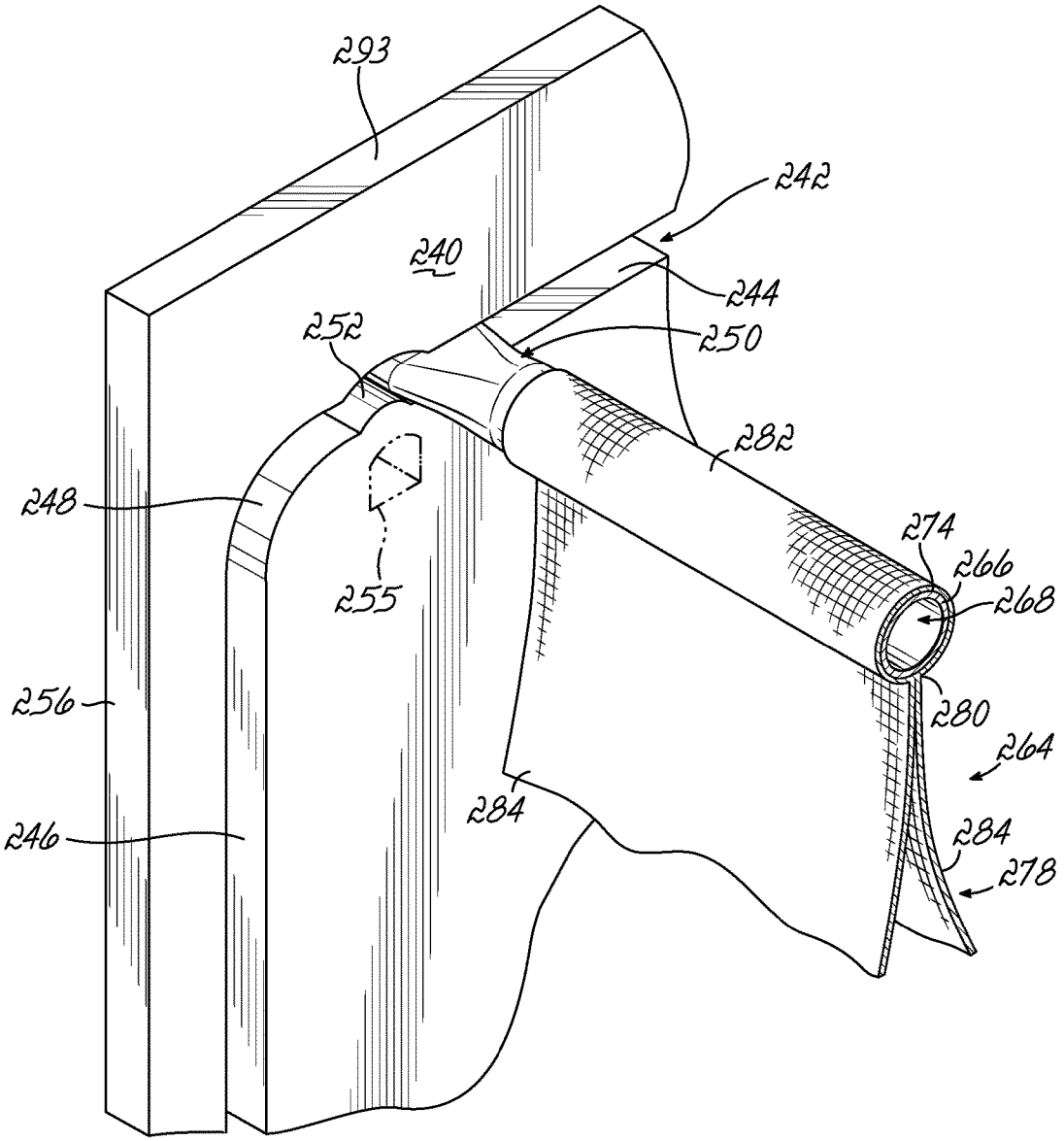
FIG. 41 is a perspective view of the encircled area 40 of FIG. 39.

FIGS. 39-41 illustrate a reusable and returnable container 10*k* according to another embodiment. FIG. 39 illustrates container 10*k* having a movable door segment 34, as in container 10 shown in FIG. 1. Alternatively, any other sliding door, door segment or door assembly shown or described herein, may be incorporated into container 10*k*.

Figure 48:
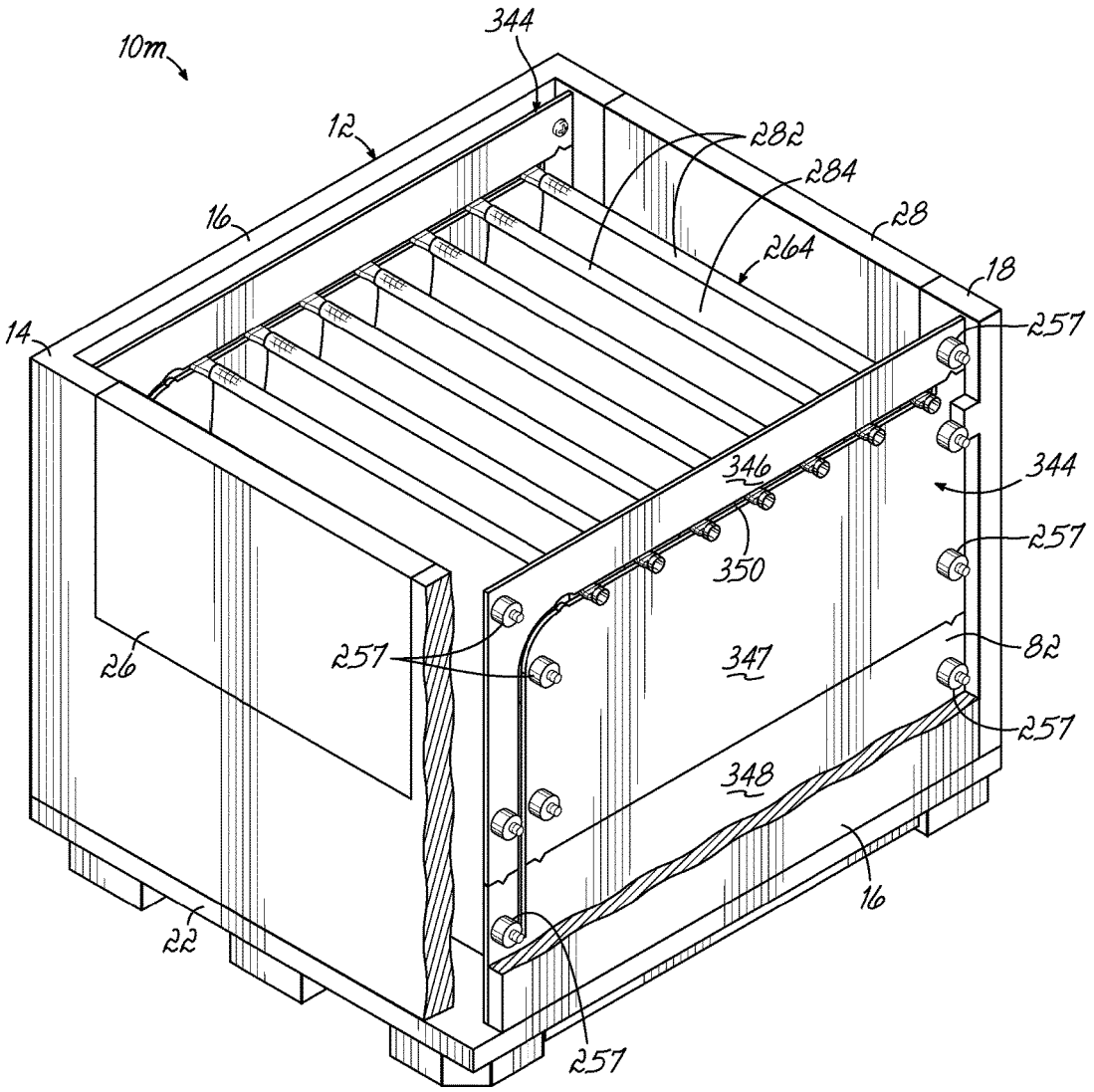
FIG. 48 is a perspective view of an alternative embodiment of a reusable and returnable container having generally L-shaped tracks, dunnage supports and associated dunnage in the form of pouches.
Figure 49:
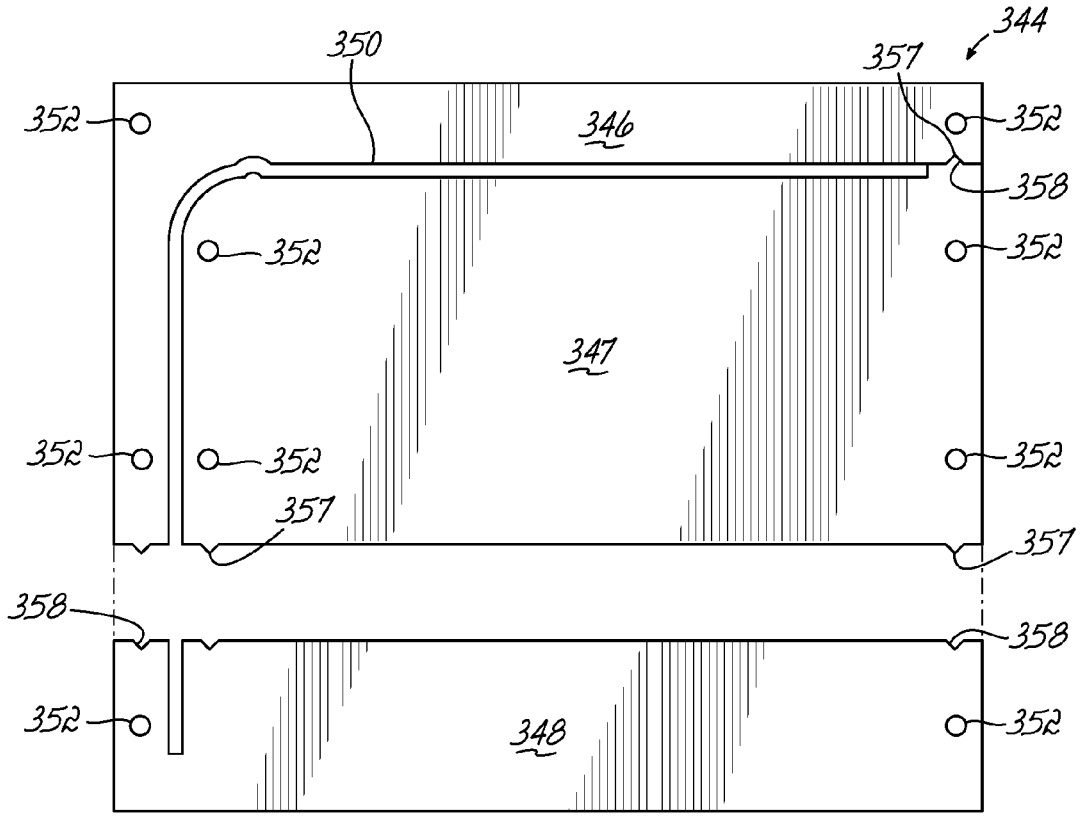
FIG. 49 is a side elevational view of the composition of one of the guides of the container of FIG. 49.
Figure 50:
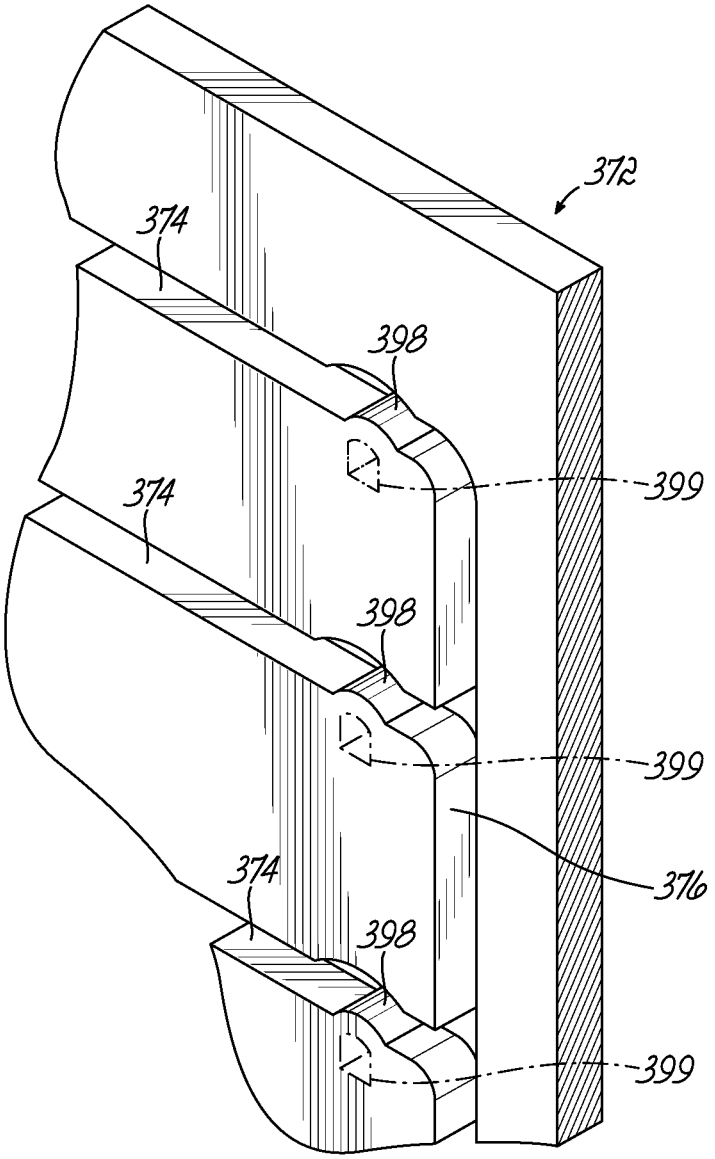
FIG. 50 is a perspective view showing a different guide.

FIGS. 39, 40 and 41 illustrate a pair of guides 240, each guide 240 being secured to one of the side walls 16. Each guide 240 may be a single piece or plate, as shown in FIGS. 39, 40 and 41 or, alternatively, may be made of multiple pieces or plates, as shown in FIGS. 48-50. Each guide 240 is preferably made of plastic; in one embodiment, high density polyethylene. However, each guide may be made of any other suitable material.

As best seen in FIGS. 39, 40 and 41, each of the guides 240 has an upper edge 293, a generally "L-shaped" slotted track 242 comprising a generally horizontally oriented track portion 244 and a generally vertically oriented track portion 246. On each side of the container, the top of the generally vertically oriented slotted track portion 246 may connect or communicate with the front end of the generally horizontally oriented track portion 244 at rounded corner 248. The generally horizontally oriented track portion 244 connects with the interior of the generally vertically oriented track portion 246 so that one of the dunnage supports 250 may move along a continuous path in both a horizontal and vertical direction.

The generally horizontally oriented track portion 244 of each generally "L-shaped" slotted track 242 of each guide 240 may have a bump 252, as best shown in FIG. 41. In some instances, the bump 252 may be omitted. As best shown in FIG. 40, the generally horizontally oriented track portion 244 of each generally "L-shaped" slotted track 242 of each guide 240 may have a rounded end 254 and extend forwardly towards a front edge 256 of the guide 240. As shown in FIG. 41, each of the guides 240 may have a cut-out 255 (shown in dashed lines) below bump 252 in which material is removed so that the bump 252 may be moved downwardly easily so that dunnage supports and/or associated dunnage may move from the generally horizontally oriented track portion 244 into the generally vertically oriented track portion 246 of each generally "L-shaped" slotted track 242.

As best shown in FIG. 40, each of the guides 240 is spaced inwardly towards the center of the container a distance D by a plurality of spacers 257, thereby creating a gap 258. Each of the spacers 257 is illustrated being cylindrical in shape, but may be any size or shape depending upon the desired distance or gap D and fasteners in any of the embodiments shown or described herein. Each of the spacers 257 has a central bore 260 through which a fastener 262 passes. Although the fasteners 262 are illustrated being screws, any other conventional fasteners may be used to secure the guides 240 inwardly from the side walls in any of the embodiments shown or described herein. Although the drawings show multiple spacers 257 separating one of the guides 240 from one of the container sides 16, a single spacer or any number of spacers of any desired shape may be used in any of the embodiments shown or described herein. The fasteners may pass through the spacer or spacers or avoid them in any of the embodiments shown or described herein.

FIG. 39 illustrates movable dunnage supports 250, each dunnage support 250 being a unitary member and extending between a pair of generally horizontally oriented track portions 244 of generally "L-shaped" slotted tracks 242 at the same level or height. The guides 240, in combination with the side walls 16, support the weight of the dunnage supports 250 and dunnage 264 suspended from the dunnage supports 250. The dunnage supports 250 are identical to any of those shown and described herein and shown in U.S. patent application Ser. No. 14/281,246, which is fully incorporated by reference herein. As shown in FIG. 40, each dunnage support 250 has a tubular wall 266 and a hollow interior 268. Dunnage support 250 has two narrowed or crimped portions 270, one at each end (only one being shown) which contact and move along the generally "L-shaped" slotted tracks 242 of opposed guides 240. Outside of each narrowed or crimped portion 270 is an end portion 272 which is approximately the same diameter as the middle portion 274 of the tubular dunnage support 250. Inside of each narrowed or crimped portion 270 is a tapered portion 276.

As best shown in FIGS. 40 and 41, each dunnage support 250 at each end has a narrowed or crimped portion 270 located inwardly from an end portion 272 (only one being shown). The narrowed or crimped portions 270 of each dunnage support 250 reside in one of the generally "L-shaped" slotted tracks 242 of one of the guides 240, as shown in FIGS. 39 and 40 and slide thereon (only one being shown in FIG. 40). The narrowed or crimped portion 270 is sized to reside on and engage one of the generally "L-shaped" slotted tracks 242 of one of the guides 240. The end portion 272 of each dunnage support 250 resides inside the gap 258 on one side of the container 10*i* and moves therein upon movement of the dunnage support 250.

Each dunnage support 250 may be any desired configuration and is not intended to be limited by the drawings of this document. Similarly, the location and length of each narrowed or crimped portion 270 of each dunnage support 250 is not intended to be limited by the drawings of this document. Each dunnage support may be a single unitary piece as shown in FIGS. 39, 40 and 41 or multiple pieces joined together, as shown herein.

The plastic material of the guides 240, such as polyvinyl chloride or PVC, facilitates movement of metal dunnage supports 250 inside the container. The presence of the generally "L-shaped" slotted tracks 242 of the guides 240 makes moving the dunnage supports 250 at any level easier for an operator from an ergonomic standpoint and thus, may reduce the time necessary to load or unload a container. A further benefit may be reduced injuries or time off work from operators using such containers to load or unload parts from the dunnage inside the containers.

The dunnage 264 may comprise one or more pieces of dunnage material. In one embodiment, one piece of dunnage material is used. However, multiple pieces of material may be used. The material may be a textile material, such as polyester. However, this document is not intended to limit the material of the dunnage.

The drawings show dunnage 264 supported by the dunnage supports 250 being in the form of pouches 278. Two adjacent dunnage supports 250 support a pouch 278 and the contents inside the pouch.

As shown in FIGS. 40 and 41, the dunnage material may be secured to itself via sewing or welding along a seam 280, as is known, to create a receiver or pocket 282. One of the dunnage supports 250 passes through receiver 282. Two plies of fabric 284, which form sides of adjacent pouches 278, hang downwardly from the receiver or pocket 282, as best shown in FIG. 40.

Although container 10*k*, shown in FIGS. 39, 40 and 41, has a single horizontally oriented slotted track portion, dunnage supports and dunnage, any of the containers shown or described herein may have more than horizontally oriented levels of slots formed in or by guides secured to and supported by the body of a container, dunnage supports extending between the slots of a level and dunnage hanging from the dunnage supports. See FIG. 50. The slots may be any slots shown or described herein. The slots may be used in connection with any one of the dunnage supports shown or described herein, regardless of whether the dunnage supports are unitary members or made from multiple pieces. For example, but intended to be limiting, dunnage supports used in a container like container 10*k* movable along generally "L-shaped" slotted tracks 242 formed in guides 240 may be any other dunnage supports shown or described herein.

Figure 42:
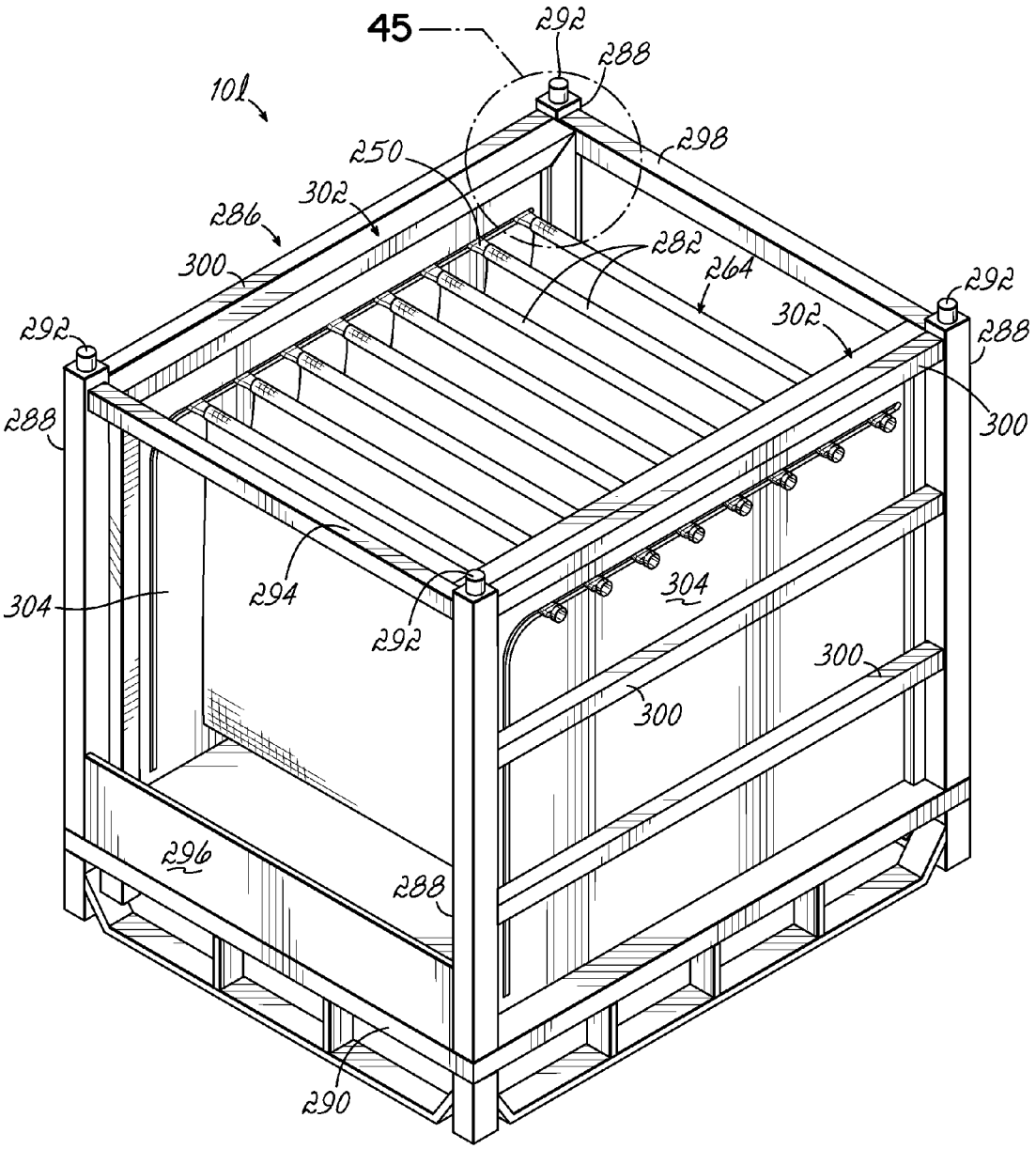
FIG. 42 is a perspective view of an alternative embodiment of a reusable and returnable container having slotted tracks, dunnage supports and associated dunnage in the form of pouches.

FIGS. 42-45 illustrate a reusable and returnable container 10*l* according to another embodiment. The container 10*l*, like container 10*i* illustrated in FIG. 29, comprises a rack-style of container. The reusable and returnable container 10*l*, as shown, comprises a metal body 286 having four corner posts 288 and a bottom or base 290. Each corner post 288 has a knob 292 at the top of the corner post 288. This enables containers 10*l* to be stacked on top of each other, the knobs 292 fitting inside the hollow corner posts 288 of the other container on top. The body 286 has a front beam 294 and a front member 296 secured to and extending between front corner posts 288 and a rear beam 298 secured to and extending between rear corner posts 288. The container 10*l* further comprises three side members 300 secured to and extending between front and rear corner posts 288 on the same side of the container. However, other configurations of metal rack structures may be used in accordance with the present invention. The drawings are not intended to limit the rack configuration. For example, although one style of base 290 is shown in FIG. 42, the base may assume other configurations.

Figure 43:
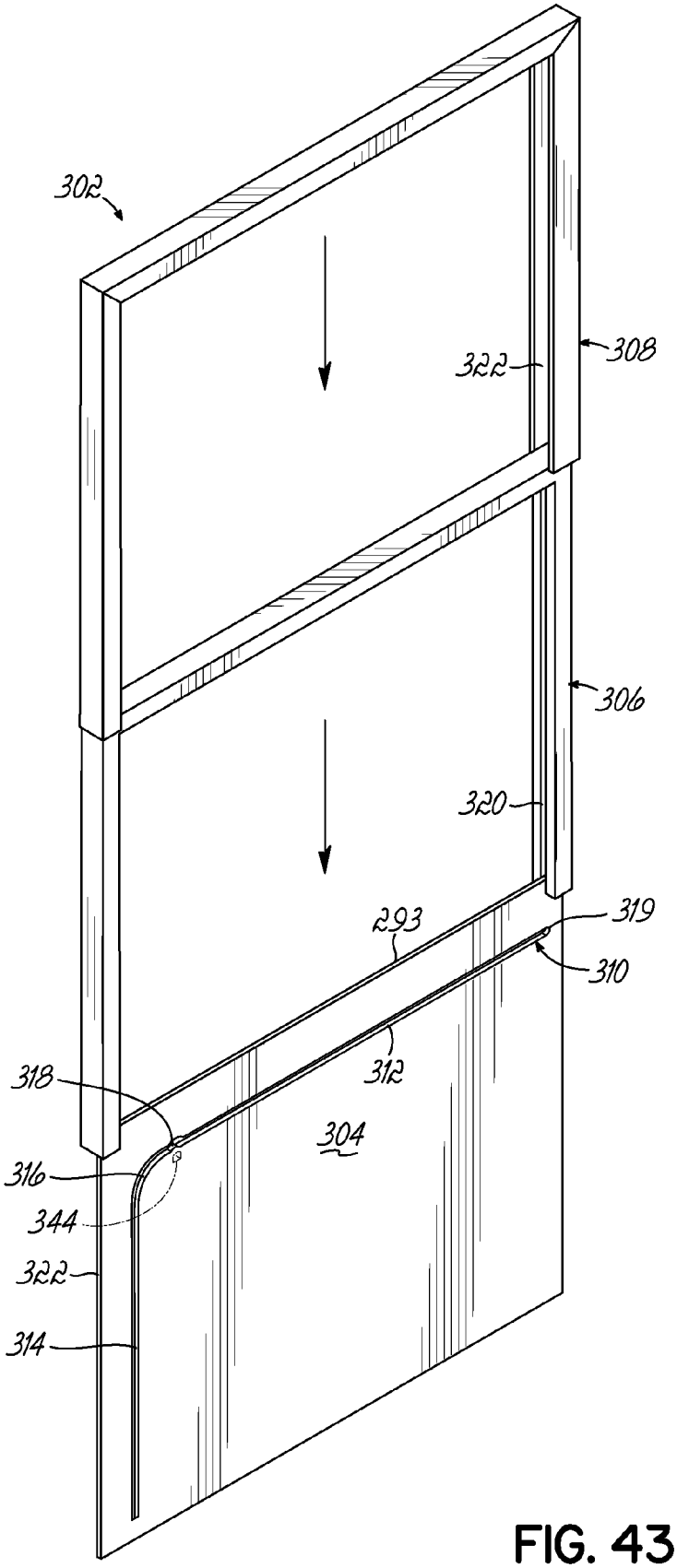
FIG. 43 is a partially disassembled view of a side of the container of FIG. 42.
Figure 44:
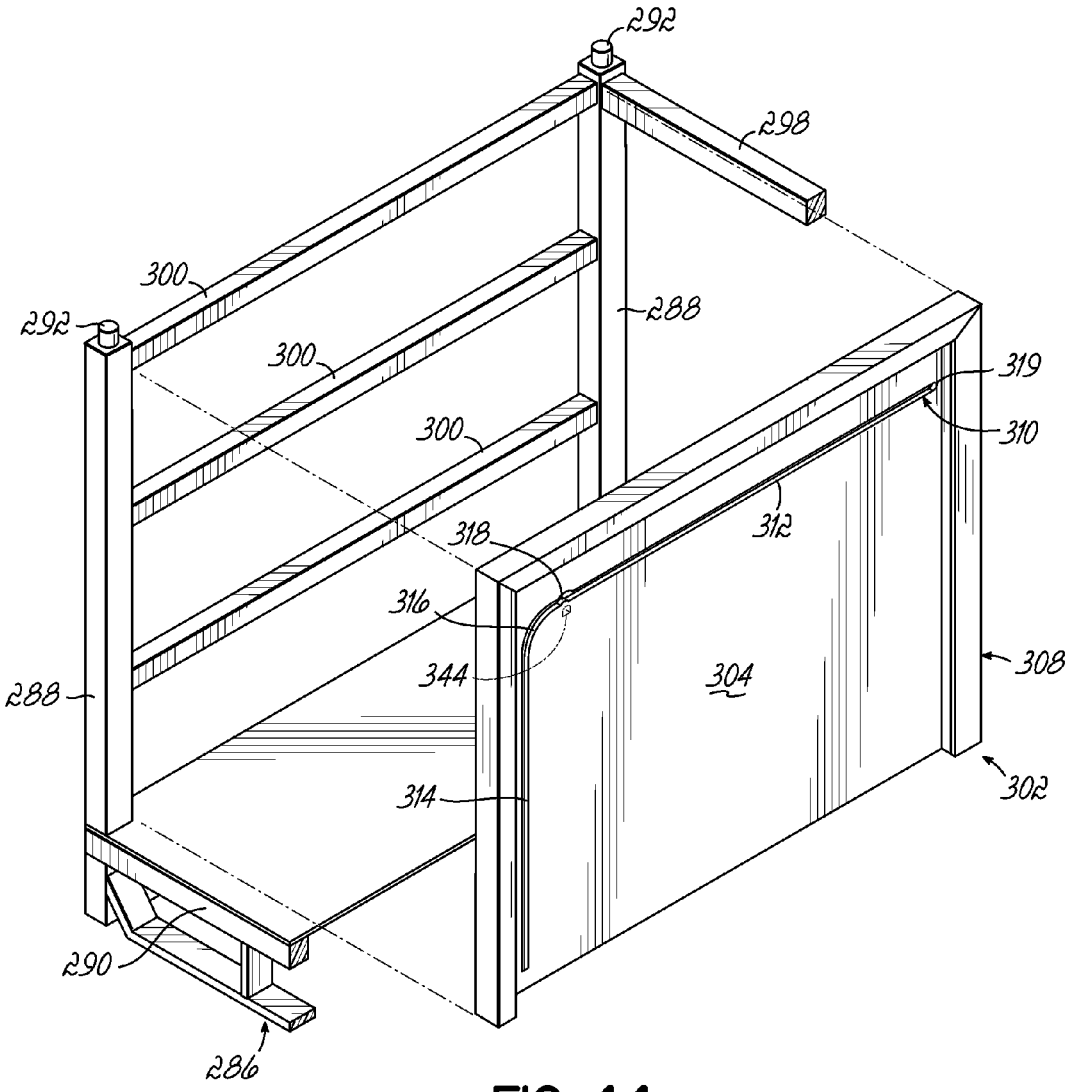
FIG. 44 is a partially disassembled view of the container of FIG. 42.

As shown in FIGS. 43 and 44, the reusable and returnable container 10*l* further comprises a side structure 302 secured to each side of the rack body 286. More specifically, each side structure 302 comprises a guide 304 similar to the guides described in U.S. patent application Ser. No. 14/539,115, which is fully incorporated herein, an inverted U-shaped cushion 306 and an inverted U-shaped frame 308.

As best shown in FIG. 43, each guide 304 (only one being shown) has a generally "L-shaped" slotted track 310 comprising a generally horizontally oriented track portion 312 and a generally vertically oriented track portion 314. On each side of the container, the top of the generally vertically oriented slotted track portion 314 may connect or communicate with the front end of the generally horizontally oriented track portion 312 at rounded corner 316. The generally horizontally oriented track portion 312 connects with the interior of the generally vertically oriented track portion 314 so that one of the dunnage supports 250 may move along a continuous path in both a horizontal and vertical direction.

Although the generally horizontally oriented track portion 312 of each generally "L-shaped" slotted track 310 of each guide 304 is illustrated as having a bump 318, as best shown in FIG. 43, the bump 318 may be omitted. As best shown in FIG. 43, the generally horizontally oriented track portion 312 of each generally "L-shaped" slotted track 310 of each guide 304 has a rounded end 319 and extends forwardly towards a front edge 322 of the guide 304. As shown in FIG. 43, each of the guides 304 may have a cut-out 344 (shown in dashed lines) below bump 318 in which material is removed so that the bump 318 may be moved downwardly easily so that dunnage supports and/or associated dunnage may move from the generally horizontally oriented track portion 312 into the generally vertically oriented track portion 314 of each generally "L-shaped" slotted track 310.

The inverted U-shaped cushion 306 is preferably made of foam/fiber or a combination thereof and has a groove 320 therein sized to receive and retain one of the guides 304. The guide 304 resides inside the groove 320 of the inverted U-shaped cushion 306. The inverted U-shaped cushion 306 functions to protect the guide 304 and inhibit movement of the guide 304.

The inverted U-shaped frame 308 is preferably made of plastic and has a groove 322 therein sized to receive and retain the inverted U-shaped cushion 306. The inverted U-shaped cushion 306 and guide 304 reside inside the groove 322 of the inverted U-shaped frame 308.

Figure 45:
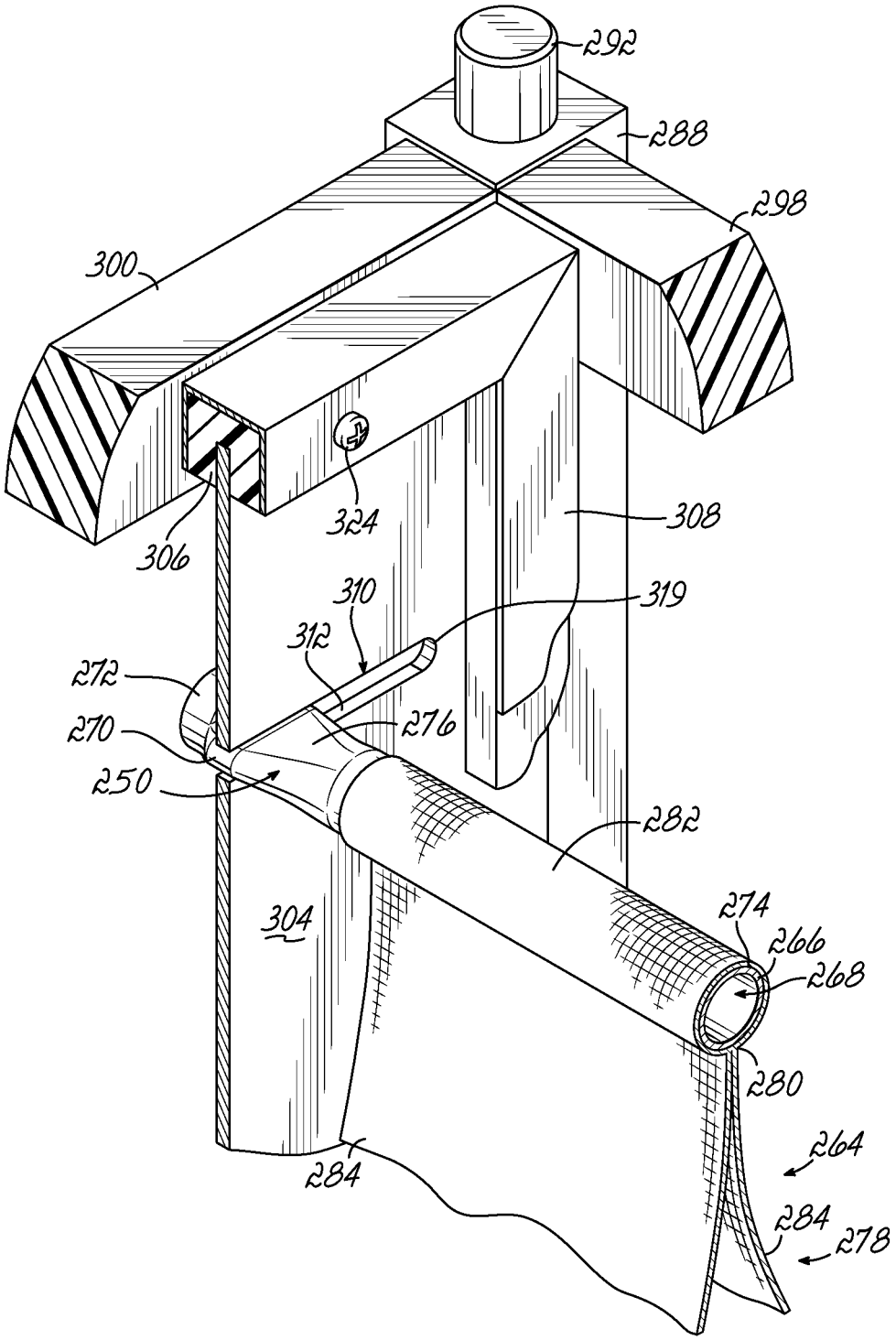
FIG. 45 is a perspective view of the encircled area 45 of FIG. 42.

As shown in FIG. 45, each side structure 302 is secured to multiple side members 300 extending between front and rear corner posts 288 on the same side of the container 10*l* with fasteners 324 (only one being shown in FIG. 45). Alternatively, each side structure 302 may be secured to the front and rear corner posts 288 on the same side of the container 10*l*.

FIG. 42 illustrates multiple dunnage supports 250, each dunnage support 250 being a unitary member and extending between a pair of generally "L-shaped" slotted tracks 310. The guides 304, in combination with the container sides or side structures, support the weight of the dunnage supports 250 and associated dunnage 264. The dunnage supports 250 and associated dunnage 264 are identical to those described herein and shown in FIGS. 39-41.

Figure 46:
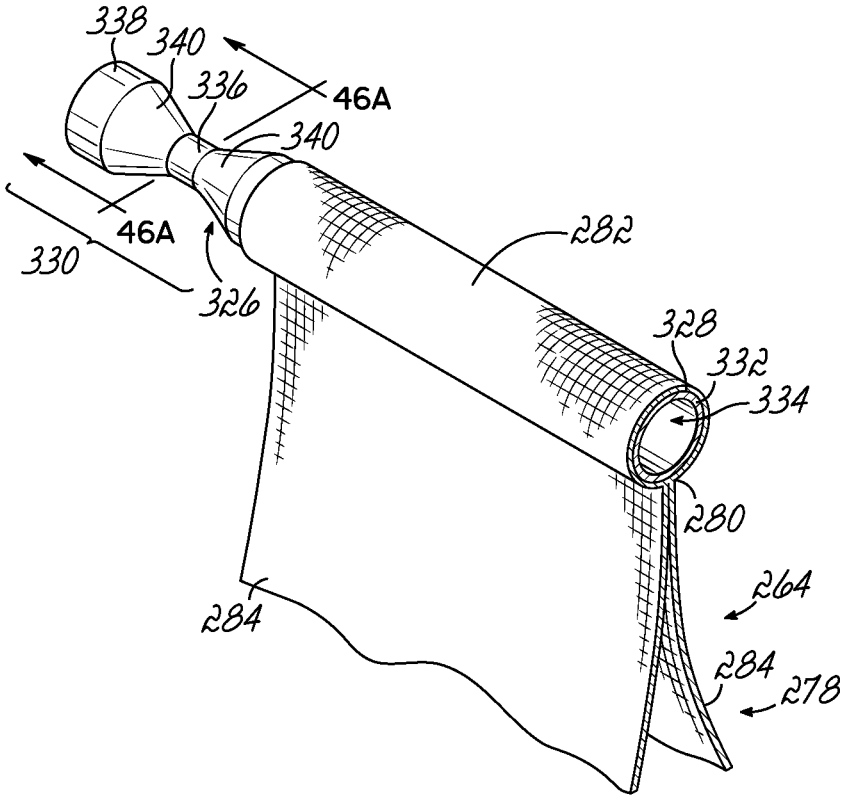
FIG. 46 is a perspective view showing one end of a different dunnage support.
Figure 46A:
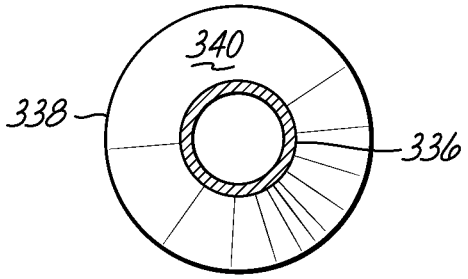
FIG. 46A is a cross-sectional view along the line 46A-46A of FIG. 46.

FIG. 46 illustrates another embodiment of dunnage support 326 which may be used in any of the containers shown or described herein, with any desired dunnage and in combination with any of the tracks or slots shown or described herein. FIG. 46 illustrates a tubular dunnage support 326 having a middle portion 328 inside a dunnage receiver or pocket 282 and two outer portions 330 (only one being shown). As shown in FIG. 46, the middle or central portion 328 of dunnage support 326 comprises a tubular wall 332 and a hollow interior 334. As best shown in FIG. 46, each dunnage support 326 at each end has an outer portion 330 (only one being shown) outside the dunnage receiver or pocket 282. Each outer portion 330 comprises a neck portion 336 and an end portion 338 outside the neck portion 336. The end portion 338 is approximately the same diameter as the middle portion 328 of the tubular dunnage support 326. On each side of each neck portion 336 is a tapered portion 340. As shown in FIG. 46A, the neck portion 336 has a circular cross-section with an outer diameter less than the outer diameter of the tubular wall 332 of the middle or central portion 328 of dunnage support 326.

The neck portion 336 may rest on top of one of the rounded edges of one of the tracks or inside one of the slots and may slide thereon. The neck portion 336 is sized to reside in the interior of one of the tracks or inside one of the slots.

The dunnage supports 326 may be used in connection with any of tracks shown or described herein. In such situations, the neck portions 336 of each dunnage support 326 move along the slotted tracks at the same level, the neck portions 336 sliding along the slotted tracks. The end portions 338 of the dunnage supports 326 reside inside the interiors of the slotted tracks.

The dunnage supports 326 may also be used with any of the containers having guides having slotted tracks shown or described herein. In such situations, the neck portions 336 of each dunnage support 326 move along the slotted tracks of opposed guides at the same level. The end portions 338 of each dunnage support 326 reside outside the slotted guides 304 and move in the gaps between the slotted guides 304 and container sides upon movement of the dunnage support 326.

Dunnage supports 326 may be any desired configuration and are not intended to be limited by the drawings of this document. Similarly, the location and size of neck portions 336 of dunnage supports 326 is not intended to be limited by the drawings of this document. Each dunnage support 326 may be a single unitary piece or multiple pieces joined together as shown generally in FIGS. 14 and 15.

Figure 47:
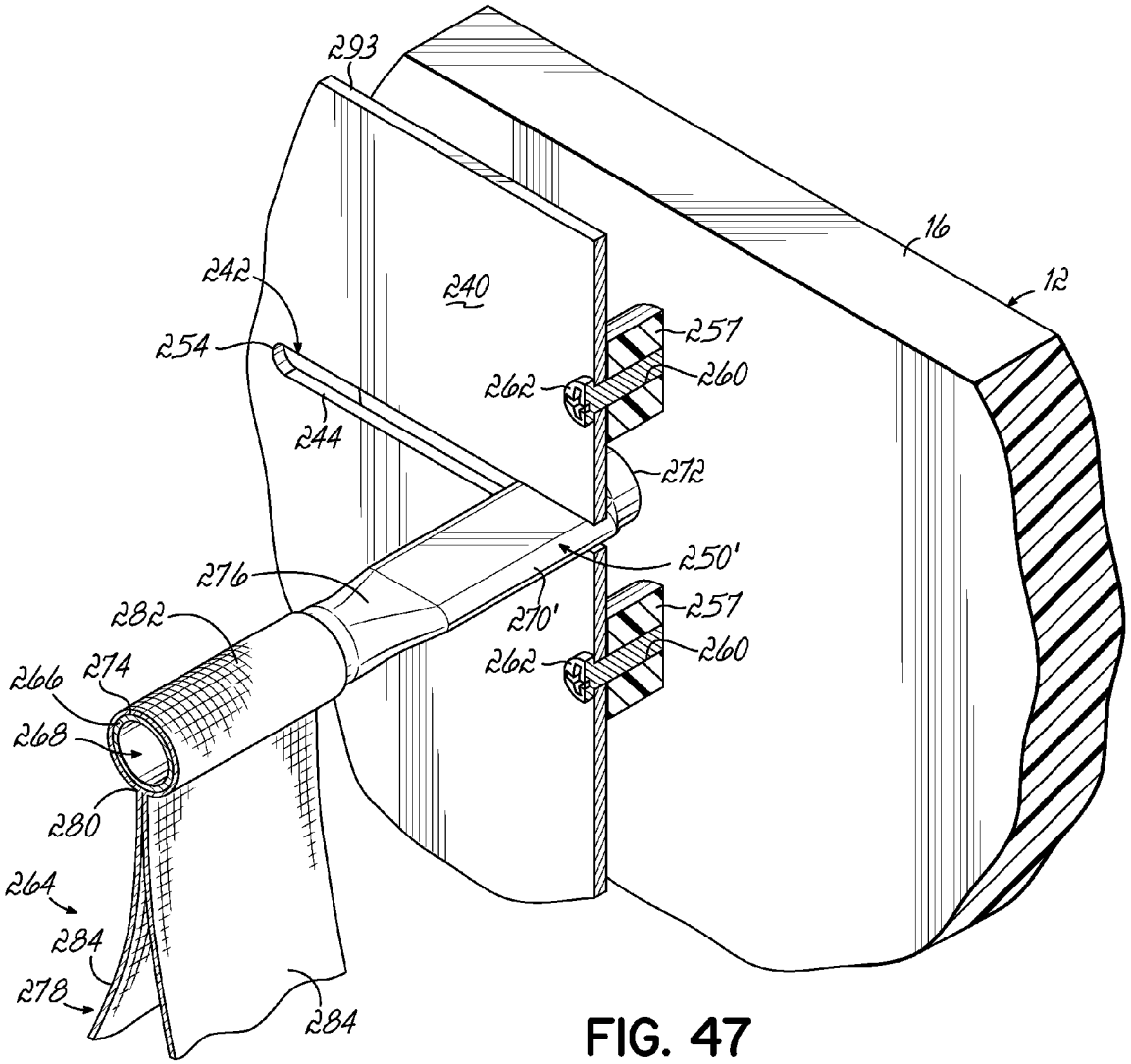
FIG. 47 is a perspective view showing one end of a different dunnage support.
Figure 47A:
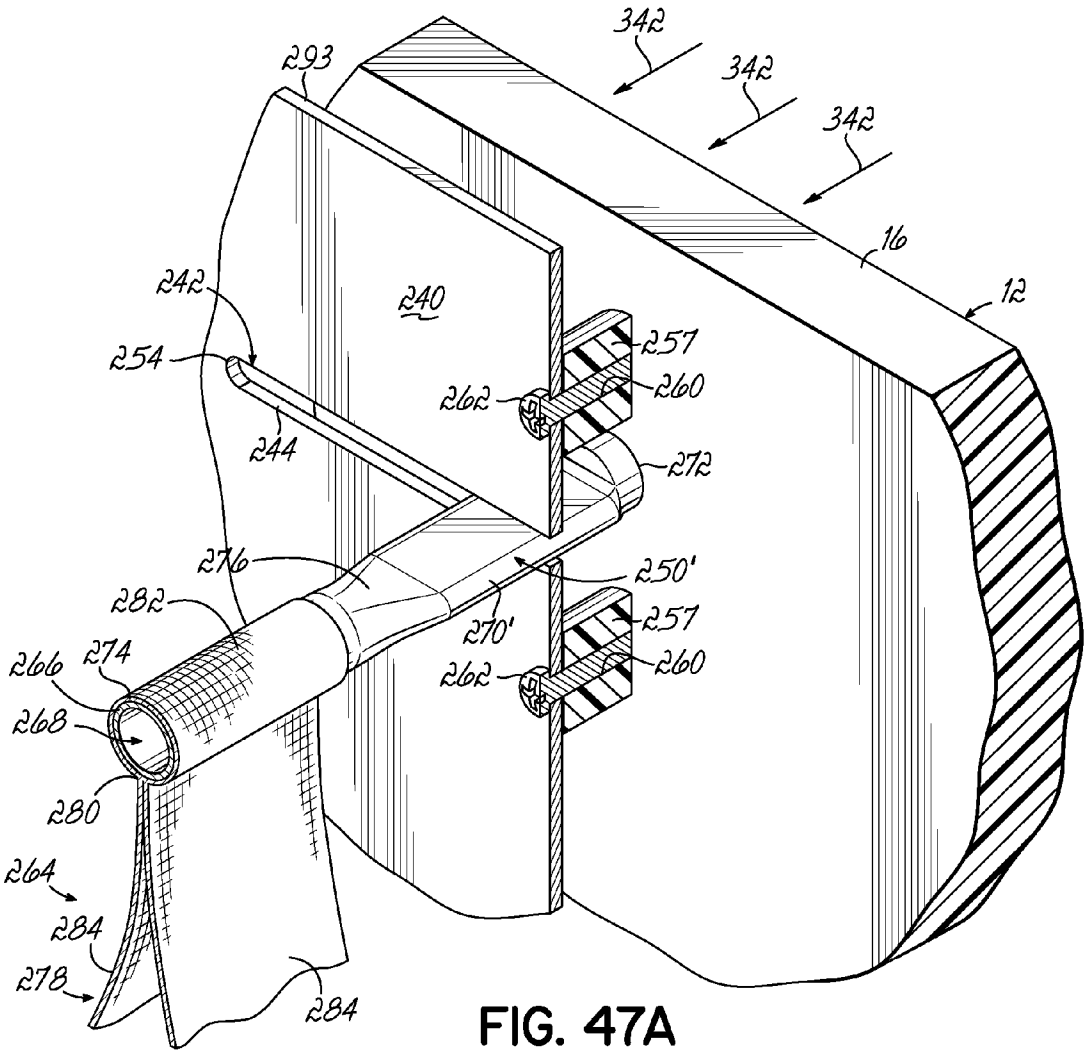
FIG. 47A is a perspective view showing the guide of the container of FIG. 47 being pushed inwardly.
Figure 47B:
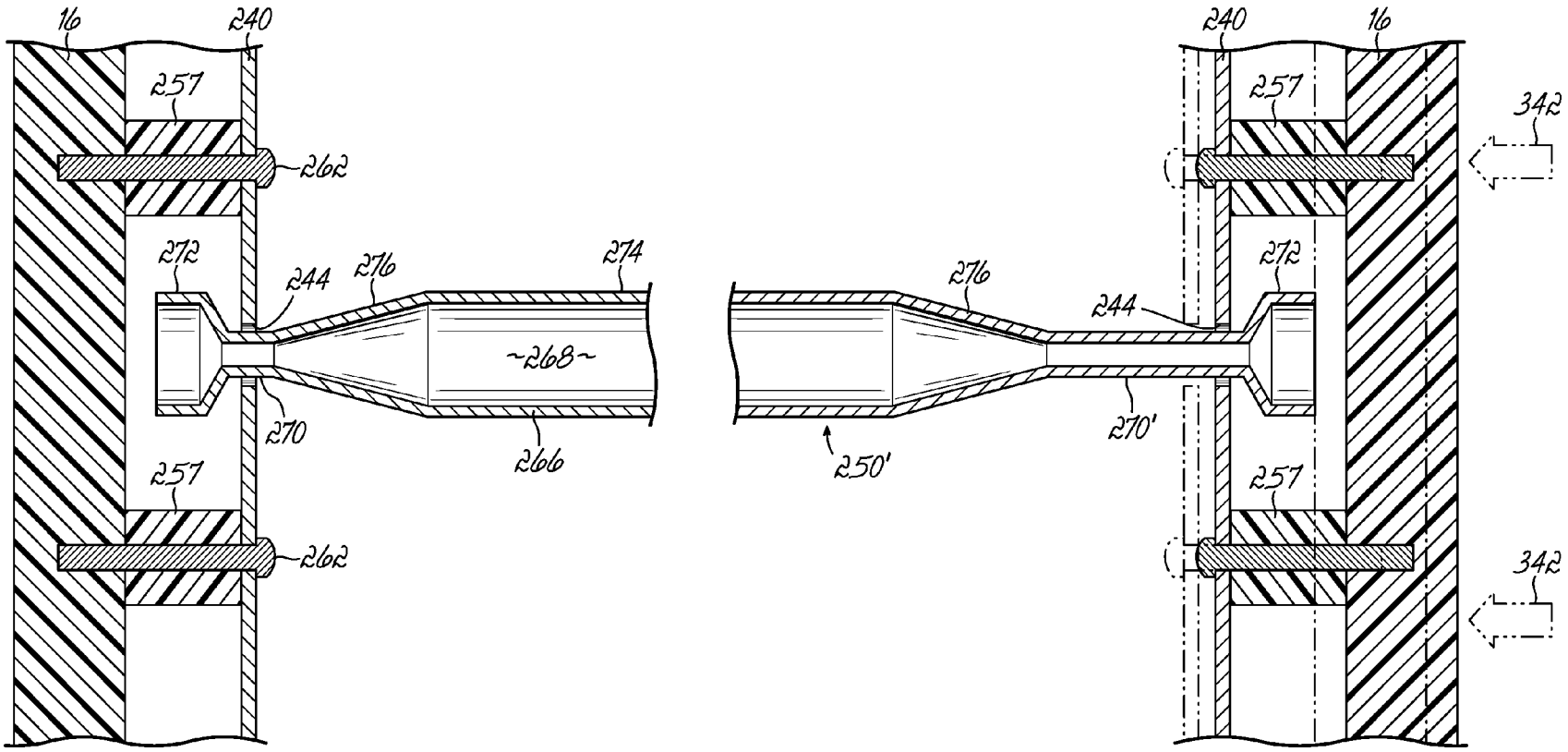
FIG. 47B is a cross-sectional view showing the guide of the container of FIG. 47 being pushed inwardly.

FIGS. 47, 47A and 47B illustrate another embodiment of dunnage support 250' which may be used in any of the containers shown or described herein, with any desired dunnage and in combination with any of the tracks or slots shown or described herein. FIG. 47B illustrates dunnage support 250' being a unitary member and extending between a pair of generally "L-shaped" slotted tracks 242 at the same level or height. The guides 240, in combination with the side walls 16, support the weight of the dunnage supports 250' and dunnage 264 suspended from the dunnage supports 250'. Each dunnage support 250' has two narrowed or crimped portions 270, 270' which are different lengths; the narrowed or crimped portion 270' shown in FIG. 47 being longer than the narrowed or crimped portion 270 shown in FIG. 42. The narrowed or crimped portions 270, 270' of dunnage support 250' (narrowed or crimped portion 270' being shown in FIG. 47 and narrowed or crimped portion 270 being shown in FIG. 40) contact and move along the generally "L-shaped" slotted tracks 242 of opposed guides 240 at the same vertical level or height. Outside of each narrowed or crimped portion 270, 270' is an end portion 272 which is approximately the same diameter as the middle portion 274 of the tubular dunnage support 250'. Inside of each narrowed or crimped portion 270, 270' is a tapered portion 276. See FIG. 47B.

Although the drawings show dunnage support 250' having its elongated narrowed or crimped portion 270' proximate side wall 16, the dunnage supports 250' may be reversed. The elongated narrowed or crimped portions 270' of dunnage supports 250' may be proximate side wall 16 and the regular sized narrowed or crimped portions 270 of dunnage supports 250' may be proximate the other side wall 16. Alternatively, both sides of the dunnage supports (not shown) may have elongated narrowed or crimped portions 270' moving inside slotted tracks of a container. Not all dunnage supports inside a container must be identical. Some dunnage supports may have one or two elongated narrowed or crimped portions 270'.

FIGS. 47A and 47B illustrate one purpose for using dunnage supports having at least one elongated narrowed or crimped portion inside a slotted track. As shown in FIGS. 47A and 47B, in the event a force, from a forklift, for example, is exerted inwardly in the direction of arrows 342 on one of the side walls, the side wall 16 and associated guide 240 are moved inwardly to a collapsed position shown in dashed lines in FIG. 47B. Due to the elongated narrowed or crimped portion 270' of dunnage support 250', the guide 240 may move inwardly (from the position shown in solid lines to the collapsed position shown in dashed lines) without damaging the dunnage support 250'.

Each dunnage support 250' may be any desired configuration and is not intended to be limited by the drawings of this document. Similarly, the location and length of each narrowed or crimped portion 270, 270' of each dunnage support 250, 250', respectively, is not intended to be limited by the drawings of this document. Each dunnage support may be a single unitary piece or multiple pieces joined together, as shown generally in FIGS. 14 and 15. Although the dunnage supports 250' are shown in a pallet box-type container 10*k*, they may be used in any container shown or described herein, including a rack-style container like the container 10*l* shown in FIG. 42.

FIGS. 48 and 49 illustrate a reusable and returnable container 10*m* according to another embodiment. The container 10*m* has the same components as container 10*k*, shown in FIGS. 39, 40 and 41 and described herein except for the guides. Container 10*m* has two guides 344, each guide 344 having a generally "L-shaped" slotted track 350. Each of the guides 344 of container 10*m* is spaced from and secured to one of the side walls 16, as shown and described herein. As best shown in FIG. 49, each guide 344 is made of multiple pieces 346, 347 and 348 which fit together like a puzzle to create a generally "L-shaped" slotted track 350. Although the drawings show three pieces combined to create a generally "L-shaped" slotted track 350, one skilled in the art will appreciate that any number of pieces may be used to create any number of slots and, therefore, any desired number of movable dunnage levels.

As shown in FIG. 49, each of the guide pieces 346, 347 and 348 has openings 352 therein adapted to allow fasteners to pass through the openings 352, through one or more spacers and into one of the container sides or side structures, as described herein. As shown in FIG. 49, each of the guide pieces 346, 347 and 348 has generally "V-shaped" teeth 357 and generally "V-shaped" intents 358. When the guide pieces 346, 347 and 348 are aligned as shown in FIG. 49, teeth 357 of one piece engage the intents 358 of adjacent pieces to inhibit horizontal movement of the guide pieces. The linear distance between the lower edge of one piece and the upper edge of another piece defines the height of one of the slots 350. Although the drawings show generally "V-shaped" teeth 357 in select locations of guide pieces 346, 347 and 348 extending into generally "V-shaped" intents 358 of adjacent pieces, any other number of teeth and indents may be used in any of the embodiments shown or described. The teeth and indents may be other configurations than those illustrated in any of the embodiments shown or described.

FIG. 50 illustrates a guide 372 having multiple parallel slots 374, all extending into a downwardly directed slot 376. Although three generally horizontally oriented slots 374 are illustrated, one skilled in the art may appreciate that any number of generally horizontally oriented slots 374 may be used depending upon the desired number of levels of movable dunnage. At the juncture of each generally horizontally oriented slot 374 and downwardly directed slot 376, a bump 398 is located to keep the dunnage supports from entering the downwardly directed slot 376. As shown in FIG. 50, each of the guides 272 may have a cut-out 399 (shown in dashed lines) below bump 398 in which material is removed so that the bump 398 may be moved downwardly easily so that dunnage supports and/or associated dunnage may move from the generally horizontally oriented track portion 374 into the generally vertically oriented track portion 376. Although not shown, each of the guides may have a generally vertically oriented slot at each end of each generally horizontally oriented slot. Such a guide would have two downwardly directed or generally vertically oriented slots and potentially two bumps, each being located at an end of each of the generally horizontally oriented slots.

While various embodiments of the present invention have been illustrated and described in considerable detail, it is not the intention of the Applicants to restrict or in any way limit the scope of the claims to such detail. Additional advantages and modifications will readily appear to those skilled in the art. The invention in its broader aspect is, therefore, not limited to the specific details, representative system, apparatus, and method, and illustrative example shown and described. Accordingly, departures may be made from such details without departing from the spirit or scope of the Applicants' general inventive concept.

What is claimed is:

1. A container for holding product therein during shipment, the container comprising:

a bottom, a front, a rear and two sides;

two stationary guides, each of the guides being spaced inwardly from one of the sides of the container and generally parallel to the container sides, each of the guides being secured to one of the sides of the container and having a generally L-shaped slotted track fully extending through the guide, each of the generally L-shaped slotted tracks having at least one substantially horizontally oriented portion and at least one substantially vertically oriented portion extending towards the bottom from each substantially horizontally oriented portion and terminating proximate the container bottom; and a plurality of movable dunnage supports generally inside the container, each of the dunnage supports having a narrowed portion at each end, the narrowed portions of each dunnage support being engaged with and slidable along the slotted tracks to facilitate movement of dunnage supported by the dunnage supports.

2. The container of claim 1 further comprising at least one door.

3. The container of claim 1 wherein the dunnage comprises pouches.

4. The container of claim 1 wherein each of the dunnage supports is tubular.

5. The container of claim 1 further comprising multiple spacers located between each guide and each side of the container.

6. The container of claim 1 wherein each of the guides is a single member.

7. The container of claim 1 wherein at least one of the dunnage supports comprises multiple pieces.

8. The container of claim 1 wherein at least one of the dunnage supports is a unitary member.

9. The container of claim 2 wherein each door comprises multiple pieces.

10. A container for holding product therein during shipment, the container comprising:

a bottom and two side structures;

two stationary guides, each of the guides being supported by one of the side structures, each of the guides having an L-shaped slotted track fully extending through the guide, each of the generally L-shaped slotted tracks having at least one substantially horizontally oriented portion and at least one substantially vertically oriented portion extending towards the bottom from an end of each substantially horizontally oriented portion and terminating proximate a lower edge of the guide; and movable dunnage supports generally inside the container, each of the dunnage supports having narrowed portions, the narrowed portions of each dunnage support being engaged with and slidable along the slotted tracks to facilitate movement of the dunnage supports; and dunnage supported by the dunnage supports.

11. The container of claim 10 further comprising at least one door.

12. The container of claim 11 wherein each door comprises multiple pieces.

13. The container of claim 10 wherein the dunnage comprises pouches.

14. The container of claim 10 wherein at least one of the dunnage supports comprises multiple pieces.

15. The container of claim 10 wherein at least one of the dunnage supports comprises a unitary piece.

16. The container of claim 10 further comprising multiple spacers located between each guide and each side of the container.

17. A container for holding product therein during shipment, the container comprising:

a bottom and two opposed sides;

two guides, each guide being spaced from one of the sides of the container by at least one spacer, each of the guides having an L-shaped slotted track extending fully through the guide and comprising at least one generally horizontally oriented portion and at least one generally vertically oriented portion extending towards the bottom from each generally horizontally oriented portion and terminating proximate a lower edge of the guide;

a plurality of dunnage supports extending between opposed slotted tracks, each of the dunnage supports having narrowed portions, the narrowed portions of each dunnage support being engaged with and slidable along the slotted tracks to facilitate movement of the dunnage supports; and dunnage suspended by the dunnage supports.

18. The container of claim 17 wherein the dunnage comprises pouches hanging from the dunnage supports.

19. The container of claim 17 further comprising at least one slidable door.

20. The container of claim 17 further comprises a door having multiple segments, each of the segments being vertically movable.

* * * * *